US010994882B2

(12) United States Patent
Sanfilippo et al.

(10) Patent No.: US 10,994,882 B2
(45) Date of Patent: May 4, 2021

(54) APPARATUS AND METHOD FOR MAKING A FLEXIBLE PACKAGE

(71) Applicant: PRIMAPAK, LLC, Elgin, IL (US)

(72) Inventors: John E. Sanfilippo, Barrington Hills, IL (US); James J. Sanfilippo, Barrington Hills, IL (US); Francisco Javier Soria, West Chicago, IL (US); Milorad Radenovic, Chicago, IL (US); George Golota, Glenview, IL (US)

(73) Assignee: PRIMAPAK, LLC, Elgin, IL (US)

( * ) Notice: Subject to any disclaimer, the term of this patent is extended or adjusted under 35 U.S.C. 154(b) by 671 days.

(21) Appl. No.: 15/308,494

(22) PCT Filed: May 19, 2015

(86) PCT No.: PCT/US2015/031556
§ 371 (c)(1),
(2) Date: Nov. 2, 2016

(87) PCT Pub. No.: WO2015/179384
PCT Pub. Date: Nov. 26, 2015

(65) Prior Publication Data

US 2017/0096248 A1 Apr. 6, 2017

Related U.S. Application Data

(60) Provisional application No. 62/073,760, filed on Oct. 31, 2014, provisional application No. 62/053,001,
(Continued)

(51) Int. Cl.
*B65B 61/24* (2006.01)
*B65B 61/28* (2006.01)
(Continued)

(52) U.S. Cl.
CPC ..... *B65B 61/24* (2013.01); *B65B 9/2049* (2013.01); *B65B 9/213* (2013.01); *B65B 51/26* (2013.01); *B65B 61/18* (2013.01); *B65B 61/28* (2013.01)

(58) Field of Classification Search
CPC ..... B65B 61/18; B65B 61/24; B65B 61/28; B65B 9/213; B65B 9/2049; B65B 51/18;
(Continued)

(56) References Cited

U.S. PATENT DOCUMENTS 724,316 A 3/1903 Staples
1,102,750 A 7/1914 Hawkins
(Continued)

FOREIGN PATENT DOCUMENTS

DE 102010019867 A1 9/2011
EP 0085349 A2 8/1983
(Continued)

OTHER PUBLICATIONS

Brody et al., *Encyclopedia of Packaging Technology*, 2nd ed., New York, NY: John Wiley & Sons (1993).
(Continued)

*Primary Examiner* — Thanh K Truong
*Assistant Examiner* — David G Shutty
(74) *Attorney, Agent, or Firm* — Marshall, Gerstein & Borun LLP

(57) ABSTRACT

An apparatus for forming a flexible package can include a forming box having a first, second, and third portions that cooperate to define first, second, third, and fourth walls of the forming box, and one or more forming box actuators operatively coupled to the forming box to actuate the forming box between a first position for receiving a package, a second position for retaining a package, and a third position for releasing the package. The apparatus can also
(Continued)

include a first flap folding bar disposed upstream and adjacent a first end of the forming box, and one or more first flap folding bar actuators operatively coupled to the first flap folding bar to actuate the first flap folding bar in a direction substantially transverse to a transport path of a flexible material.

28 Claims, 40 Drawing Sheets

Related U.S. Application Data filed on Sep. 19, 2014, provisional application No. 62/000,510, filed on May 19, 2014.

(51) Int. Cl.
*B65B 51/26* (2006.01)
*B65B 9/20* (2012.01)
*B65B 61/18* (2006.01)
*B65B 9/213* (2012.01)

(58) Field of Classification Search
CPC ..... B65B 51/26; B65B 51/28; B31B 50/004; B31B 50/0042; B31B 50/0044; B31B 50/48; B31B 50/682; B31B 50/686
USPC ..... 53/373.2, 374.8, 375.3, 375.9, 387.3, 53/387.4, 479, 561, 567, 574, 575; 493/51, 69, 70, 79
See application file for complete search history.

(56) References Cited

U.S. PATENT DOCUMENTS 1,389,197 A 8/1921 Kusterer
1,395,229 A 10/1921 Inman et al.
1,747,618 A 2/1930 Burns
1,930,285 A 10/1933 Robinson
2,017,176 A 10/1935 Andrews
2,041,227 A 5/1936 Chalmers
2,048,122 A 7/1936 Howard
2,092,858 A 9/1937 Richard
2,106,907 A 2/1938 Brunt et al.
2,113,431 A 4/1938 Milliken
2,153,310 A 4/1939 Newman
2,180,841 A 11/1939 Vogt
2,239,398 A 4/1941 Palmer
2,251,283 A 8/1941 Johnson
2,259,866 A 10/1941 Stokes
2,260,064 A 10/1941 Stokes
2,291,063 A 7/1942 Staude et al.
2,311,857 A 2/1943 Noah
2,328,579 A 9/1943 Pelosi
2,330,015 A 9/1943 Stokes
2,339,156 A 1/1944 Duane
2,352,766 A 7/1944 Bogue
2,365,159 A 12/1944 Walton
2,385,898 A 10/1945 Waters
2,416,332 A 2/1947 Lehman
2,495,807 A 1/1950 Buttery
2,508,962 A 5/1950 Moore
2,524,766 A 10/1950 Carroll
2,619,226 A 11/1952 Adams
2,684,807 A 7/1954 Gerrish
2,695,847 A 11/1954 Fisher
2,719,663 A 10/1955 Meyer-Jagenberg
2,737,338 A 3/1956 Moore
2,749,245 A 6/1956 Peters
2,750,093 A 6/1956 Moore
2,758,775 A 8/1956 Moore
2,787,410 A 4/1957 Moore
2,819,831 A 1/1958 Polarek et al.
2,823,795 A 2/1958 Moore
2,864,710 A 12/1958 Pottle et al.
2,936,940 A 5/1960 Berghgracht
2,970,735 A 2/1961 Jacke
3,006,257 A 10/1961 Orsini
3,054,550 A 9/1962 Comstock
3,091,902 A 6/1963 Grafingholt
3,111,223 A 11/1963 Jacobi
3,116,153 A 12/1963 Seiferth et al.
3,125,275 A 3/1964 Ehe
3,127,082 A 3/1964 Meyer-Jagenberg
3,143,276 A 8/1964 Nichols
3,155,304 A 11/1964 Beerend
3,172,769 A 3/1965 Horan
3,185,379 A 5/1965 Kohlhaas
3,206,094 A 9/1965 Humphrey
3,228,584 A 1/1966 Ashton
3,228,587 A 1/1966 Segebrecht
3,235,168 A 2/1966 Nichols
3,249,286 A 5/1966 Palmer
3,259,303 A 7/1966 Repko
3,259,507 A 7/1966 Smith
3,272,423 A 9/1966 Bjarno
3,275,214 A 9/1966 Carangelo
3,299,611 A 1/1967 Hendrick et al.
3,314,591 A 4/1967 Cheeley
3,318,204 A 5/1967 Crane
3,325,077 A 6/1967 Boegershausen
3,326,097 A 6/1967 Lokey
3,332,198 A 7/1967 Thesing
3,339,721 A 9/1967 Goldstein
3,349,959 A 10/1967 Watkins
3,373,917 A 3/1968 Cox
3,380,646 A 4/1968 Doyen et al.
3,423,007 A 1/1969 Christensson
3,426,499 A 2/1969 Paige
3,434,652 A 3/1969 Shore
3,437,258 A 4/1969 Kugler
3,462,067 A 8/1969 Shore
3,505,779 A 4/1970 Kopp
3,515,270 A 6/1970 Yang et al.
3,521,807 A 7/1970 Weisberg
3,562,392 A 2/1971 Mylius
3,599,387 A 8/1971 James
3,604,491 A 9/1971 Spiess
3,621,637 A 11/1971 Sternau
3,738,567 A 6/1973 Ruda
3,739,977 A 6/1973 Shapiro et al.
3,785,112 A 1/1974 Leasure et al.
3,838,787 A 10/1974 McCloskey
3,917,158 A 11/1975 Dorofachuk et al.
3,935,993 A 2/1976 Doyen et al.
3,940,054 A 2/1976 Goebel et al.
3,968,921 A 7/1976 Jewell
3,980,225 A 9/1976 Kan
4,004,398 A * 1/1977 Larsson ..... B65B 31/00 53/511
4,041,851 A 8/1977 Jentsch
4,069,348 A 1/1978 Bush
4,082,214 A 4/1978 Baker
4,082,216 A 4/1978 Clarke
4,101,051 A 7/1978 Reil
4,129,976 A 12/1978 Grundler et al.
4,185,754 A 1/1980 Julius
4,192,420 A 3/1980 Worrell, Sr. et al.
4,197,949 A 4/1980 Carlsson
4,252,052 A * 2/1981 Meyers ..... B31B 50/00 493/134
4,260,061 A 4/1981 Jacobs
4,265,074 A * 5/1981 Reuter ..... B65B 65/003 53/374.6
4,291,826 A 9/1981 Swanson
4,308,679 A 1/1982 Ray et al.
4,338,766 A 7/1982 Hamilton
D265,777 S 8/1982 Elzea et al.
4,345,133 A 8/1982 Cherney et al.
4,345,393 A 8/1982 Price et al.
D266,049 S 9/1982 Conti
4,353,497 A 10/1982 Bustin
4,361,266 A 11/1982 Killy

(56) References Cited

U.S. PATENT DOCUMENTS 4,367,842 A 1/1983 Rausing
4,420,080 A 12/1983 Nakamura
4,441,648 A 4/1984 Portsmouth
4,442,656 A 4/1984 Wylie, Sr.
4,512,138 A * 4/1985 Greenawalt ..... B29C 65/02 219/243
4,531,668 A 7/1985 Forbes, Jr.
4,552,269 A 11/1985 Chang
4,554,190 A 11/1985 McHenry et al.
4,576,309 A 3/1986 Tzifkansky et al.
4,589,145 A 5/1986 Van Erden et al.
D286,745 S 11/1986 Forbes, Jr.
4,621,000 A 11/1986 Frick
4,651,874 A 3/1987 Nakamura
4,663,915 A 5/1987 Van Erden et al.
4,674,129 A 6/1987 Janhonen
4,679,693 A 7/1987 Forman
4,679,701 A 7/1987 Ackermann et al.
4,687,104 A 8/1987 Lelmini
4,696,404 A 9/1987 Corella
4,738,365 A 4/1988 Prater
D297,214 S 8/1988 Forbes, Jr.
4,786,192 A 11/1988 Graves et al.
4,790,436 A 12/1988 Nakamura
4,798,295 A 1/1989 Rausing
4,804,137 A 2/1989 Harby
4,808,421 A 2/1989 Mendenhall et al.
4,811,848 A 3/1989 Jud
4,837,849 A 6/1989 Erickson et al.
4,840,270 A 6/1989 Caputo et al.
4,848,575 A 7/1989 Nakamura et al.
4,851,246 A 7/1989 Maxwell et al.
4,861,328 A * 8/1989 Franke ..... B31B 50/00 493/470
D304,016 S 10/1989 Forbes, Jr.
4,881,360 A 11/1989 Konzal et al.
4,886,373 A 12/1989 Corella
4,909,017 A 3/1990 McMahon et al.
4,954,124 A 9/1990 Erickson et al.
4,986,054 A 1/1991 McMahon
D315,099 S 3/1991 Alizard
4,997,416 A 3/1991 Mitchell et al.
5,031,826 A 7/1991 Seufert
5,036,997 A 8/1991 May et al.
5,044,777 A 9/1991 Watkins et al.
5,046,300 A 9/1991 Custer et al.
5,059,036 A 10/1991 Richison et al.
5,062,527 A 11/1991 Westerman
5,065,887 A 11/1991 Schuh et al.
5,078,509 A 1/1992 Center et al.
5,080,643 A 1/1992 Mitchell et al.
5,092,831 A 3/1992 James et al.
5,127,208 A 7/1992 Custer et al.
5,158,371 A 10/1992 Moravek
5,158,499 A 10/1992 Guckenberger
D332,399 S 1/1993 Neff
5,195,829 A 3/1993 Watkins et al.
5,205,651 A 4/1993 Decottignies et al.
5,215,380 A 6/1993 Custer et al.
5,251,809 A 10/1993 Drummond et al.
5,254,073 A 10/1993 Richison et al.
5,255,497 A 10/1993 Zoromski et al.
5,350,240 A 9/1994 Billman et al.
D351,090 S 10/1994 Narsutis
5,352,466 A 10/1994 Delonis
5,353,946 A 10/1994 Behrend
5,356,069 A 10/1994 Bochet et al.
5,366,104 A 11/1994 Armstrong
D354,436 S 1/1995 Krupa
5,417,035 A 5/1995 English
D364,563 S 11/1995 Miller et al.
5,463,851 A 11/1995 Nagai
5,484,101 A 1/1996 Hedberg
5,498,080 A 3/1996 Dalea et al.
5,505,040 A 4/1996 Janssen et al.
5,505,305 A 4/1996 Scholz et al.
5,542,902 A 8/1996 Richison et al.
5,545,420 A 8/1996 Lipinski et al.
5,556,026 A 9/1996 Blankitny
D374,774 S 10/1996 Cassel
5,561,966 A 10/1996 English
5,577,612 A 11/1996 Chesson et al.
5,611,452 A 3/1997 Bonora et al.
5,613,608 A 3/1997 Tronchetti et al.
5,655,706 A 8/1997 Vandiver
D386,001 S 11/1997 Saffran
5,687,848 A 11/1997 Scholz et al.
5,704,480 A 1/1998 Scholz et al.
5,704,541 A 1/1998 Mogard
D394,606 S 5/1998 Zorn et al.
5,749,512 A 5/1998 Gingras-Taylor
5,770,839 A 6/1998 Ruebush et al.
5,772,332 A 6/1998 Geller
D395,952 S 7/1998 Buczwinski et al.
5,785,179 A 7/1998 Buczwinski et al.
5,788,121 A 8/1998 Sasaki et al.
5,788,378 A 8/1998 Thomas
5,789,049 A 8/1998 Randles
5,791,465 A 8/1998 Niki et al.
D398,526 S 9/1998 Schwarz et al.
D398,844 S 9/1998 Oberloier
5,799,863 A 9/1998 Capy et al.
5,818,016 A 10/1998 Lorence et al.
5,820,017 A 10/1998 Eliovson et al.
5,826,401 A 10/1998 Bois
5,832,701 A 11/1998 Hauers et al.
5,842,790 A 12/1998 Imer
5,852,919 A * 12/1998 Matsuda ..... B65B 9/20 53/551
5,857,613 A 1/1999 Drummond et al.
5,858,543 A 1/1999 Futter et al.
5,862,652 A 1/1999 Schoeler
5,882,749 A 3/1999 Jones et al.
5,882,789 A 3/1999 Jones et al.
5,897,050 A 4/1999 Barnes
D409,484 S 5/1999 Tasker
5,908,246 A 6/1999 Arimura et al.
D412,439 S 8/1999 Cormack
5,937,615 A 8/1999 Forman
5,944,425 A 8/1999 Forman
5,970,687 A * 10/1999 Katayama ..... B65B 9/20 53/451
5,972,396 A 10/1999 Jurgovan et al.
5,983,594 A 11/1999 Forman
5,993,593 A 11/1999 Swartz et al.
6,005,234 A 12/1999 Moseley et al.
6,021,624 A 2/2000 Richison et al.
6,023,914 A 2/2000 Richison et al.
6,026,953 A 2/2000 Nakamura et al.
D421,901 S 3/2000 Hill
D421,902 S 3/2000 Hill
6,036,365 A 3/2000 Imer
6,038,839 A 3/2000 Linkiewicz
6,056,141 A 5/2000 Navarini et al.
6,060,096 A 5/2000 Hanson et al.
D427,056 S 6/2000 Irace et al.
6,088,998 A 7/2000 Malin et al.
6,113,271 A 9/2000 Scott et al.
6,120,183 A 9/2000 Buchanan et al.
D431,464 S 10/2000 Collins et al.
6,132,351 A 10/2000 Lotto et al.
6,137,098 A 10/2000 Moseley et al.
6,139,662 A 10/2000 Forman
6,149,304 A 11/2000 Hamilton et al.
D437,686 S 2/2001 Balzar et al.
6,182,887 B1 2/2001 Ljunstrom et al.
6,195,965 B1 * 3/2001 Tobolka ..... B29C 65/18 493/218
6,229,061 B1 5/2001 Dragoo et al.
6,231,237 B1 5/2001 Geller
6,234,676 B1 5/2001 Galomb et al.
6,245,367 B1 6/2001 Galomb
6,250,048 B1 6/2001 Linkiewicz
6,253,993 B1 7/2001 Lloyd et al.

(56) References Cited

U.S. PATENT DOCUMENTS 6,254,907 B1 7/2001 Galomb
6,261,215 B1 7/2001 Imer
D446,014 S 8/2001 Adkins
6,273,610 B1 8/2001 Koyama et al.
6,274,181 B1 8/2001 Richison et al.
6,309,105 B1 10/2001 Palumbo
D450,960 S 11/2001 Boyea et al.
6,319,184 B1 11/2001 DeMatteis et al.
D452,374 S 12/2001 Kim
6,325,239 B2 12/2001 Randall et al.
6,350,057 B1 2/2002 Forman
6,354,062 B1 3/2002 Haughton et al.
6,361,212 B1 3/2002 Sprehe et al.
6,412,634 B1 7/2002 Telesca et al.
6,420,006 B1 7/2002 Scott
6,423,356 B2 7/2002 Richison et al.
D461,403 S 8/2002 Chomik et al.
6,428,867 B1 8/2002 Scott et al.
6,430,899 B1 8/2002 Cicha
6,431,434 B1 8/2002 Haughton et al.
D463,276 S 9/2002 Piscopo et al.
6,446,796 B1 9/2002 Schmidt
D464,884 S 10/2002 Sumpmann et al.
D464,894 S 10/2002 Mittersinker et al.
6,481,183 B1 11/2002 Schmidt
D466,807 S 12/2002 Buck et al.
6,488,556 B2 12/2002 Galomb
6,502,986 B1 1/2003 Bensur et al.
6,510,673 B1 1/2003 Visona' et al.
6,513,308 B1 * 2/2003 Meeuwesen ..... B65B 9/20
493/302
D471,804 S 3/2003 Staples
6,533,456 B1 3/2003 Buchman
D473,461 S 4/2003 Joubert
6,568,150 B2 5/2003 Forman
6,589,622 B1 7/2003 Scott
6,615,567 B2 9/2003 Kuhn et al.
6,659,645 B1 12/2003 Schulz
D485,461 S 1/2004 Sams et al.
6,679,034 B2 1/2004 Kohl et al.
6,695,757 B2 2/2004 Edwards et al.
D487,192 S 3/2004 Farnham et al.
6,702,109 B1 3/2004 Tabuchi
6,719,140 B1 4/2004 Rinsler
6,719,678 B1 4/2004 Stern
D489,530 S 5/2004 Lindsay
6,729,112 B2 5/2004 Kuss et al.
6,736,309 B1 5/2004 Westerman et al.
6,746,388 B2 6/2004 Edwards et al.
6,755,927 B2 6/2004 Forman
6,761,279 B1 7/2004 Martin et al.
6,783,277 B2 8/2004 Edwards et al.
6,817,160 B2 11/2004 Schmidt
6,820,391 B2 11/2004 Barmore et al.
D501,134 S 1/2005 Takahashi et al.
6,845,602 B2 1/2005 Drut
D502,095 S 2/2005 Tucker et al.
D503,336 S 3/2005 Tucker et al.
D504,622 S 5/2005 Takahashi et al.
6,886,313 B2 5/2005 Knoerzer et al.
6,913,389 B2 7/2005 Kannankeril et al.
6,918,532 B2 7/2005 Sierra-Gomez et al.
6,935,086 B2 8/2005 Brenkus et al.
6,953,069 B2 10/2005 Galomb
D513,870 S 1/2006 Rosine et al.
6,986,920 B2 1/2006 Forman et al.
D514,439 S 2/2006 Snedden et al.
7,051,877 B2 5/2006 Lin
7,059,466 B2 6/2006 Lees et al.
7,077,259 B2 7/2006 Breidenbach
7,080,726 B2 7/2006 Breidenbach et al.
D528,010 S 9/2006 Yashima et al.
7,108,441 B2 9/2006 Altonen et al.
7,128,200 B2 10/2006 Lees et al.
D531,894 S 11/2006 Ramirez et al.
7,153,026 B2 12/2006 Galomb
7,156,556 B2 1/2007 Takahashi et al.
D536,608 S 2/2007 Arkins
RE39,505 E 3/2007 Thomas et al.
7,205,016 B2 4/2007 Garwood
7,207,717 B2 4/2007 Steele
7,213,710 B2 5/2007 Cotert
D544,762 S 6/2007 Zimmerman
D545,186 S 6/2007 Liebe et al.
D548,080 S 8/2007 Brown et al.
D551,508 S 9/2007 Friedland et al.
D552,468 S 10/2007 Seum et al.
7,299,608 B2 11/2007 Kohl et al.
7,350,688 B2 4/2008 Sierra-Gomez et al.
D569,719 S 5/2008 Ross
7,371,008 B2 5/2008 Bonenfant
D571,146 S 6/2008 Sanfilippo et al.
D571,197 S 6/2008 Sanfilippo et al.
7,475,781 B2 1/2009 Kobayashi et al.
D591,555 S 5/2009 Sanfilippo et al.
D593,369 S 6/2009 Green et al.
D608,193 S 1/2010 Sanfilippo et al.
7,665,629 B2 2/2010 Julius et al.
7,665,895 B2 2/2010 Takita et al.
7,717,620 B2 5/2010 Hebert et al.
7,744,517 B2 6/2010 Bonenfant
7,780,006 B2 8/2010 Clark, Jr. et al.
D629,296 S 12/2010 De Muynck
D637,577 S 5/2011 Han et al.
7,993,256 B2 8/2011 Takita et al.
8,006,833 B2 8/2011 Clark, Jr. et al.
8,038,349 B2 10/2011 Andersson et al.
D648,302 S 11/2011 Park et al.
8,066,137 B2 11/2011 Sanfilippo et al.
8,074,803 B2 12/2011 Motsch et al.
8,114,451 B2 2/2012 Sierra-Gomez et al.
8,132,395 B2 3/2012 Gehring et al.
8,182,891 B2 5/2012 Scott et al.
8,231,024 B2 7/2012 Sanfilippo et al.
8,245,865 B2 8/2012 Damaghi et al.
8,276,353 B2 10/2012 Reaves et al.
D671,000 S 11/2012 O'Neill et al.
8,308,363 B2 11/2012 Vogt et al.
D676,014 S 2/2013 Chung
8,407,974 B2 * 4/2013 Fontanazzi ..... B65B 9/2049
53/551
D682,244 S 5/2013 Park et al.
D686,181 S 7/2013 Jeong
D689,767 S 9/2013 Clark et al.
8,523,441 B2 9/2013 Goglio et al.
D696,107 S 12/2013 Kimple et al.
8,602,242 B2 12/2013 Sanfilippo et al.
8,602,244 B2 12/2013 Sanfilippo et al.
8,656,690 B2 * 2/2014 Bierschenk ..... B65B 1/26
53/551
8,746,483 B2 6/2014 Sierra-Gomez et al.
8,951,591 B2 2/2015 Vogt et al.
10,029,814 B2 * 7/2018 Galata' ..... B65B 61/24
2001/0005979 A1 7/2001 Kuss et al.
2001/0010253 A1 8/2001 Forman
2002/0009575 A1 1/2002 DeMatteis
2002/0090879 A1 7/2002 Galomb
2002/0094922 A1 7/2002 Edwards et al.
2002/0112982 A1 8/2002 Stagray et al.
2002/0118896 A1 8/2002 Forman
2002/0144998 A1 10/2002 Lees et al.
2002/0147088 A1 10/2002 Edwards
2003/0001002 A1 1/2003 Haughton et al.
2003/0041564 A1 3/2003 Schmidt
2003/0054929 A1 3/2003 Post et al.
2003/0059130 A1 3/2003 Yoneyama et al.
2003/0063820 A1 4/2003 Buchman
2003/0100424 A1 5/2003 Barmore et al.
2003/0111523 A1 6/2003 Haugan
2003/0113042 A1 6/2003 Yeager
2003/0152679 A1 8/2003 Garwood
2003/0165602 A1 9/2003 Garwood
2003/0170357 A1 9/2003 Garwood
2003/0170359 A1 9/2003 Garwood

(56) References Cited

U.S. PATENT DOCUMENTS

2003/0175392 A1 9/2003 Garwood
2003/0185937 A1 10/2003 Garwood
2003/0185948 A1 10/2003 Garwood
2003/0230504 A1 12/2003 Hamming
2004/0025476 A1 2/2004 Oliverio et al.
2004/0031244 A1 2/2004 Steele
2004/0040261 A1 3/2004 Troyer et al.
2004/0058103 A1 3/2004 Anderson et al.
2004/0081729 A1 4/2004 Garwood
2004/0089578 A1 5/2004 Lin
2004/0099570 A1 5/2004 Cargile
2004/0105600 A1 6/2004 Floyd
2004/0114838 A1 6/2004 McGregor
2004/0120611 A1 6/2004 Kannankeril et al.
2004/0141664 A1 7/2004 Olsen et al.
2004/0146602 A1 7/2004 Garwood et al.
2004/0185154 A1 9/2004 Garwood
2004/0185155 A1 9/2004 Garwood
2004/0185156 A1 9/2004 Garwood
2004/0188457 A1 9/2004 Galomb
2004/0226625 A1 11/2004 Galomb
2004/0226849 A1 11/2004 Brenkus et al.
2004/0232029 A1 11/2004 Cotert
2004/0244338 A1* 12/2004 Nievergeld ..... B29C 65/305 53/451
2004/0251163 A1 12/2004 Conde et al.
2004/0262322 A1 12/2004 Middleton et al.
2005/0011906 A1 1/2005 Buck et al.
2005/0031233 A1 2/2005 Varanese et al.
2005/0053315 A1 3/2005 Aasen
2005/0069227 A1 3/2005 Steele
2005/0069230 A1 3/2005 Takahashi et al.
2005/0084186 A1 4/2005 Caris
2005/0139645 A1 6/2005 Shean et al.
2005/0150785 A1 7/2005 Julius et al.
2005/0189367 A1 9/2005 Chasid et al.
2005/0208188 A1 9/2005 Garwood
2005/0238766 A1 10/2005 Henderson et al.
2005/0265636 A1 12/2005 Michalsky
2005/0276525 A1 12/2005 Hebert et al.
2005/0284776 A1 12/2005 Kobayashi et al.
2006/0006049 A1 1/2006 Breidenbach et al.
2006/0016865 A1 1/2006 Berglin et al.
2006/0076352 A1 4/2006 Peterson et al.
2006/0080944 A1 4/2006 Annehed et al.
2006/0113212 A1 6/2006 Steele
2006/0126970 A1 6/2006 Perell
2006/0169691 A1 8/2006 Rothschild et al.
2006/0210202 A1 9/2006 Plourde
2006/0283750 A1 12/2006 Villars et al.
2006/0285777 A1 12/2006 Howell et al.
2007/0080078 A1 4/2007 Hansen et al.
2007/0082096 A1 4/2007 Dougherty et al.
2007/0084142 A1 4/2007 Matthews
2007/0151887 A1 7/2007 Clark et al.
2008/0053860 A1 3/2008 McDonald
2008/0274686 A1 11/2008 Kupferberg et al.
2009/0039078 A1 2/2009 Sanfilippo et al.
2009/0113848 A1* 5/2009 Santi ..... B65B 61/24 53/374.7
2009/0120828 A1 5/2009 Sanfilippo et al.
2009/0193763 A1* 8/2009 Fontanazzi ..... B65B 49/08 53/456
2009/0232425 A1 9/2009 Tai et al.
2009/0273179 A1 11/2009 Scott et al.
2010/0002963 A1 1/2010 Holbert et al.
2010/0040311 A1 2/2010 Plate
2010/0092112 A1 4/2010 Goglio et al.
2010/0113240 A1 5/2010 Takita et al.
2010/0140129 A1 6/2010 Sanfilippo et al.
2010/0154264 A1 6/2010 Scott et al.
2010/0278454 A1 11/2010 Huffer
2011/0058755 A1 3/2011 Guibert
2011/0297690 A1 12/2011 Teys et al.
2012/0008884 A1 1/2012 Murray
2012/0125937 A1 5/2012 Ahlstrom et al.
2012/0177307 A1 7/2012 Duan et al.
2012/0275727 A1 11/2012 Chang
2012/0321229 A1 12/2012 Surdziel et al.
2013/0004626 A1 1/2013 Renders et al.
2013/0011527 A1 1/2013 Renders et al.
2013/0114918 A1 5/2013 Lyzenga et al.
2013/0227918 A1* 9/2013 Paradisi ..... B65B 1/02 53/551
2013/0266244 A1 10/2013 Doll et al.
2014/0083897 A1 3/2014 Sanfilippo et al.
2014/0102936 A1 4/2014 Sanfilippo et al.
2014/0109522 A1 4/2014 Sanfilippo et al.
2014/0185962 A1 7/2014 Sanfilippo et al.
2014/0196406 A1 7/2014 Sanfilippo et al.
2014/0301674 A1 10/2014 Sanfilippo et al.
2014/0307985 A1 10/2014 Sanfilippo et al.
2014/0328552 A1 11/2014 Sanfilippo et al.
2014/0371046 A1* 12/2014 Catellani ..... B65B 61/24 493/162
2015/0001234 A1 1/2015 Sanfilippo et al.

FOREIGN PATENT DOCUMENTS

EP 0879767 A1 11/1998
EP 1106508 A1 6/2001
EP 1508531 A1 2/2005
EP 1637472 A1 3/2006
EP 2347971 A1 7/2011
EP 2468634 A1 6/2012
EP 2586718 A1 5/2013
FR 2766794 A1 2/1999
IT 1274100 B 7/1997
JP 01167084 6/1989
JP 01226579 9/1989
JP 01267182 10/1989
JP 09142551 6/1997
JP 10-203560 8/1998
JP 11077857 A * 3/1999 ..... B31B 1/26
JP 2005320032 A 11/2005
WO WO-86/06344 A1 11/1986
WO WO-94/11270 A1 5/1994
WO WO-00/12407 A1 3/2000
WO WO-02/085726 A1 10/2002
WO WO-2004/024588 A1 3/2004
WO WO-2004/110885 12/2004
WO WO-2006/091821 A2 8/2006
WO WO-2007/058689 A1 5/2007
WO WO-2009/061959 A1 5/2009
WO WO-2012/098085 A1 7/2012
WO WO-2012098085 A1 * 7/2012 ..... B65B 31/022
WO WO-2013064290 A1 * 5/2013 ..... B65B 61/24

OTHER PUBLICATIONS

Photographs of flexible container packaging, "Minibrick Pack", from Sonoco (Hartsville, South Carolina, USA) (became aware of in Dec. 2007).
SBS Special Top Design Machine, product sheet from Rovema Packaging Machines L.P. (Lawrenceville, Georgia, USA) (1 pg.) (2005).
International Search Report and Written Opinion from corresponding International Application No. PCT/US2013/066985, dated Jan. 29, 2014.
International Search Report and Written Opinion for counterpart International Application No. PCT/US08/072554, dated Feb. 23, 2009.
International Search Report and Written Opinion for International Application No. PCT/US2009/063591, dated Jun. 18, 2010.
International Search Report and Written Opinion for International Application No. PCT/US2008/082689, dated Mar. 24, 2009.
Extended European Search Report, European application No. EP 09825498.0, dated Nov. 22, 2012.
International Search Report and Written Opinion for International Application No. PCT/US2015/022859, dated Oct. 12, 2015.
International Search Report and Written Opinion, International Application No. PCT/US2015/031556, dated Sep. 15, 2015.

(56) References Cited

OTHER PUBLICATIONS

International Preliminary Report on Patentability and Written Opinion for International Application No. PCT/US2015/031556 dated Nov. 22, 2016.

* cited by examiner 66
56
18
64
74
72
58

READY

CLOSE AND FOLD

START EJECTING

EJECT

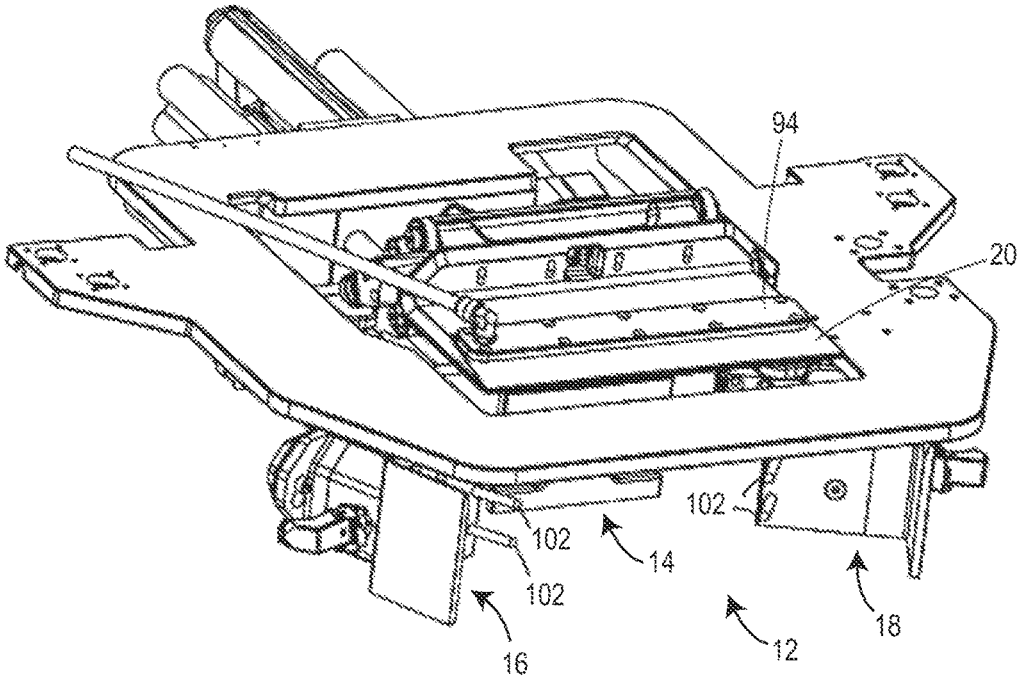
FIGURE 29A
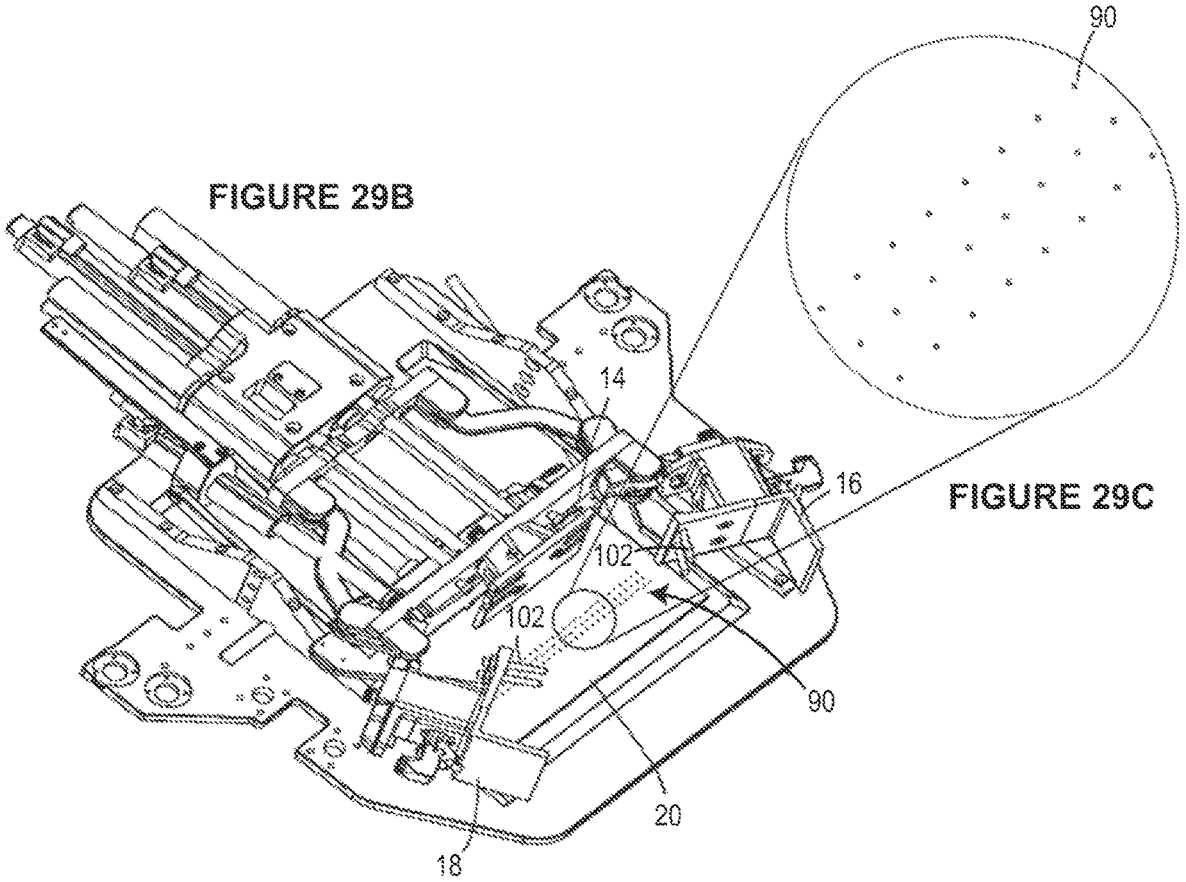
FIGURE 29B
FIGURE 29C

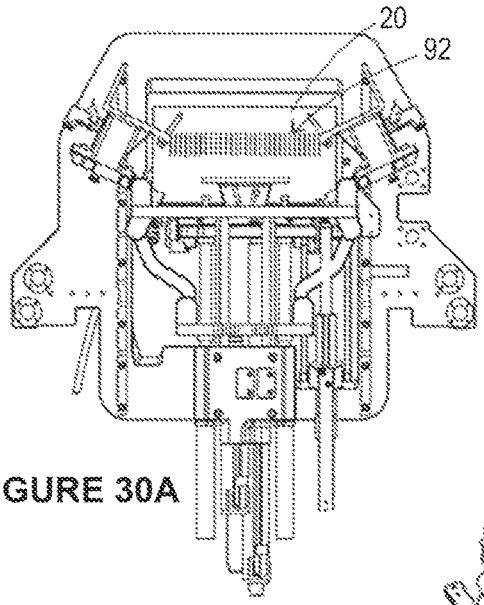
FIGURE 30A
FIGURE 30C
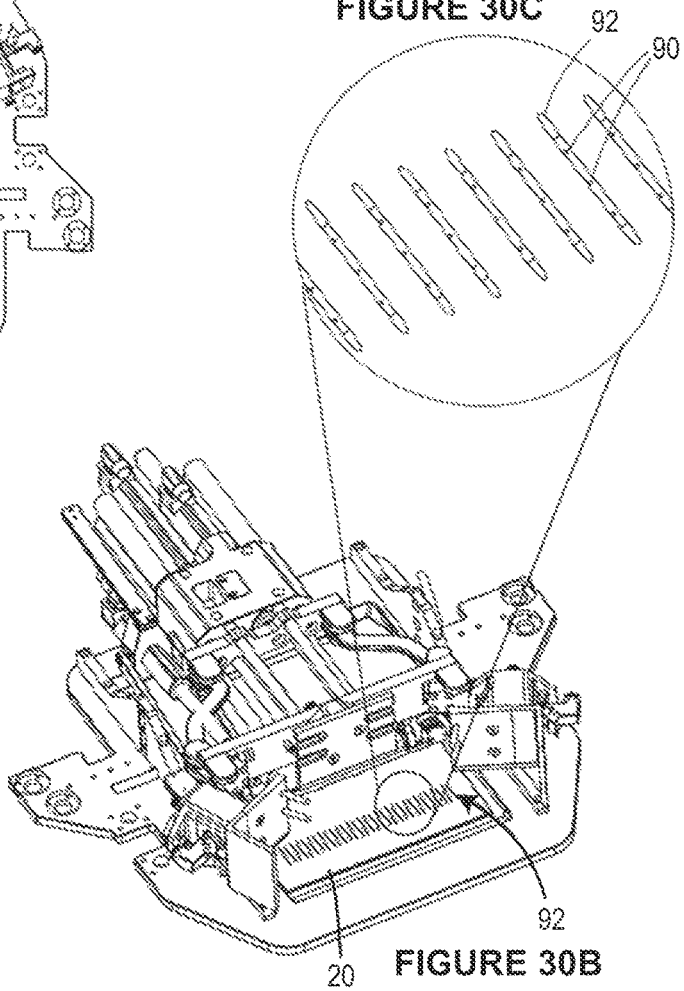
FIGURE 30B
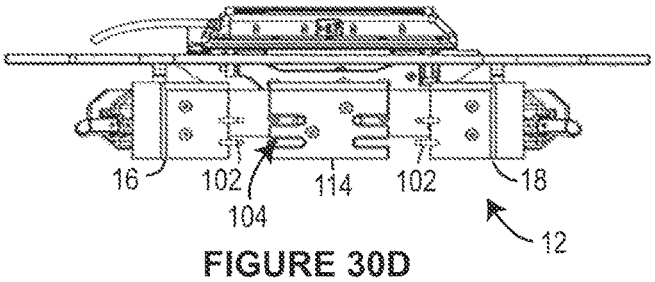
FIGURE 30D
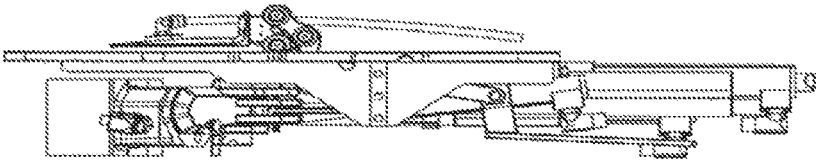
FIGURE 30E

APPARATUS AND METHOD FOR MAKING A FLEXIBLE PACKAGE

CROSS REFERENCE TO RELATED APPLICATIONS

This application is a national stage application of International Patent Application No. PCT/US2015/031556, filed May 19, 2015, which claims priority under 35 U.S.C. § 119 to U.S. Provisional Patent Application Nos. 62/000,510 filed May 19, 2014, 62/053,001 filed Sep. 19, 2014, and 62/073,760 filed Oct. 31, 2014. The respective disclosures of which are each incorporated herein by reference in their entireties.

BACKGROUND

Field of the Disclosure

The disclosure relates to apparatus, systems, and methods for making a flexible package.

Brief Description of Related Technology

Vertical form, fill, and seal (VFFS) packaging machines are commonly used in the snack food industry for forming, filling, and sealing bags of nuts, chips, crackers and other products. Such packaging machines take a packaging film or flexible material from a roll and form the flexible material into a vertical tube around a product delivery cylinder. One disadvantage of these packages is that the resulting filled package is not rigid enough to allow the stacking of one package on top of another in a display. Additionally, such conventional packages do not retain their shape, particularly after the package is opened and product is removed.

BRIEF SUMMARY OF THE INVENTION

An apparatus for forming a flexible package includes a forming box having a first end and an oppositely disposed second end, wherein the forming box comprises first, second, and third portions that cooperate to define first, second, third, and fourth walls of the forming box, each extending between the first and second ends. One or more forming box actuators are operatively coupled to the forming box to actuate the forming box between a first position for receiving a package, a second position for retaining a package, and a third position for releasing the package. A first flap folding bar is disposed upstream and adjacent the first end of the forming box. One or more first flap folding bar actuators are operatively coupled to the first flap folding bar to actuate the first flap folding bar in a direction substantially transverse to a transport path of a flexible material between a first position in which the first flap folding bar is disposed away from the forming box and a second position in which at least a portion of the first flap folding bar is disposed over the first end of the forming box.

An apparatus for forming a flexible package includes a forming box having a first end and an oppositely disposed second end, wherein the forming box comprises first, second, and third portions that cooperate to define first, second, third, and fourth walls of the forming box, each extending between the first and second ends. The first portion includes a first surface defining the first wall, and the second portion includes second and third surfaces joined at a first corner, the second surface defining a portion of the fourth wall and the third surface defining the second wall. The third portion includes fourth and fifth surfaces joined at a second corner, the fourth surface defining a remaining portion of the fourth wall and the fifth surface defining the third wall. One or both of the third surface and the fifth surface includes at least one ejector extending from an end of the third surface or fifth surface disposed adjacent to the first surface. One or more forming box actuators operatively coupled to the forming box to actuate the forming box between a first position for receiving a package, a second position for retaining a package, and a third position for releasing the package, the at least one ejector being configured to engage the package and force the package out of the forming box when the forming box is actuated to the third position. A first flap folding bar is disposed upstream and adjacent the first end of the forming box. In addition, one or more first flap folding bar actuators are operatively coupled to the first flap folding bar to actuate the first flap folding bar in a direction substantially transverse to a transport path of a flexible material between a first position in which the first flap folding bar is disposed away from the forming box and a second position in which at least a portion of the first flap folding bar is disposed over the first end of the forming box.

BRIEF DESCRIPTION OF THE DRAWINGS

FIG. 29A is a top perspective view of a cubing apparatus in accordance with an embodiment of the disclosure;

FIG. 29B is a bottom view of the cubing apparatus of FIG. 29A;

FIG. 29C is a zoomed-in image of vent holes on the flap folding bar of the cubing apparatus of FIG. 29B;

FIG. 30A is a bottom view of a cubing apparatus in accordance with another embodiment of the disclosure;

FIG. 30B is a bottom perspective view of the cubing apparatus of FIG. 30A;

FIG. 30C is a zoomed-in image of vent holes and venting channels on the flap folding bar of the cubing apparatus of FIG. 30A;

FIG. 30D is a front view of the cubing apparatus of FIG. 30A;

FIG. 30E is a side view of the cubing apparatus of FIG. 30A;

DETAILED DESCRIPTION

Flexible stackable packages and equipment for making such packages having a generally cubed shape have been disclosed in, for example, U.S. Pat. No. 8,602,244, the disclosure of which is incorporated herein by reference. The apparatus, systems, and methods of various embodiments of the disclosure can advantageously allow for formation of such flexible stackable packages with improved rigidity and/or improved shape, for example, a cubed shaped.

As described in detail below, the apparatus, systems, and methods of the disclosure can produce a flexible package in which first and second seals (also referred to as leading and trailing seals) are folded over and disposed generally in the same plane of the panel of the package from which they extend. The disclosed apparatuses can also advantageously allow for significantly increased processing speeds in forming such products, as well as the ability to convert conventional packaging machines into machines capable of forming such flexible packages.

The apparatus 10 in accordance with an embodiment of the disclosure can be adapted to function with known packaging machines, including, but not limited to vertical form fill seal (VFFS) packaging machines, horizontal form, fill and seal (HFFS) machines, sequential assembly machines and the like. As used herein, the "transport path" refers to the path of the flexible material as it is transported through the conventional packaging machine during operation for making a flexible package. In various embodiments, the apparatus 10 can be provided on a frame assembly that is portable, allowing the apparatus 10 to be moved into and out of configuration with the conventional packaging machine. The frame assembly and/or components of the apparatus 10 can be adjustable to accommodate different packaging machine configurations and heights.

Figure 1A:
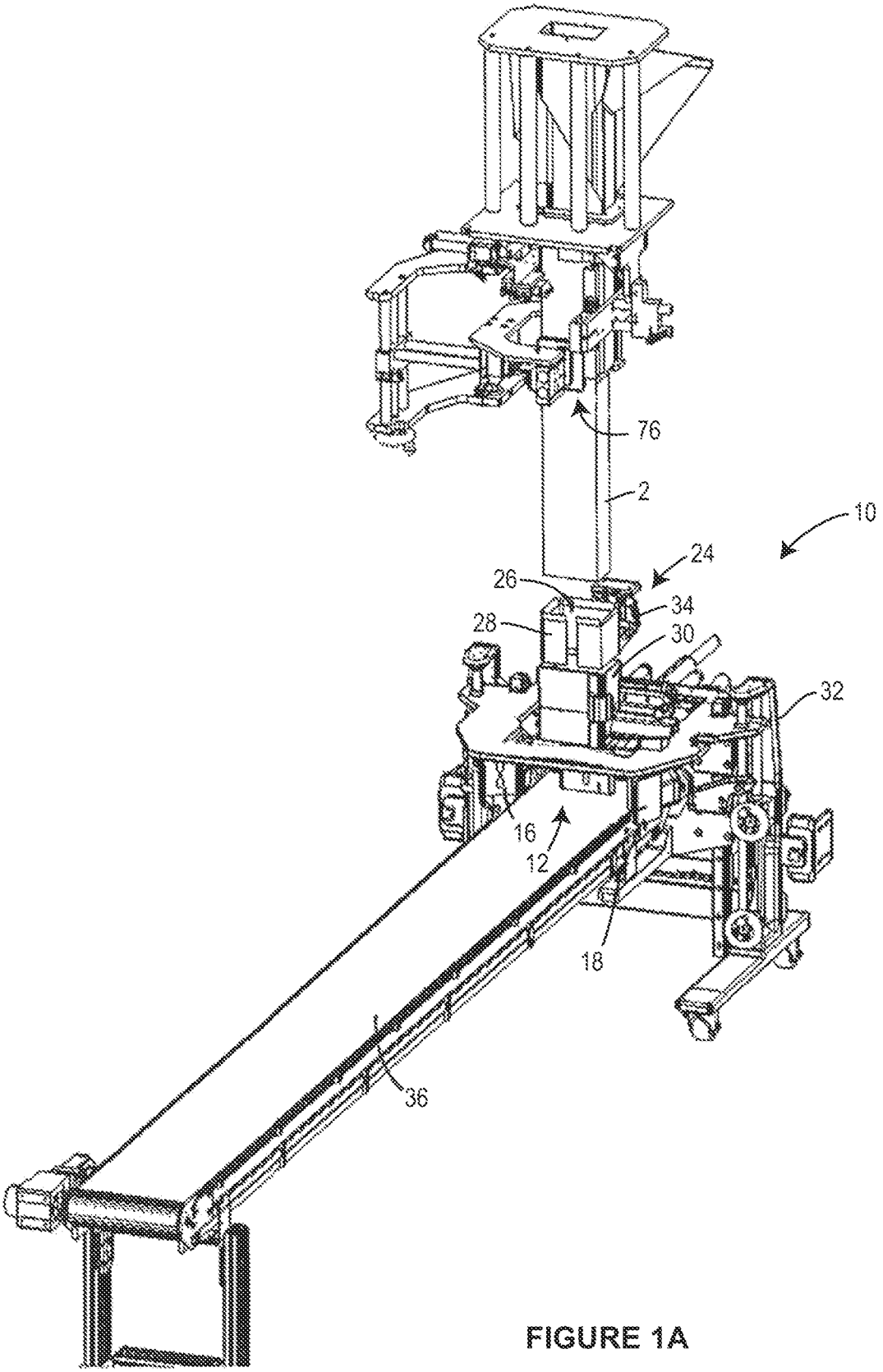
FIG. 1A is a schematic illustration a system including an apparatus for forming a flexible package in accordance with an embodiment of the disclosure.
Figure 1B:
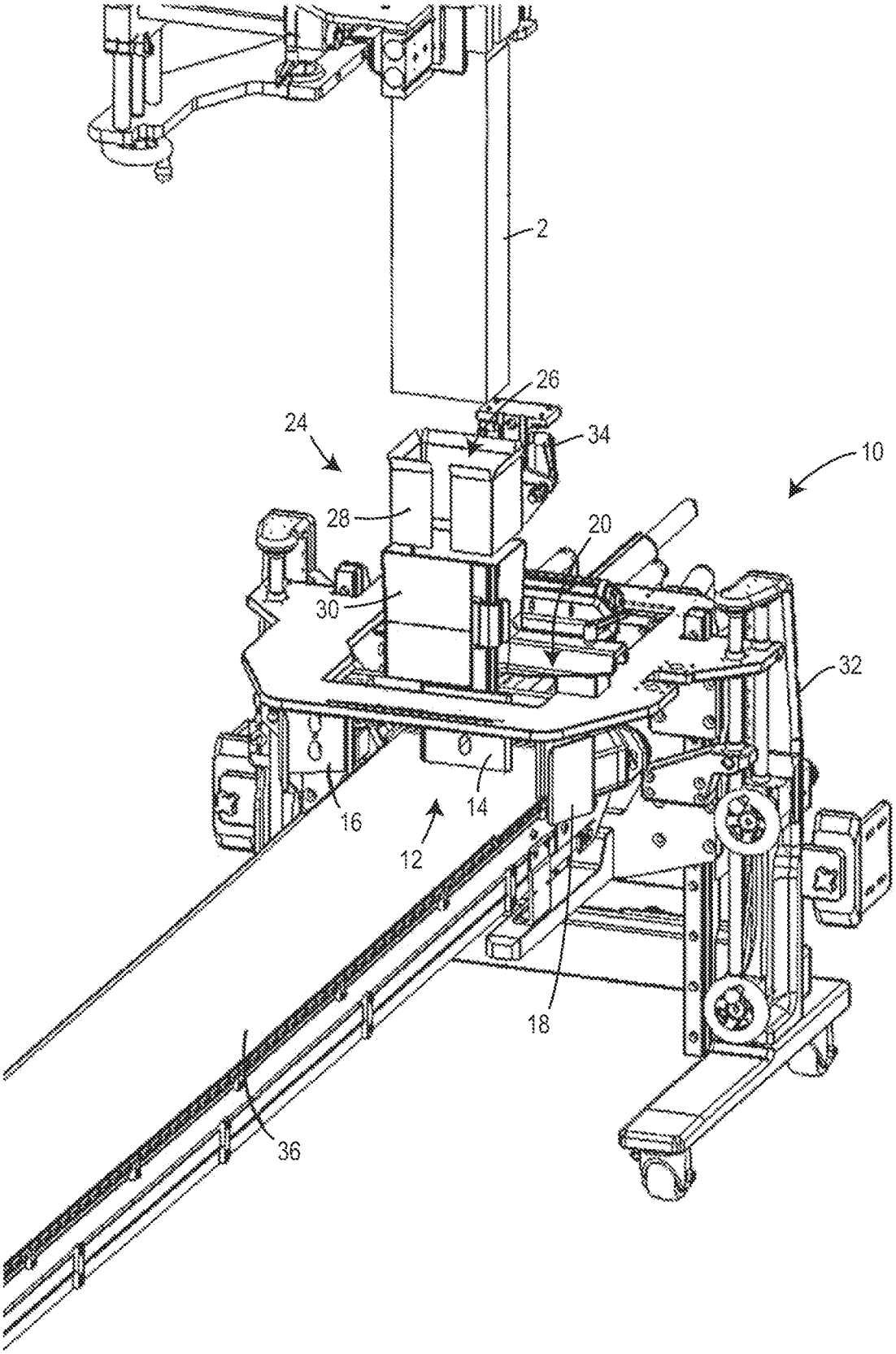
FIG. 1B is a close-up schematic illustration of the apparatus of FIG. 1A.

Referring to FIGS. 1A and 1B, in accordance with an embodiment of the disclosure, an apparatus 10 for making a flexible package can include a forming box 12 and a first flap folding bar 20. The apparatus 10 can receive a sealed flexible package for further processing, for example, such as folding over a seal extending perpendicularly from the sealed package such that it is disposed in substantially the same plane as the panel of the sealed package from which the seal extends.

Referring to FIGS. 3-6, in accordance with an embodiment, the forming box 12 can include a first portion 14, a second portion 16, and a third portion 18. It is contemplated herein that the forming box 12 can be divided into any suitable number of portions. It has been advantageously found that division of the forming box 12 into three portions can increase processing time by providing a forming box 12 that can quickly actuate to accept the package and release the package, thereby increasing package forming speeds. For ease of references, a forming box 12 having three portions will be discussed herein. However, it should be understood that other numbers of portions are contemplated herein and such additional portions may result in additional positions in which the forming box 12 can be actuated for receiving, retaining, and releasing the package after the flap folding process. The portions of the forming box 12 cooperate to define one or more walls of the forming box 12. For example, first, second, and third portion 14, 16, 18 can cooperate to define a forming box 12 having four walls. The forming box 12 can have any suitable size and shape depending on the size and shape of the package to be formed. For example, when the package to be formed is designed to have substantially square edges, the forming box 12 can be designed to have substantially square edges. Such design can facilitate in providing a package having substantially square edges by applying a pressure to the package to retain the squared shape during flap folding.

Figure 6:
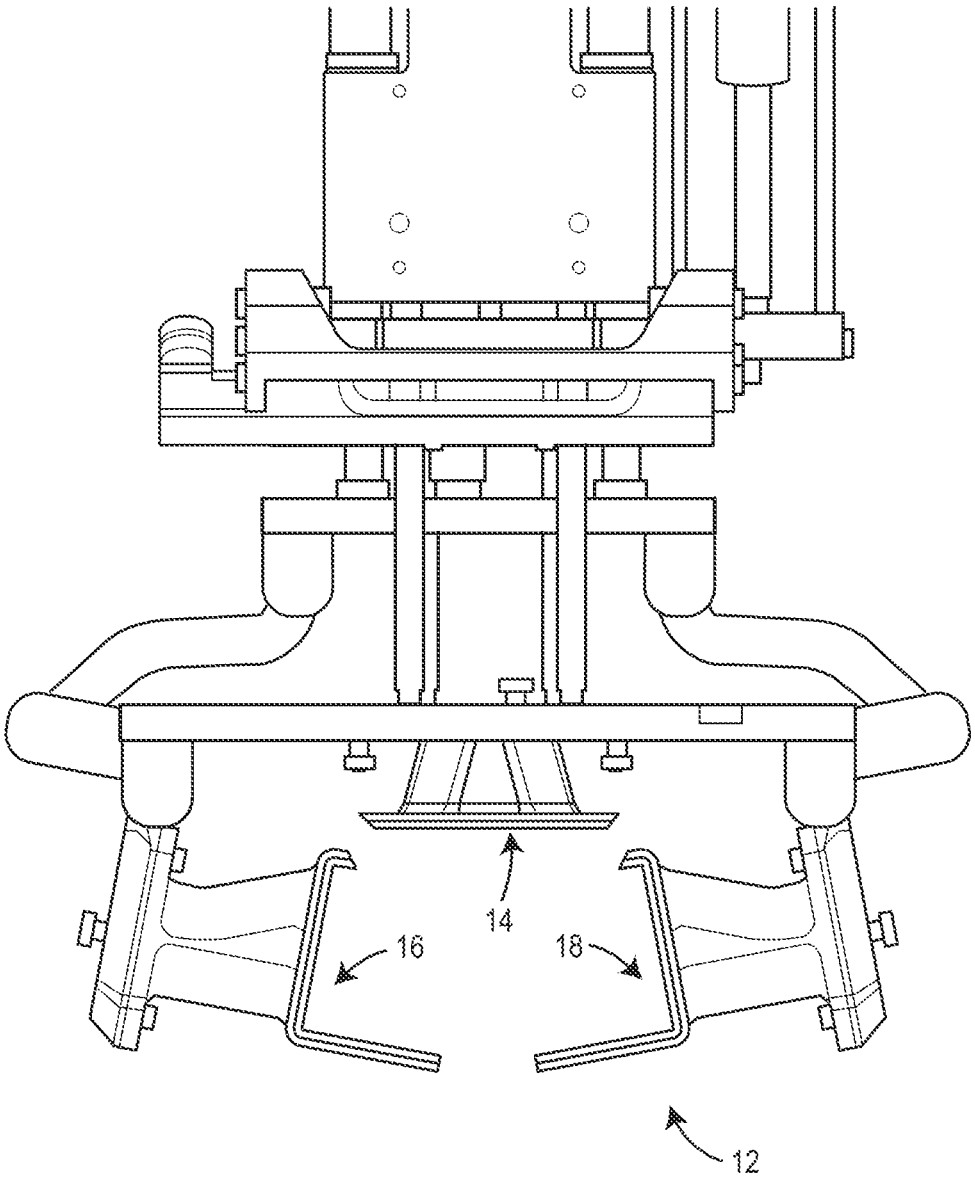
FIG. 6 is a top view of a forming box in accordance with an embodiment of the disclosure, shown in a third position for releasing a package.
Figure 7A:
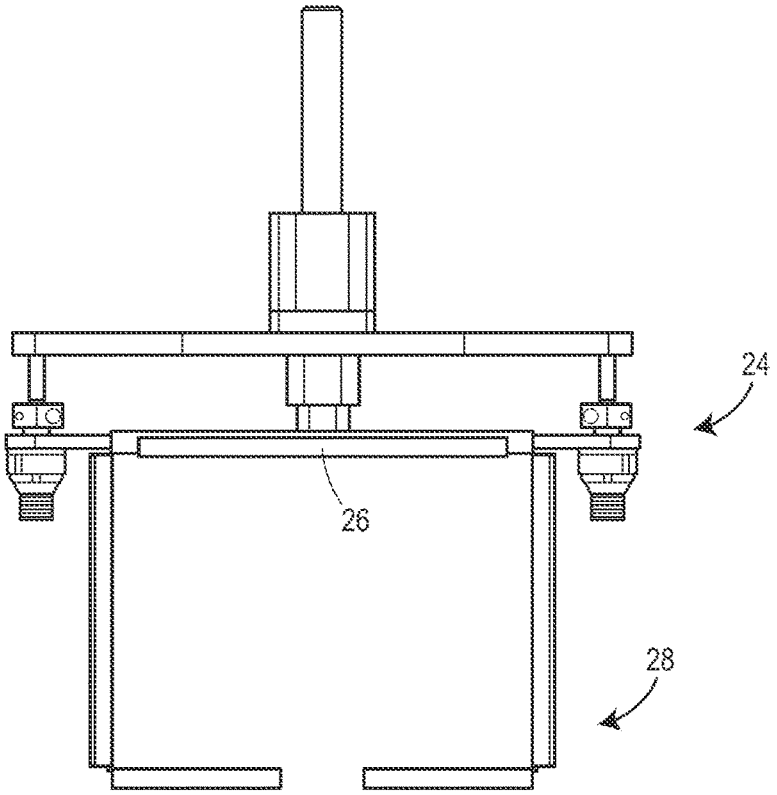
FIG. 7A is a top view of a volume adjuster in accordance with an embodiment of the disclosure, showing the plate in a non-actuated position for receiving a package within the volume adjuster.
Figure 7B:
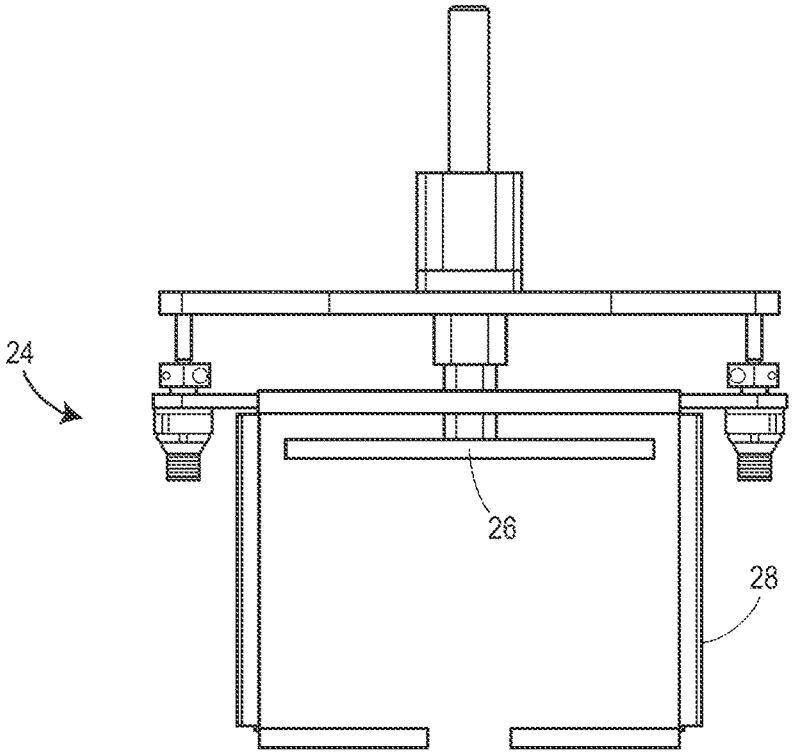
FIG. 7B is a top view of the volume adjuster of FIG. 7A, showing the plate in an actuated position for engaging a package received within the volume adjuster.
Figure 7C:
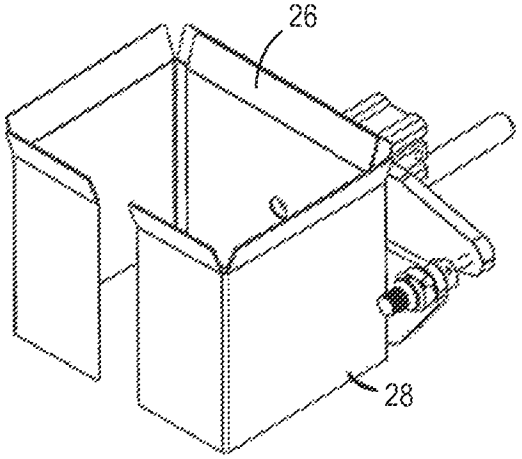
FIGS. 7C and 7D are perspective views of the volume adjuster of FIG. 7A, showing the plate in a non-actuated position for receiving a package within the volume adjuster.
Figure 7D:
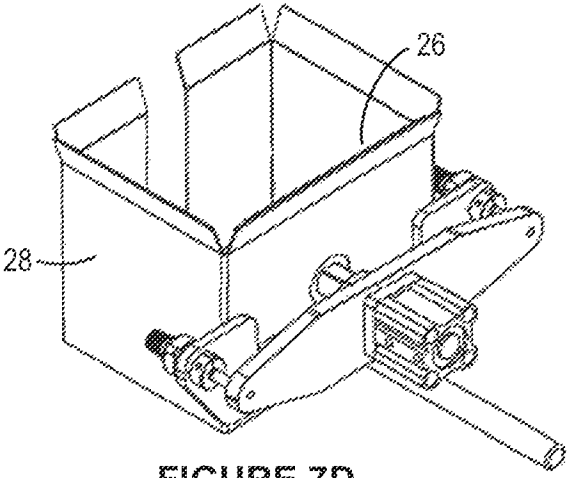
Figure 7E:
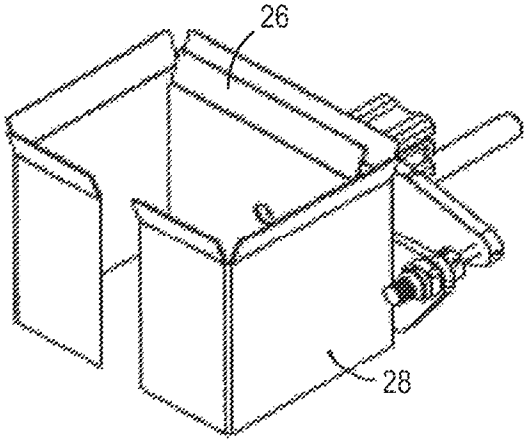
FIGS. 7E and 7F are perspective views of the volume adjuster of FIG. 7B, showing the plate in an actuated position for engaging a package received within the volume adjuster.
Figure 7F:
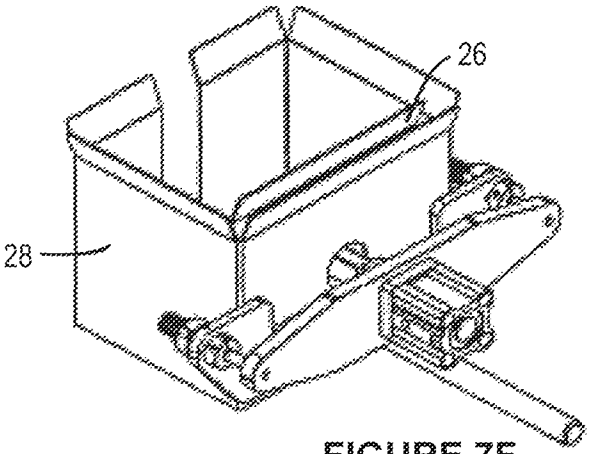
Figure 8G:
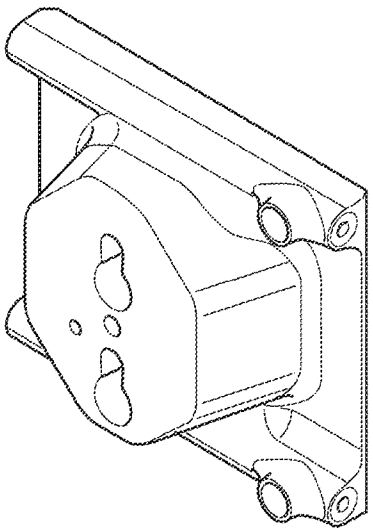
FIGS. 8A-8G are schematic illustrations of a first portion of a forming box having heating/cooling in accordance with an embodiment of the disclosure.
Figure 8E:
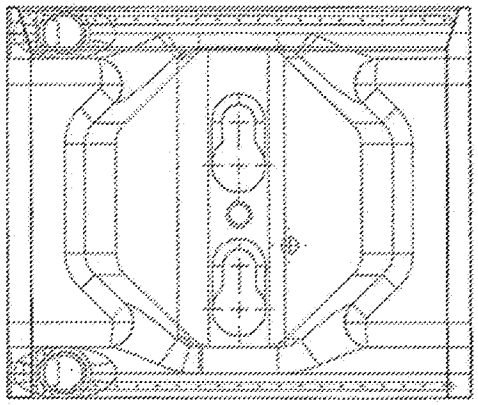
Figure 8F:
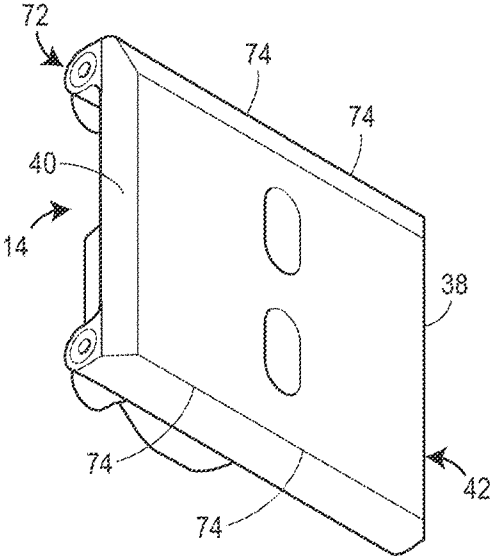
Figure 8D:
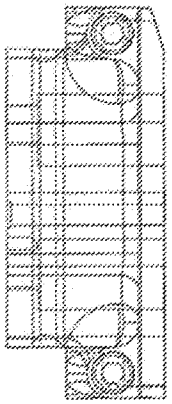
Figure 8B:
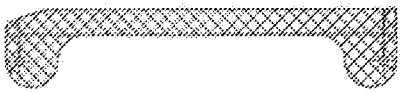
Figure 8A:
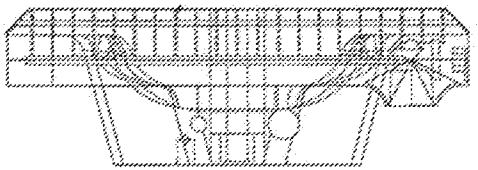
Figure 8C:
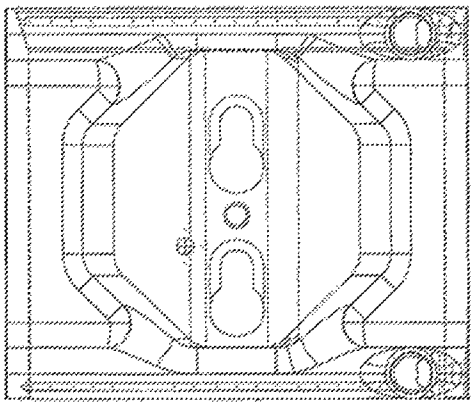
Figure 9H:
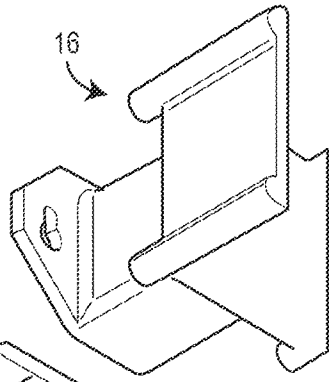
FIGS. 9A-9H are schematic illustrations of a second portion of a forming box having heating/cooling in accordance with an embodiment of the disclosure.
Figure 9G:
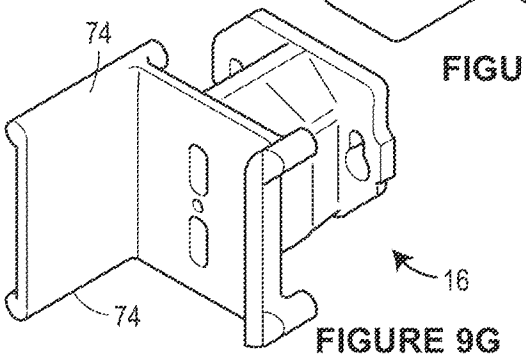
Figure 9E:
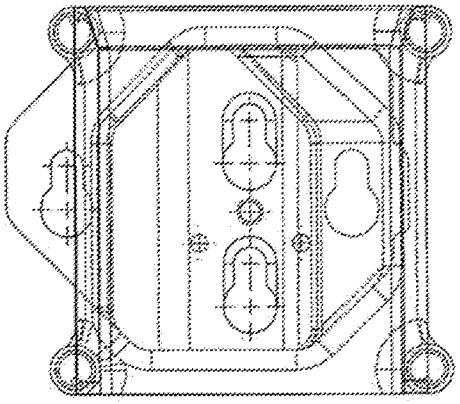
Figure 9F:
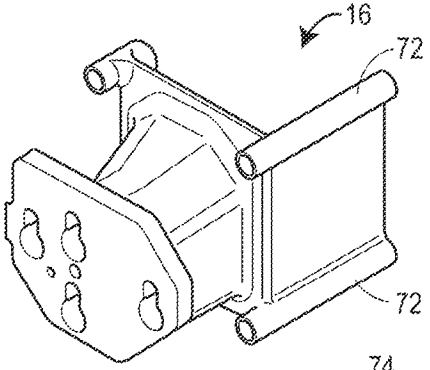
Figure 9D:
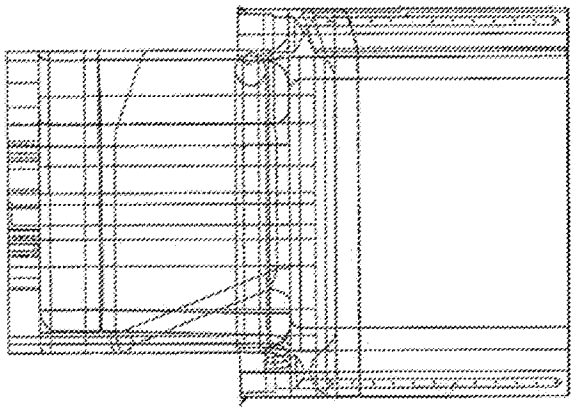
Figure 9B:
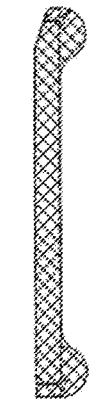
Figure 9A:
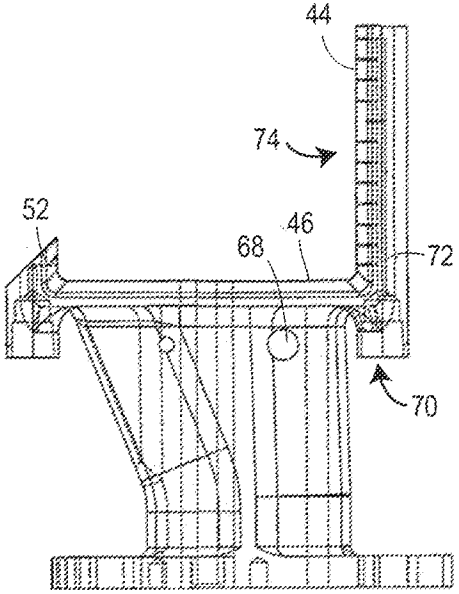
Figure 9C:
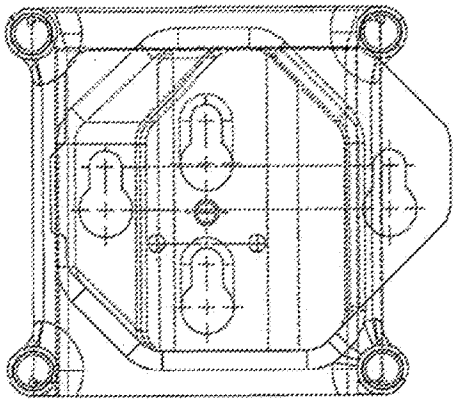
Figures 10A, 10B, 10C, 10D, 10E, 10F, 10G, 10H:
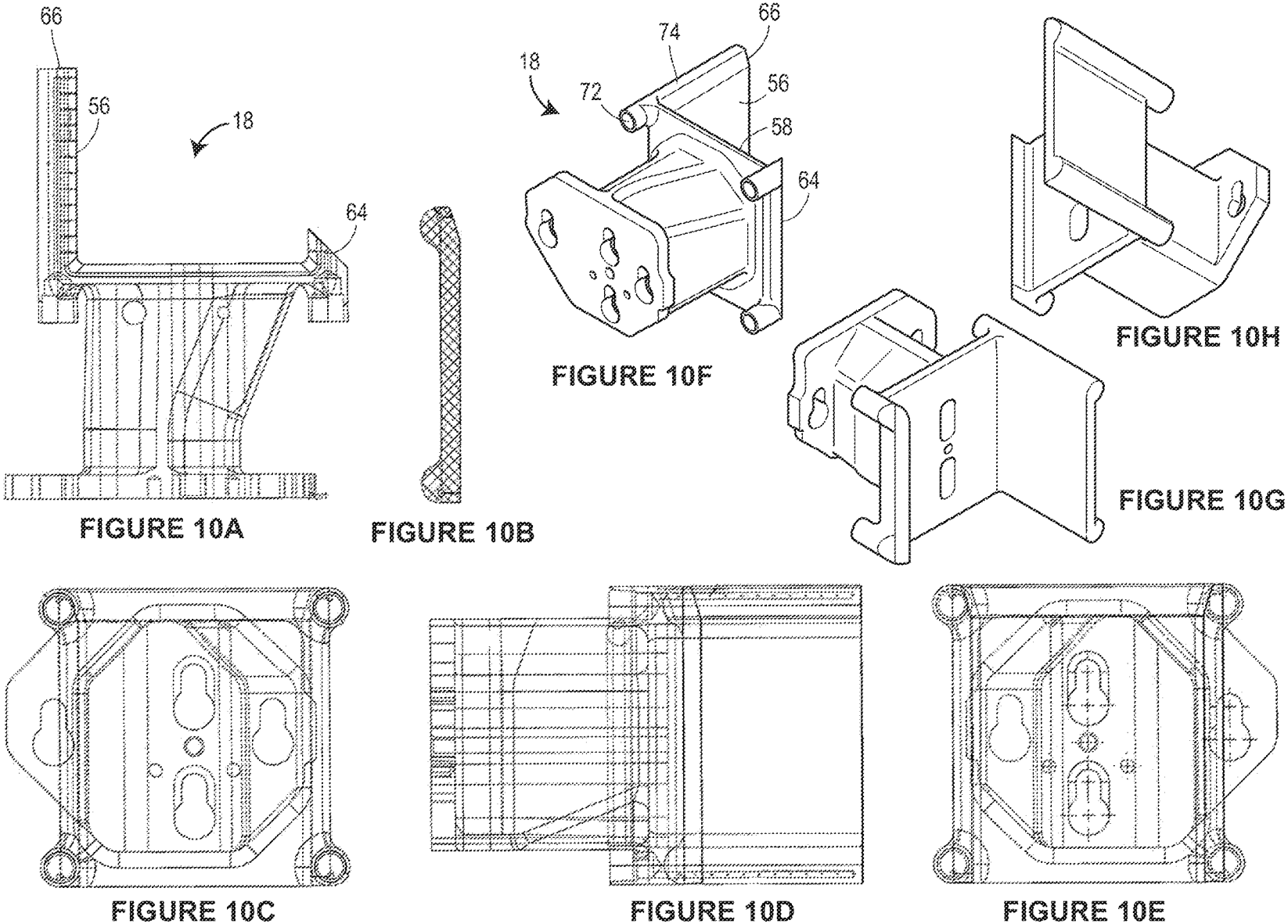
FIGS. 10A-10H are schematic illustrations of a third portion of a forming box having heating/cooling in accordance with an embodiment of the disclosure.
Figure 11:
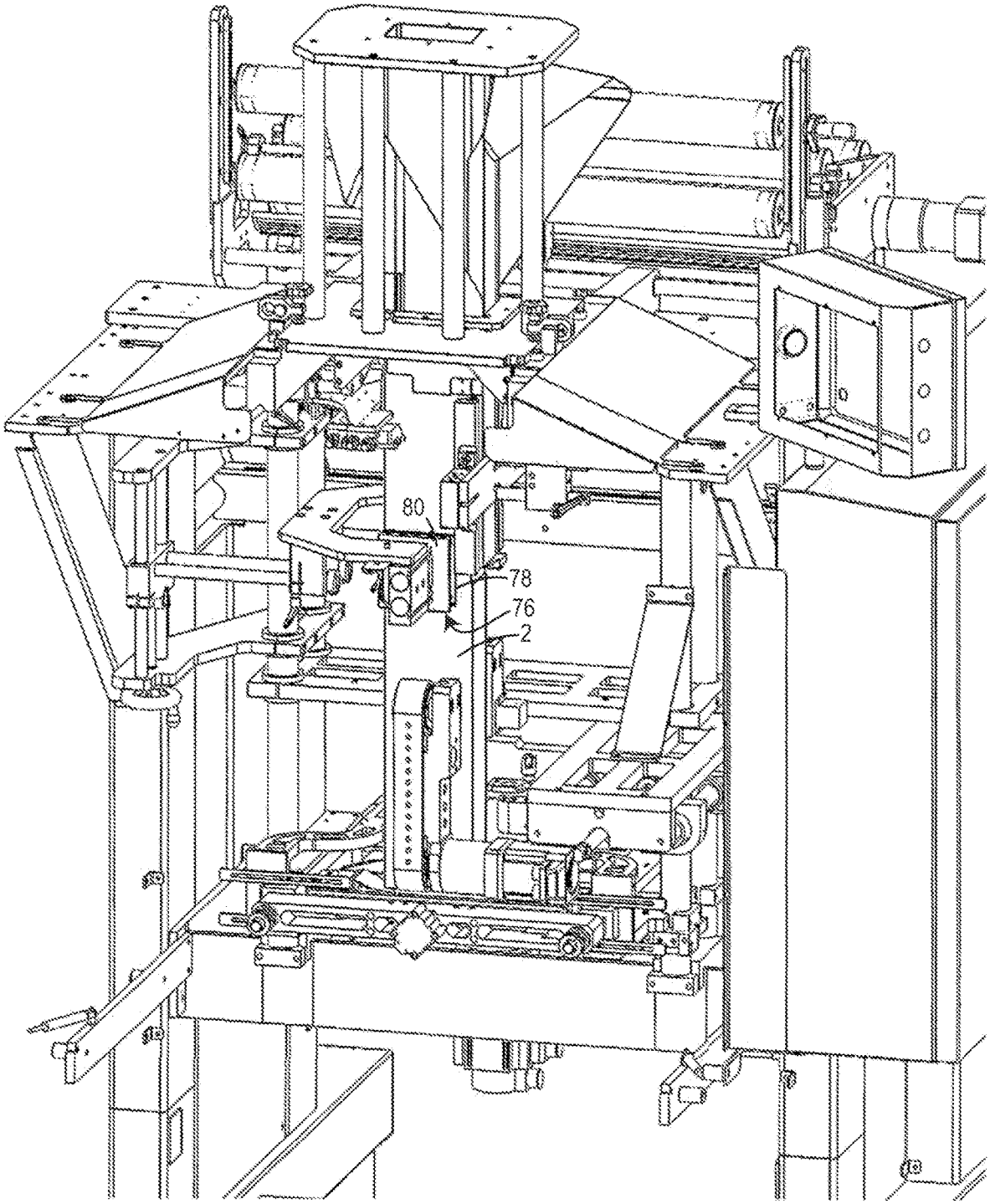
FIG. 11 is a schematic illustration of a packaging machine having a pre-creasing device in accordance with an embodiment of the disclosure.
Figure 12A:
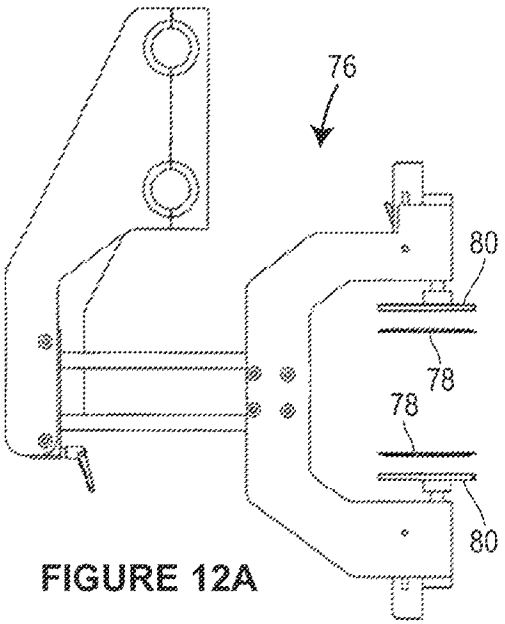
FIGS. 12A-12E are various views of the pre-creasing device of FIG. 11.
Figure 12C:
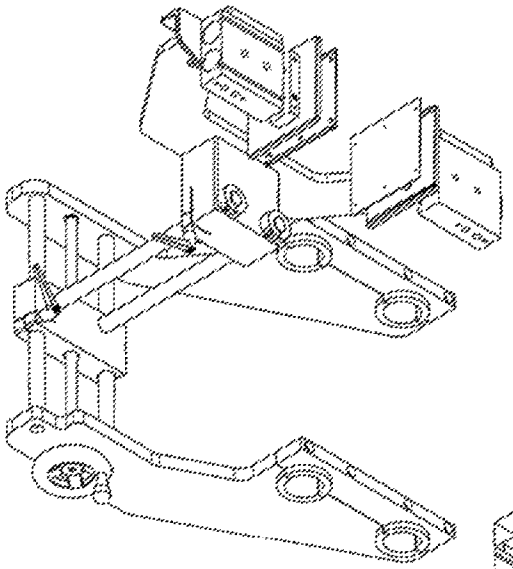
Figure 12E:
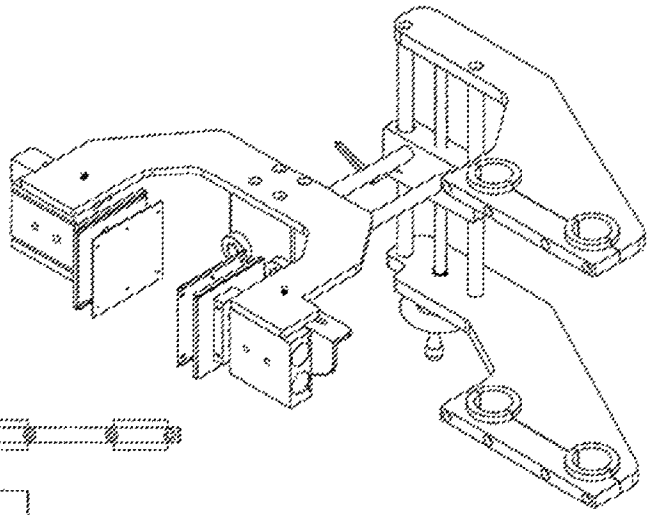
Figure 12B:
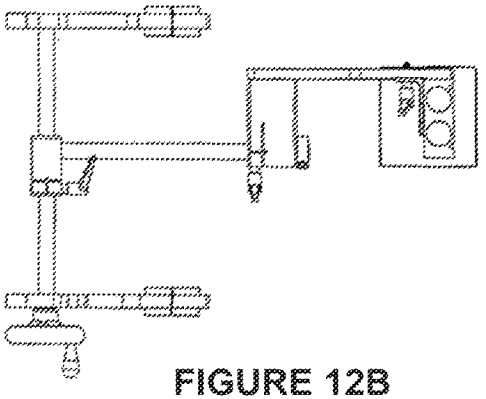
Figure 12D:
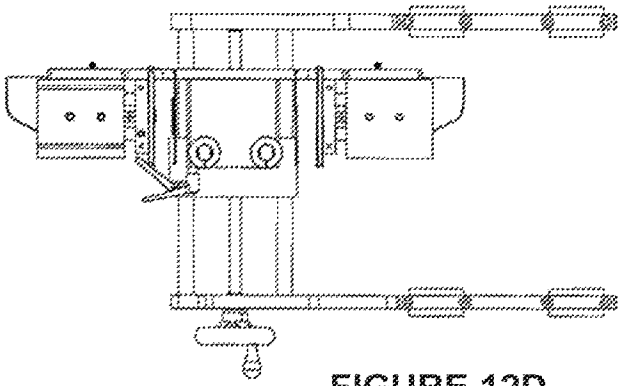
Figure 13D:
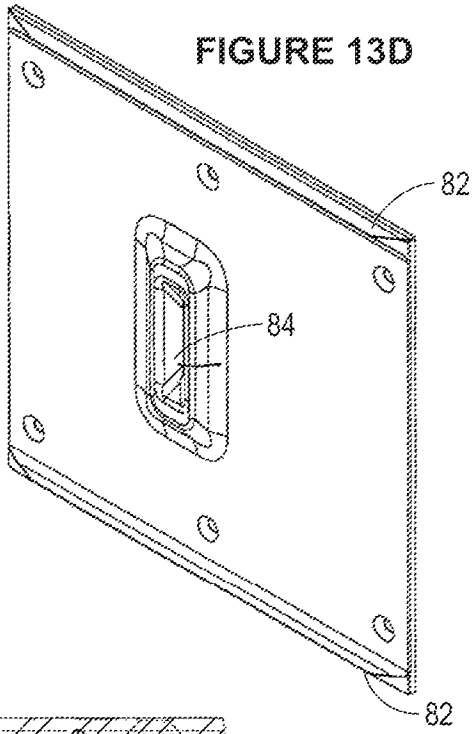
FIGS. 13A-13E are various views of a first plate of a pre-creasing device in accordance with an embodiment of the disclosure for creasing both a fold line which defines an edge of the package and a pull tab.
Figure 13E:
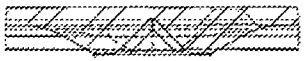
Figure 13B:
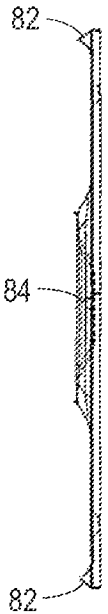
Figure 13C:
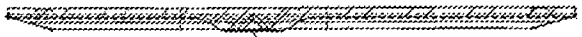
Figure 13A:
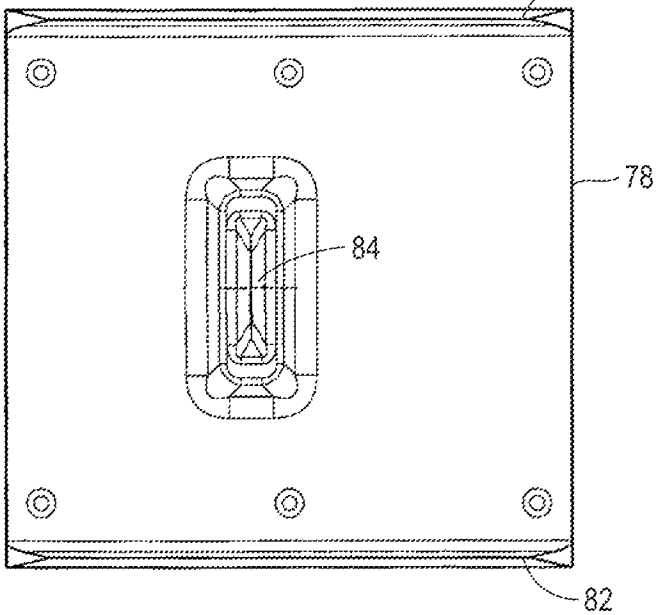
Figure 14D:
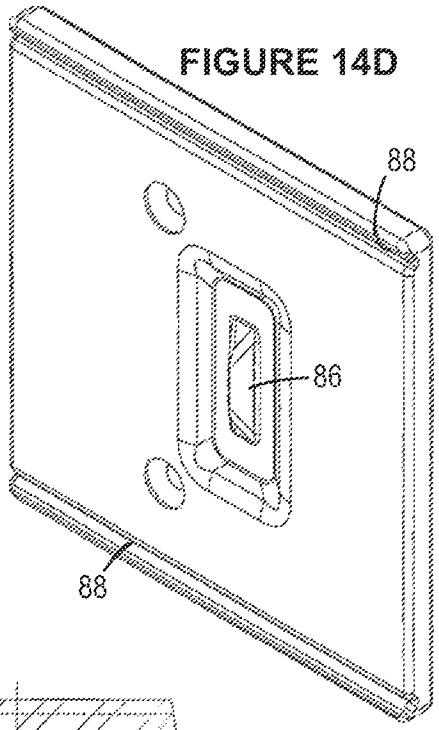
FIGS. 14A-14E are various views of a second plate of a pre-creasing device in accordance with an embodiment of the disclosure for creasing both a fold line which defines an edge of the package and a pull tab.
Figure 14E:
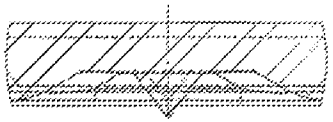
Figure 14B:
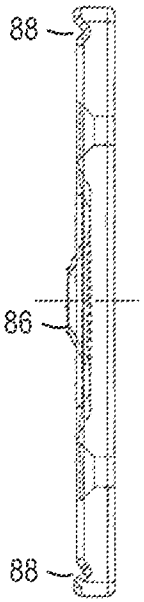
Figure 14C:
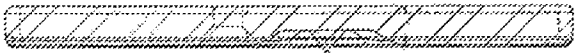
Figure 14A:
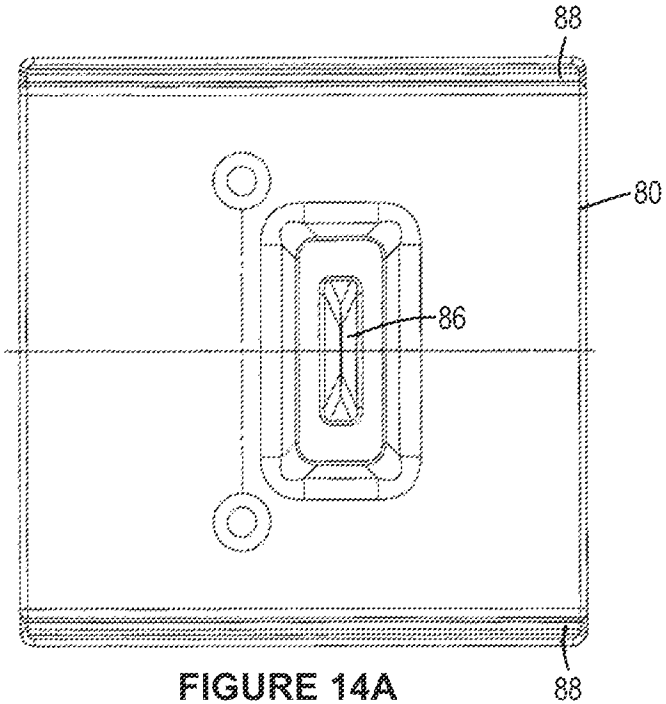
Figure 15D:
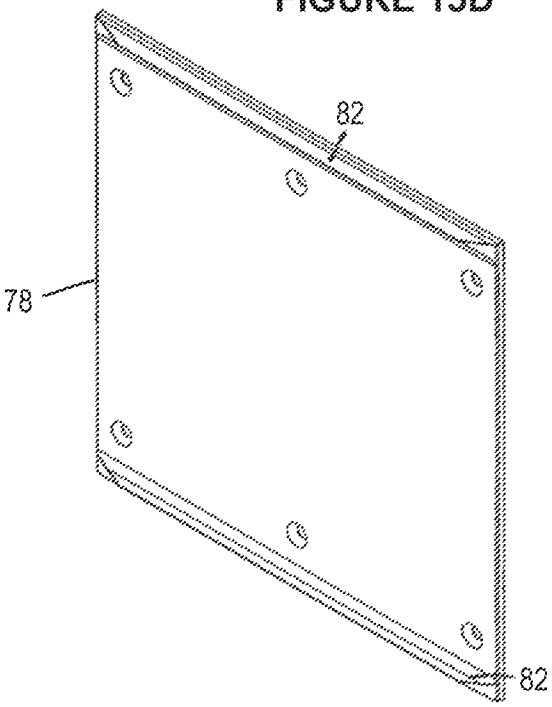
FIGS. 15A-15D are various views of a first plate of a pre-creasing device in accordance with an embodiment of the disclosure for creasing a fold line which defines an edge of the package.
Figure 15B:
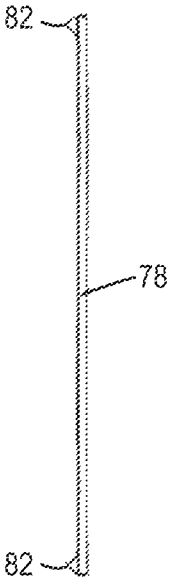
Figure 15C:
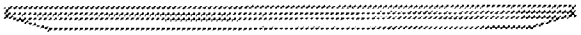
Figure 15A:
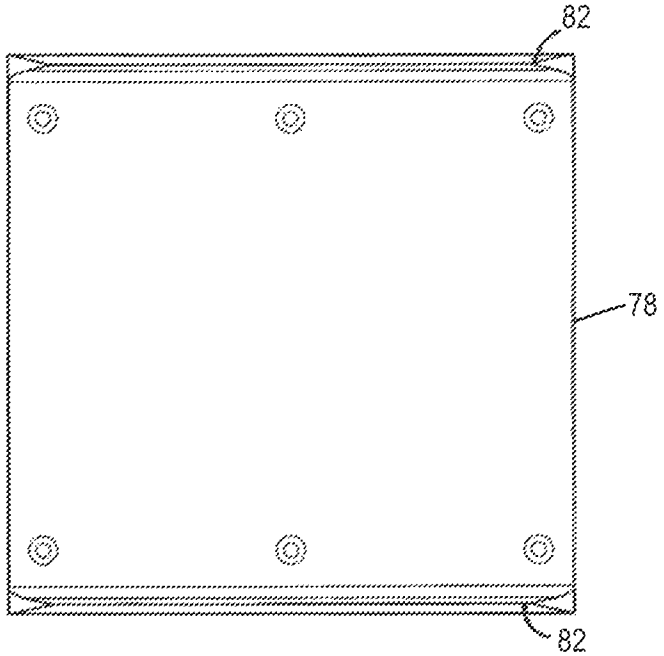
Figure 16D:
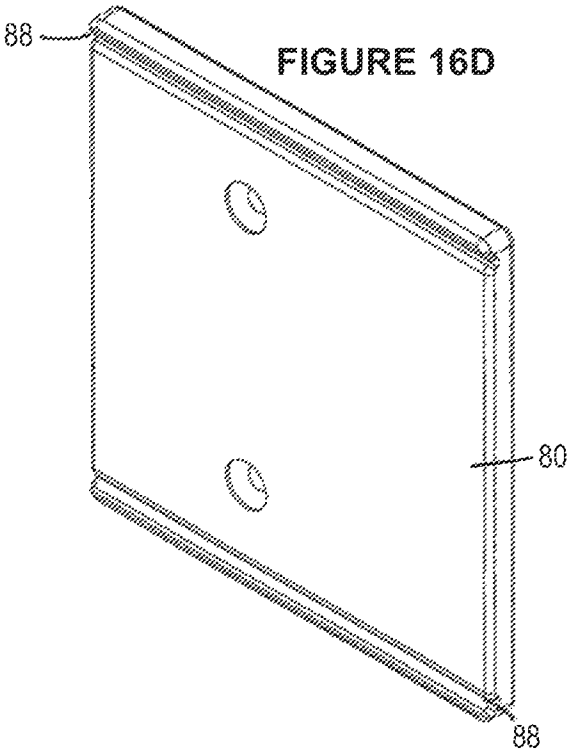
FIGS. 16A-16D are various views of a second plate of a pre-creasing device in accordance with an embodiment of the disclosure for creasing a fold line which defines an edge of the package.
Figure 16B:
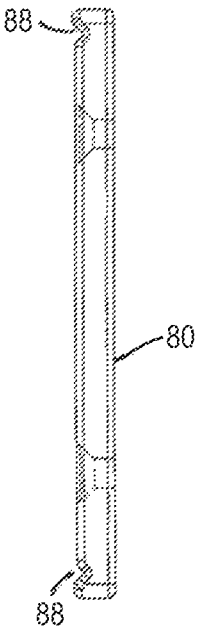
Figure 16C:
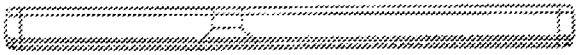
Figure 16A:
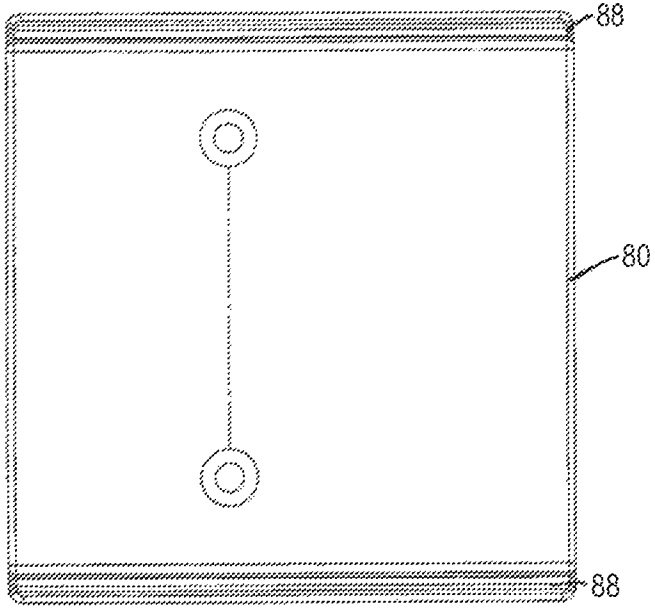
Figure 17A:
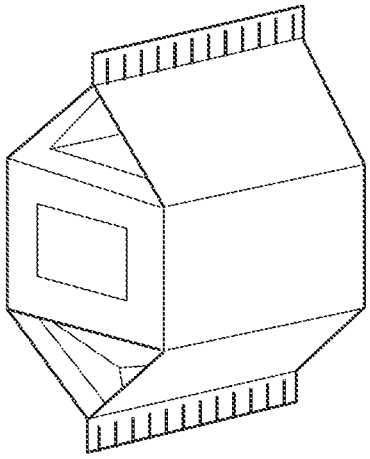
FIG. 17A is a schematic illustration of a seal packaged that can be processed by the apparatus in accordance with an embodiment of the disclosure, illustrating opposed first and second seals extending substantially perpendicularly to a panel of the package.
Figure 17B:
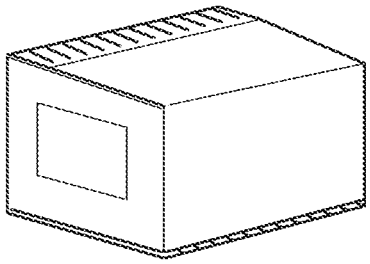
FIG. 17B is a schematic illustration of the sealed package of FIG. 17A in which the seals have been folded over to be disposed in substantially the same plane as the panel.

The forming box 12 can actuate between a first position for receiving a package (shown in FIG. 4), a second position for retaining the package during flap folding (shown in FIG. 5), and a third position for releasing the package from the forming box (shown in FIG. 6). FIG. 6 illustrates the start of the third position for releasing the package from the forming box. The second and third positions actuate further away from each other to provide a space through which the package can be passed out of the forming box. The apparatus 10 can include one or more forming box 12 actuators to actuate portions of the forming box 12 to the various positions. In accordance with an embodiment, the actuators can be operatively coupled to one or more of the portions of the forming box 12. For example, in an embodiment, actuators are coupled to the second and third portions 16, 18 of the forming box 12 to actuate the second and third portions 16, 18 while the first portion 14 remains stationary. In yet another embodiment, only one of the portions may actuate or all three portions can be actuated.

The forming box 12 has a first end and an oppositely disposed second end. The first end is disposed adjacent to the first flap folding bar 20. In an embodiment, the forming box 12 can be open at both the first and second ends. For example, the forming box 12 can be open at the second end and a conveyor 36 can be disposed beneath the second end. The package can reside on the conveyor when it is received in the forming box 12. In another embodiment, the forming box can be closed at the second end. For example, the forming box 12 can include a plate or other member forming a bottom surface of the forming box 12 at the second end. The bottom member can be, for example, an additional fourth portion of the forming box 12 that actuates into and out of position for receiving, retaining, and releasing a package. In an embodiment, the bottom member of the forming box 12 can be operatively coupled to an actuator that actuates the bottom member from a closed position in which the bottom surface forms a bottom surface of the forming box 12 and an open position in which the bottom surface is disposed away from the forming box 12, such that the second end is open.

In an embodiment, the forming box 12 comprises first and second portions defining four walls of the forming box 12 and a third portion defining a bottom wall of the forming box 12 at the second end. In operation, the forming box 12 can actuate from a first position in which the third portion defines a bottom wall of the forming box 12 and the first and second portions are separated to receive the package, a second position in which the first and second portions actuate towards each other to retain the package during flap folding, with the third portion maintaining a bottom surface, and a third position in which the first and second portions separate and the third portion 18 is disposed away from the second end to release the package.

Figure 3:
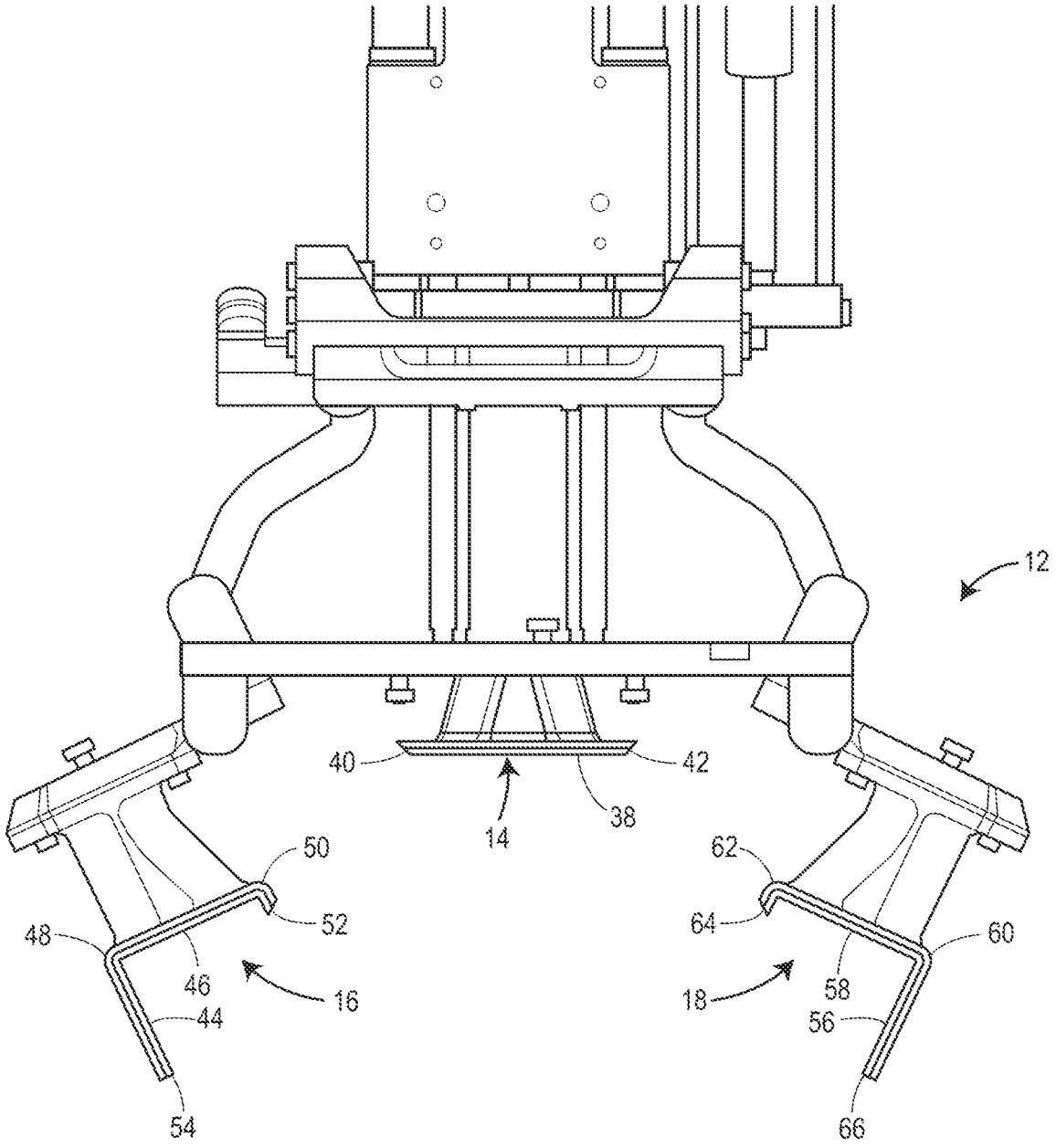
FIG. 3 is a top view of a forming box in accordance with an embodiment of the disclosure.
Figure 4:
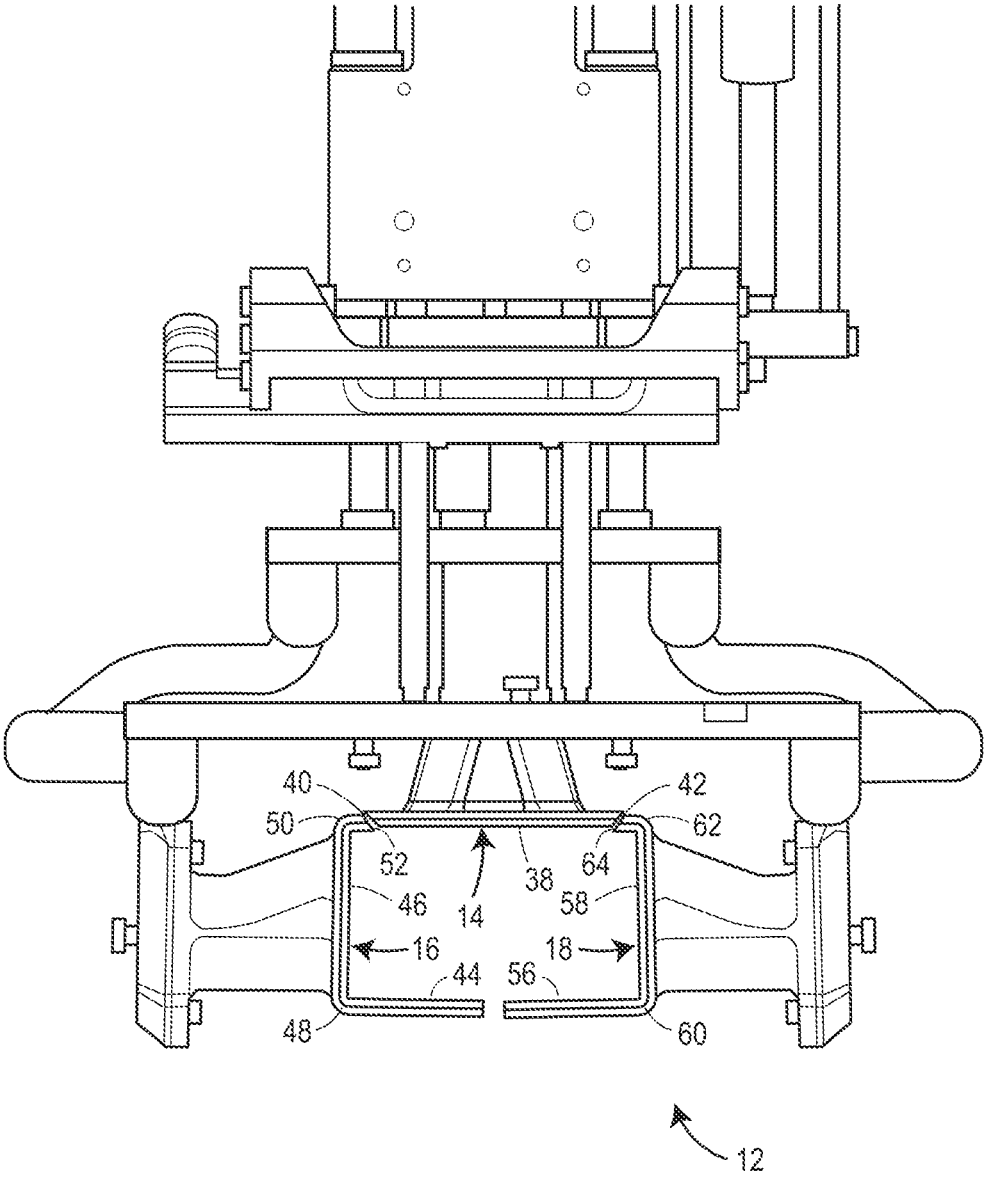
FIG. 4 is a top view of a forming box in accordance with an embodiment of the disclosure, shown in a first position for receiving a package.
Figure 5:
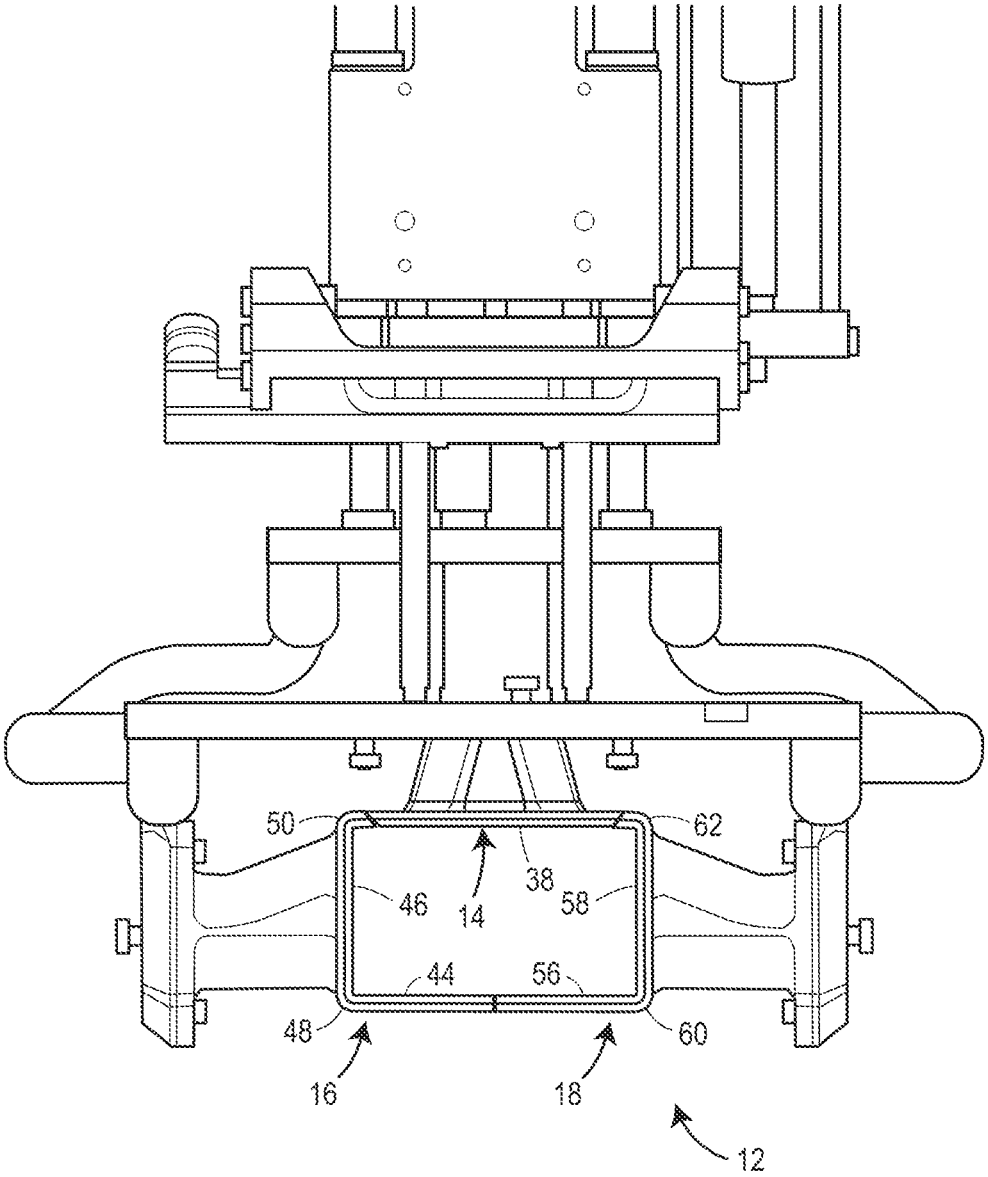
FIG. 5 is a top view of a forming box in accordance with an embodiment of the disclosure, shown in a second position for retaining a package.

Referring to FIG. 3, in accordance with an embodiment, the first portion 14 can include a first surface 38, which can be a planar or substantially planar surface, extending between first and second mating surfaces 40, 42. The mating surfaces 40, 42 can be angled. Alternatively, the mating surfaces 40, 42 can be substantially planar.

In accordance with an embodiment, the second portion 16 can include second and third surfaces 44, 46, which can be planar or substantially planar surfaces, joined by a corner 48. The second portion 16 can further include a mating surface 52 joined to the third surface 46 by a corner 50. Similarly, the third portion 18 can include fourth and fifth surfaces 56, 58, which can be planar or substantially planar surfaces, joined by a corner 60, and a mating surface 64 joined to the fifth surface 58 by a corner 62. The mating surfaces 52, 64 can have a shape complementary to a shape of the mating surfaces 40, 42, respectively, of the first portion 14. For example, the mating surfaces 52, 64 can be angled at an angle complementary to the angle of the first and second mating surface 40, 42, respectively, of the first portion 14, or be substantially planar to mate with the mating surfaces 40, 42 of the first portion 14. When the forming box 12 is in the second position, the mating surfaces 52, 64 contact the mating surface 40, 42 such that the first surface 38 of the first portion 14 and the mating surfaces 40, 42, 52, 64 define a wall of the forming box 12. For example, the complementary shape of the mating portions 40, 42, 52, 64, can allow the portions to cooperate to define a planar or substantially planar wall. The mating surfaces 52, 64 of the second and third portions 16, 18 being joined to the third and fifth surfaces 46, 58 by a corner can advantageously provide a package releasing aid when the forming box 12 is actuated to the third position. For example, the mating surfaces 52, 64 can contact the package when the second and third portions 16, 18 are actuated to the third position, forcing the package away from the first portion 14 and out of the forming box 12.

The second and fourth surfaces 44, 56 of the second and third portions 16, 18, respectively can each terminate in mating portions 54, 66 that can have complementary shapes such that the mating surfaces 54, 66 can contact each other to define a wall of the forming box 12 when the forming box 12 is in the second position. In alternative embodiments, the second and fourth surfaces 44, 56 of the forming box 12 can be sized such that a gap remains between the mating surfaces 54, 56 when the forming box 12 is in the second position.

Referring to FIGS. 18A-18D, in yet another embodiment of the disclosure, the forming box 12 can include one or more ejectors 102 to aid in releasing the package (not shown) from the forming box 12 after sealing. As described above, the forming box 12 can include any suitable number of portions. By way of example only, description herein will be made with reference to three actuating portions 14, 16, 18. In an embodiment, the first portion 14 can include a first surface 38 extending between first and second ends 40, 42. The second portion 16 can include second 44 and third surfaces 46 joined at a corner 48. The third portion 18 can include fourth 56 and fifth 58 surfaces joined at a corner 60. The first surface 38 defines a first wall of the forming box 12, the third surface 46 defines a second wall of the forming box 12, the second surface 44 defines a portion of the fourth wall of the forming box 12, the fifth surface 58 defines a third wall of the forming box 12, and the fourth surface 56 defines the remaining portion of the fourth wall of the forming box 12.

Figure 18A:
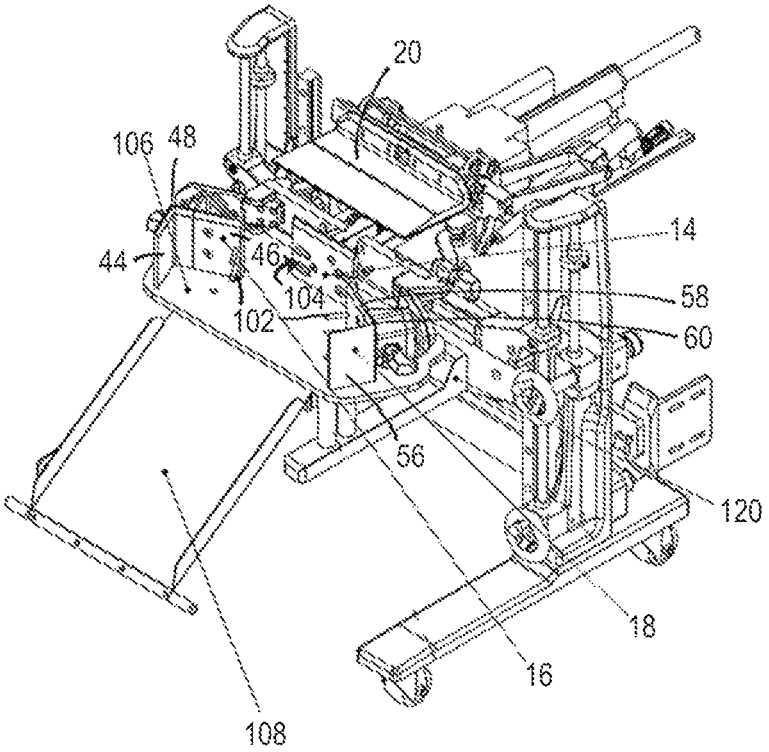
FIG. 18A is a perspective view of a forming box assembly in accordance with an embodiment of the disclosure.
Figure 18B:
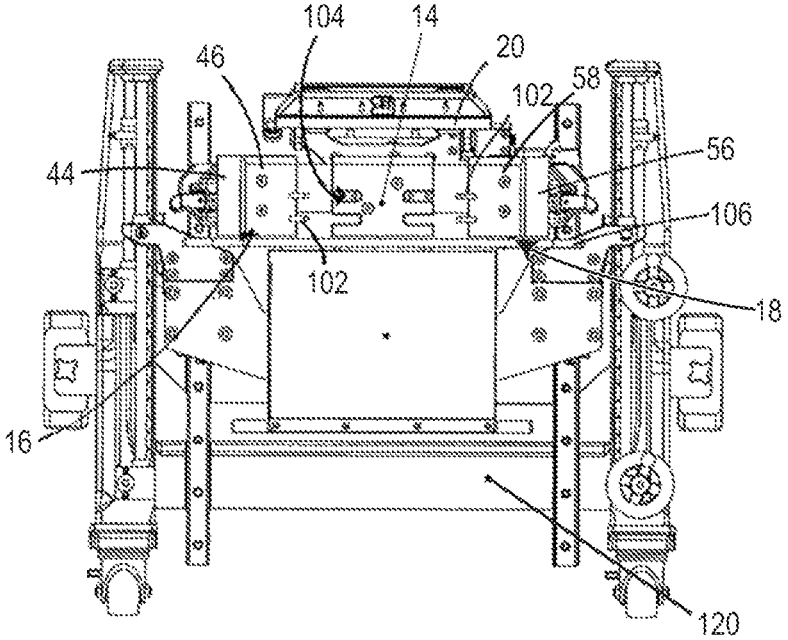
FIG. 18B is a front view of the forming box assembly of FIG. 18A.
Figure 20A:
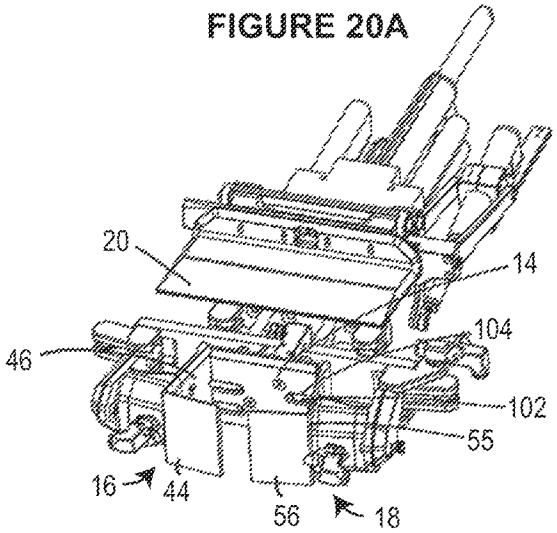
FIGS. 20A-20D are perspective views of the forming box of FIGS. 19A-19D, in (A) the package receiving position, (B) the package retaining position, (C) the package ejecting position, and (D), the package ejected position.
Figure 20B:
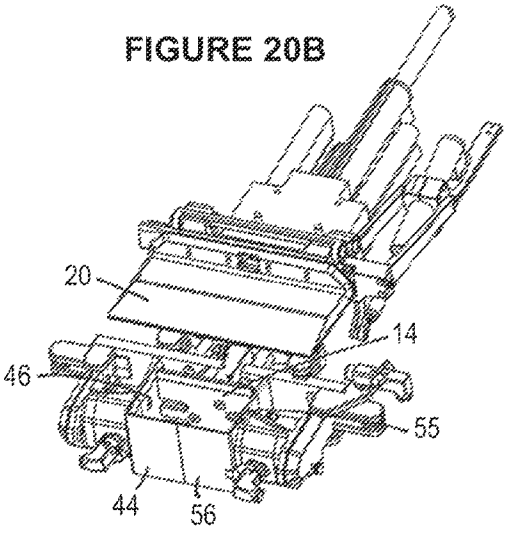
Figure 20C:
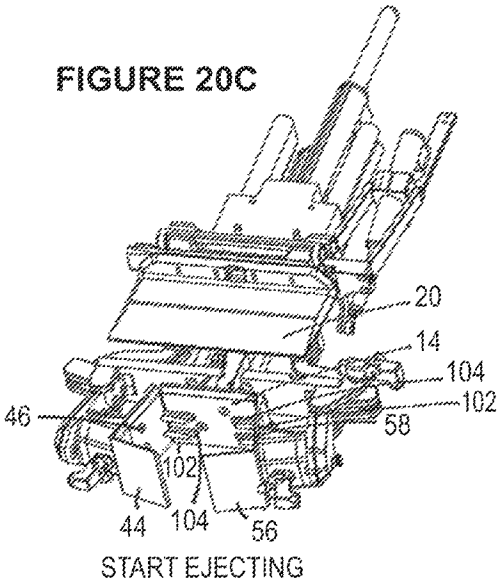
Figure 20D:
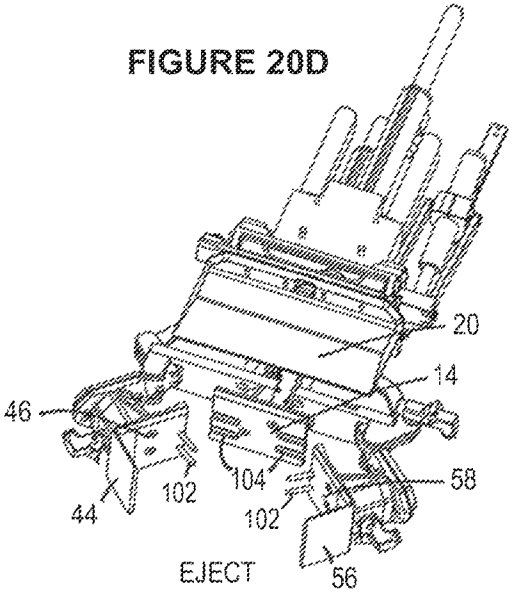

The third surface 46 and/or the fifth surface 58 can include one or more ejectors 102 extending perpendicularly from the surface. For example, the one or more ejectors 102 can extend from an end of the third surface 46 and/or fifth surface 58 that is adjacent to the first portion 14. Referring to FIG. 18B, in some embodiments, the first portion 14 can include one or more apertures 104 disposed in the first surface 38 to receive the one or more ejectors 102. Referring to FIG. 20B, the apertures 104 can be arranged such that when in the forming box 12 is in the second, closed position, the ejectors 102 reside within the apertures 104 and a substantially planar first wall is defined. Referring to FIGS. 19C, 19D, 20C, and 20D, when the forming box 12 is actuated to the third position for releasing the package, the ejectors 102 contact the package (not shown) and aid in forcing the package out of the forming box 12.

The one or more ejectors 102 can take a variety of forms and shapes, including, but not limited to, pins, pegs, posts, finger-like extensions, and combination thereof. The ejectors 102 can be permanently or removably attached to the second and/or fourth surface 44, 54 of the second and third portions 16, 18, respectively, or can be formed integral with the portion from which it extends. For example, the ejector 102 can include threads and be received in a threaded hole disposed in the portion, thereby providing an ejector that is removable. In various embodiments, the ejectors 102 extend from the third and/or fifth surface 46, 58 at an angle other than a 90° angle, for example, angled relative to the surface 46, 58 about 90° to about 135°. The ejectors 102 can have a length extending from the third and/or fifth surface 46, 58 of about 0.5 inches to about 4 inches, about 1 inch to about 2 inches, about 2 inches to about 4 inches, about 0.5 inches to about 1 inch. Other lengths are also contemplated herein. The length of the ejectors can depend on the package size to be formed using the forming box. For example, for smaller packages, the length of the ejectors can be less than about 1 inch and for larger packages the length of the ejectors can be greater than about 2 inches.

The forming box 12 can include any suitable number of ejectors 102. For example, the forming box 12 can include one ejector 102 extending from the third or fifth surface 46, 58. In yet another embodiment, the forming box 12 can include one ejector 102 extending from the third surface 46 and one ejector 102 extending from the fifth surface 58. In yet another embodiment, the forming box 12 can include two ejectors 102 extending from the third surface 46 and two ejectors 102 extending from the fifth surface 58. For example, one or both of the third and fifth surfaces 46, 58 can include 1 to 12 ejectors, 2 to 10 ejectors, 4 to 8 ejectors, 3 to 7 ejectors, 4 to 12 ejectors, and 6 to 10 ejectors. Other suitable numbers of ejectors include, for example, 1, 2, 3, 4, 5, 6, 7, 8, 9, 10, 11, and 12 ejectors. Use of more than 12 ejectors is also contemplated herein. The selection of the suitable number of ejectors can depend, for example, on the package size. For example, it may be required to utilize a larger number of ejectors for wider packages so that the package is evenly engaged by the ejectors along the width of the package. In embodiments including ejectors 102 extending from the third surface 46 and the fifth surface 58, the surfaces can include the same or different numbers of ejectors.

Figure 18C:
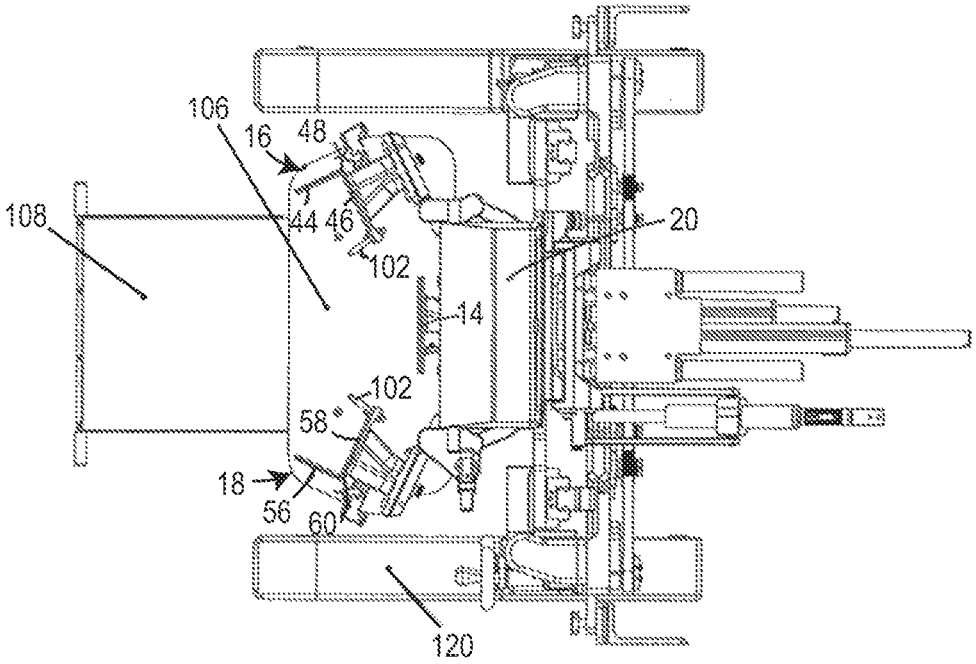
FIG. 18C is a top view of the forming box assembly of FIG. 18A.
Figure 18D:
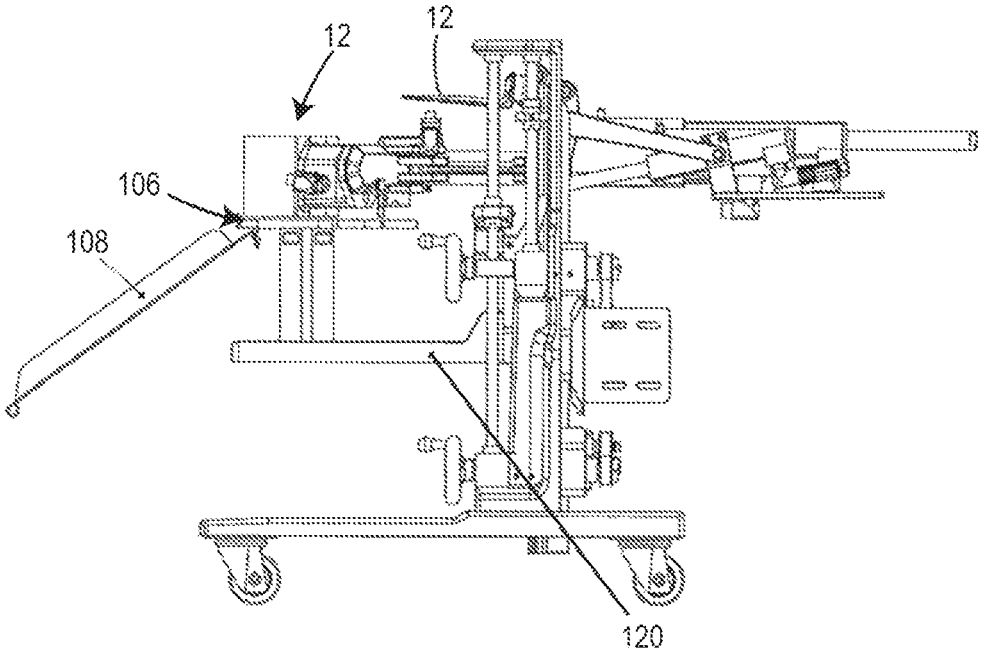
FIG. 18D is side view of the forming box assembly of FIG. 18A.
Figure 19D:
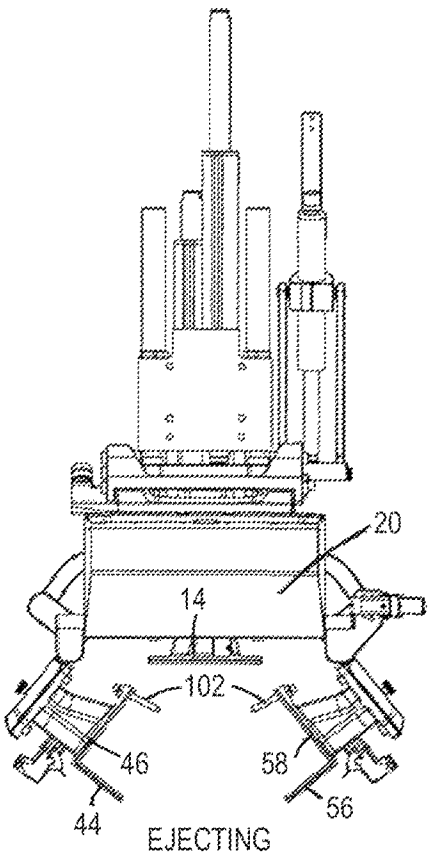
FIGS. 19A-19D are top views of a forming box in accordance with an embodiment of the disclosure, in (A) the package receiving position, (B) the package retaining position, (C) the package ejecting position, and (D), the package ejected position.
Figure 19C:
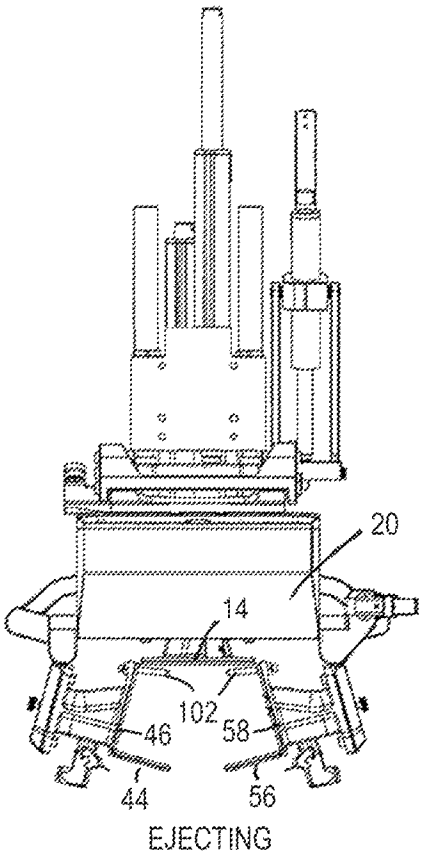
Figure 19B:
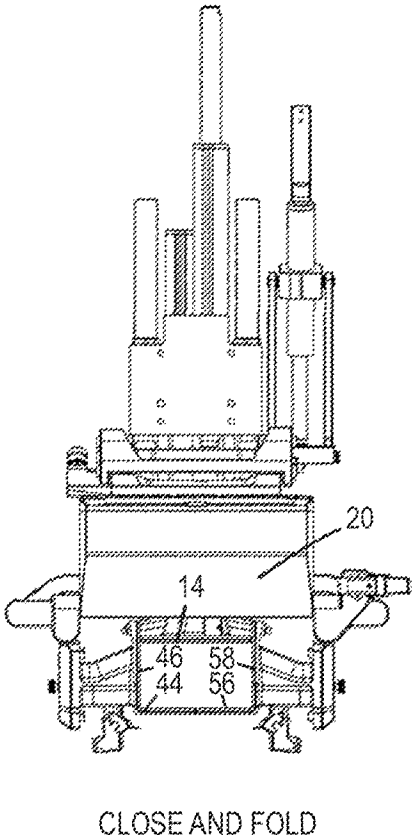
Figure 19A:
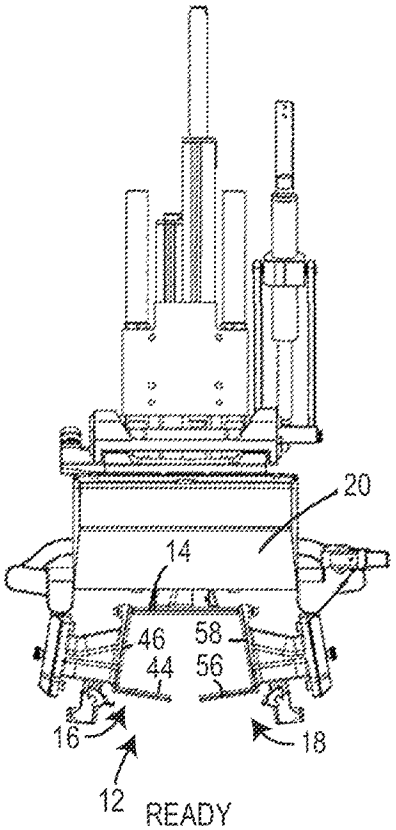

Referring to FIG. 18C, in various embodiments, the apparatus or system for making the flexible package can include a stationary plate 106 disposed beneath the forming box 12, adjacent the second end. When a package is received in the forming box 12, the package resides on the stationary plate 106. Advantageously, in such embodiments, a conveyor need not be disposed beneath the forming box 14 to aid in releasing the package from the forming box 12. It has been surprisingly and beneficially discovered that the ejectors 102 can engage the package and provide enough force to push the package out of the forming box 12 when the forming box 12 is actuated to the third position. In various embodiments, the package can be pushed across a stationary plate 106 and onto a take away conveyor for further processing, such as boxing. In other embodiments, as illustrated in FIG. 18A, the package can be pushed across the stationary plate 106 to a chute 108 or other means of transporting the package for further operation, such as boxing. By eliminating the need for a conveyor to be disposed beneath the forming box, the complexity of coordinating the timing of a conveyor speed with the actuation and folding operations associated with the forming box can be eliminated.

It is also contemplated herein that more complex systems such as an actuating plate disposed beneath the forming box can be used as opposed to a stationary plate. The plate may actuate in a direction transverse to the transport path such that it is disposed beneath the forming box when a package is to be received in the forming box and actuate away from the forming box once the package is released from the forming box. The plate may also or alternatively actuate in a direction parallel to the transport path, towards any away from the forming box second end, to provide improved pressure against the package when the package is retained in the forming box for flap folding, while allowing for release of the pressure during receipt of the package and ejection of the package from the forming box. One or more plate actuators may be coupled to the plate to actuate the plate in the various positions.

In some embodiments, the stationary plate 106 may include a forming member 250, as illustrated in FIGS. 31A to 34D. As illustrated in FIG. 31E, the forming member 250 may have a raised portion or a protrusion upwardly extending from a top surface 251 of the stationary plate 106. In some embodiments, the forming member 250 may include a perimeter portion 252 and a central portion 254, and the perimeter portion 252 may at least partially surround the central portion 254. In some embodiments, the perimeter portion 252 completely surrounds the central portion 254.

The perimeter portion 252 of the forming member 250 may include one or more segments that forms or cooperates to form a shape (or two or more shapes) that generally corresponds to a shape (or two or more shapes) of a perimeter of bottom portion of a package that is received in the forming box 12. For example, the perimeter portion 252 may include one segment that forms an oval or circular shape. In other embodiments, the perimeter portion 252 may include a plurality of segments that cooperate to form a polygonal shape, such as a rectangular shape or a square shape. The perimeter portion 252 (i.e., the segments that cooperate to form the perimeter portion 252) may be positioned on the top surface 251 of the stationary plate 106 such that each of the segments of the perimeter portion 252 are disposed within (i.e., inside) a perimeter formed by the forming box 12 (e.g., the first, second and third portions 14, 16, 18 of the forming box 12) when the forming box 12 is in the second position (and when viewed normal to the top surface 251 of the stationary plate 106).

The perimeter portion 252 may have any suitable cross-sectional shape or combination of shapes. More specifically, the perimeter portion 252 (i.e., the segments that cooperate to form the perimeter portion 252) may be tapered and may gradually decrease in height (i.e., distance normal to the top surface 251 of the stationary plate 106) from the central portion 254 to the top surface 251 of the stationary plate 106. In some embodiments, the perimeter portion 252 (i.e., the segments that cooperate to form the perimeter portion 252) may be normal to the top surface 251 of the stationary plate 106. Any other shape or combination of shapes is contemplated. In some embodiments, a cross-sectional shape of the perimeter portion 252 (i.e., the segments that cooperate to form the perimeter portion 252) may be uniform (or substantially uniform) along the entire perimeter portion 252. In other embodiments, one or more portions of the perimeter portion 252 (i.e., the segments that cooperate to form the perimeter portion 252) may have a cross-sectional shape that varies.

Figures 31A, 31B, 31C, 31D, 31E, 31F, 31G, 31H:
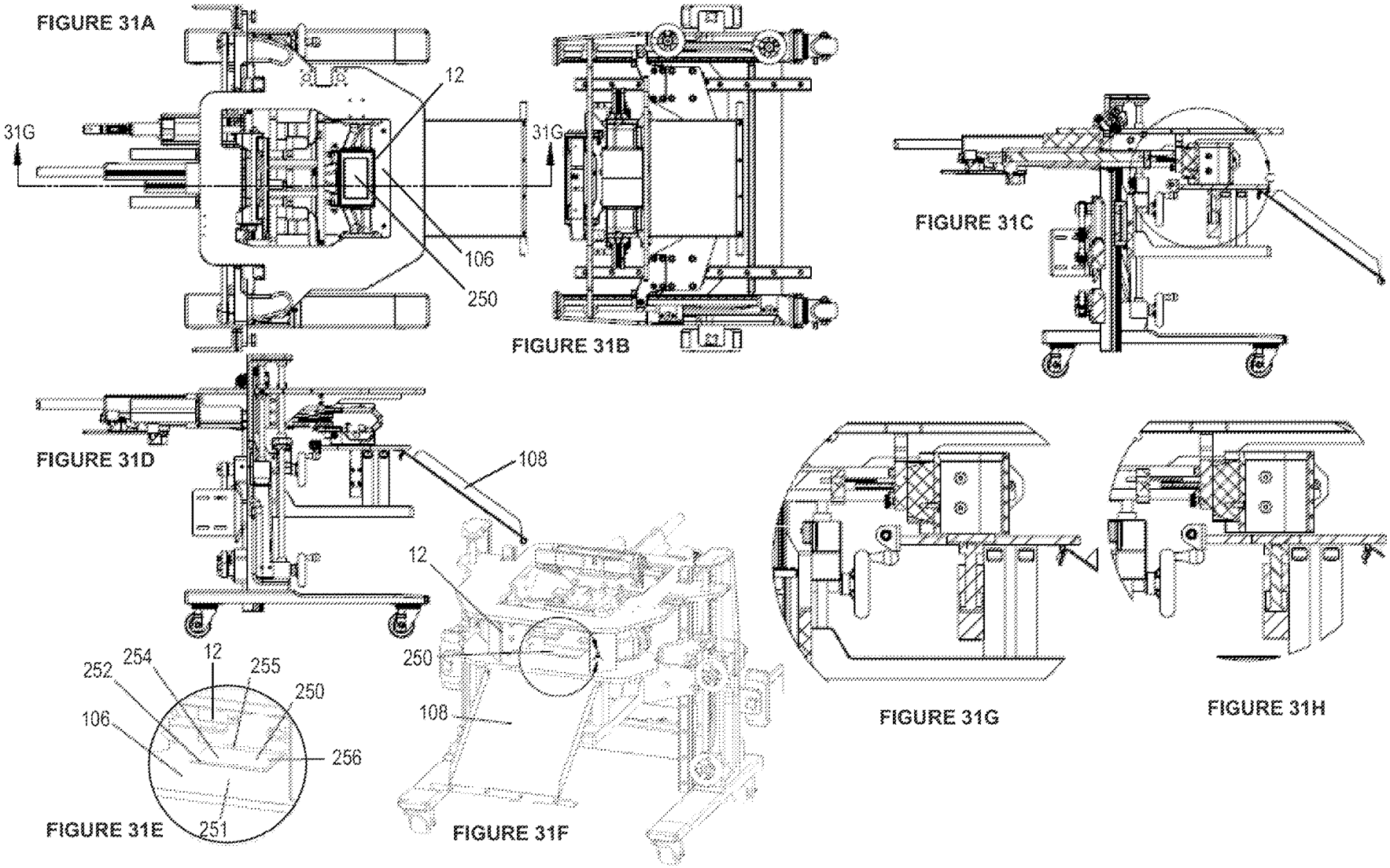
FIGS. 31A to 31H are various views of an embodiment of a stationary plate and forming box.
Figure 32A:
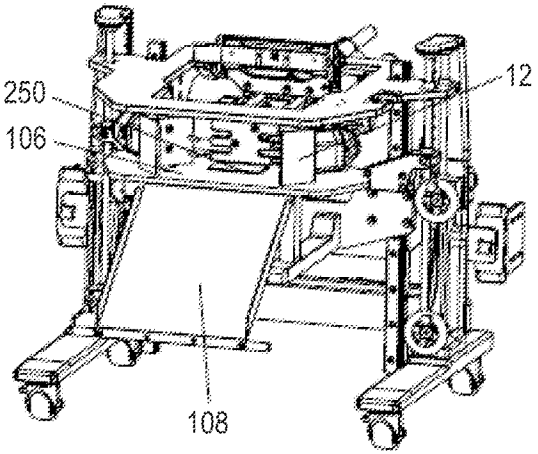
FIGS. 32A to 32D are various views of an embodiment of a stationary plate and forming box.
Figure 32B:
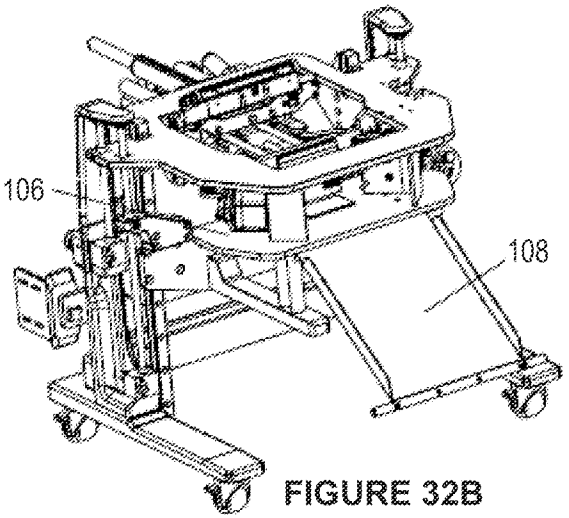
Figure 32C:
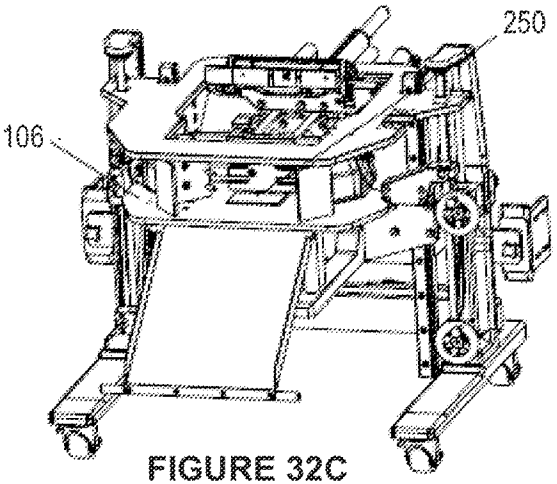
Figure 32D:
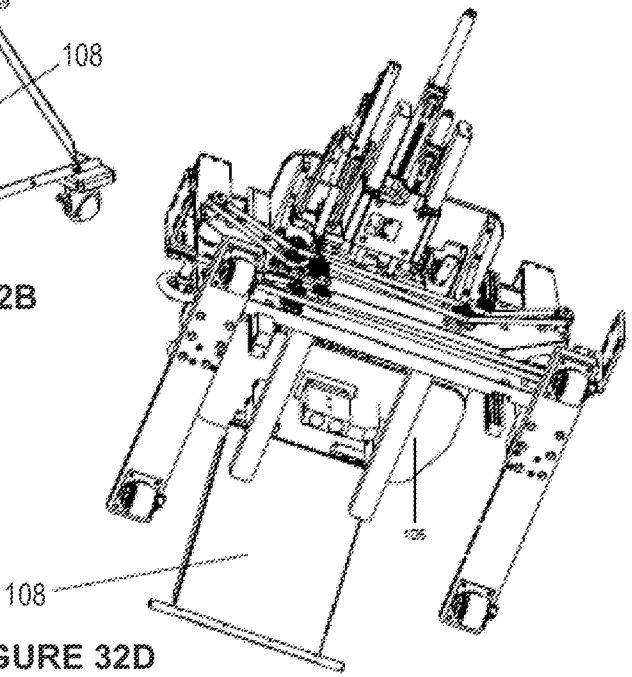
Figure 33B:
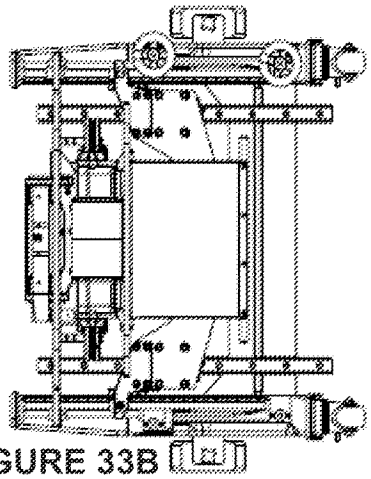
FIGS. 33A to 33G are various views of an embodiment of a stationary plate and forming box.
Figure 33A:
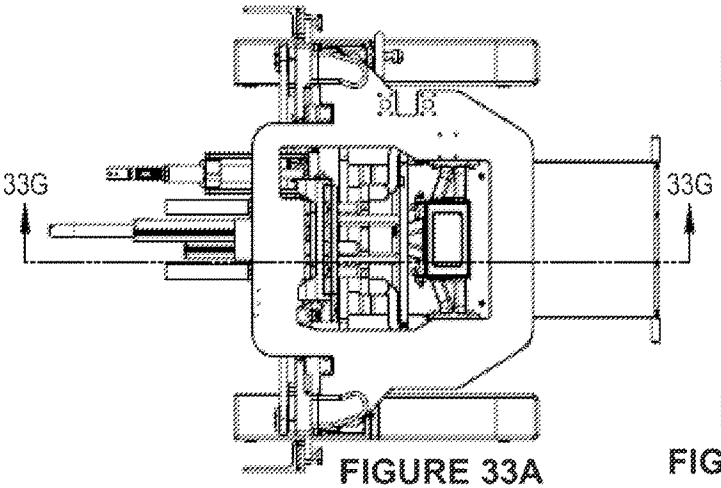
Figure 33C:
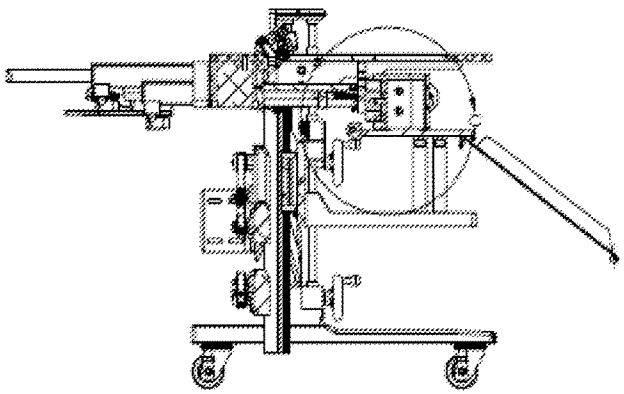
Figure 33G:
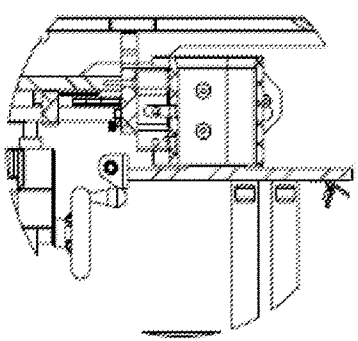
Figure 33E:
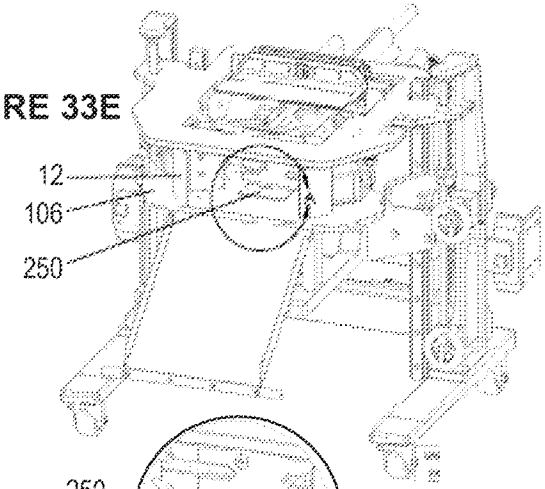
Figure 33F:
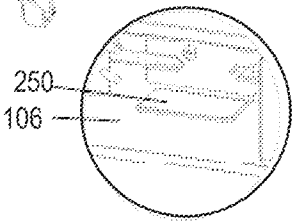
Figure 33D:
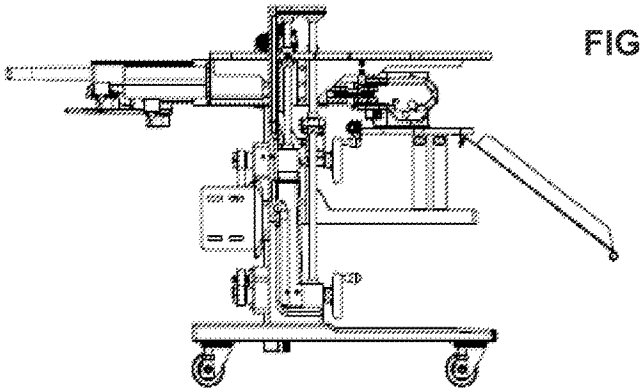
Figure 34A:
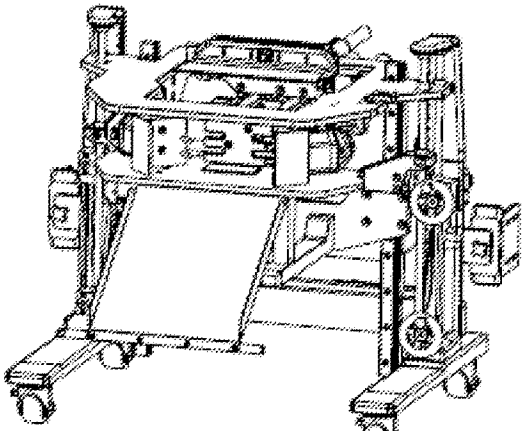
FIGS. 34A to 34D are various views of an embodiment of a stationary plate and forming box.
Figure 34B:
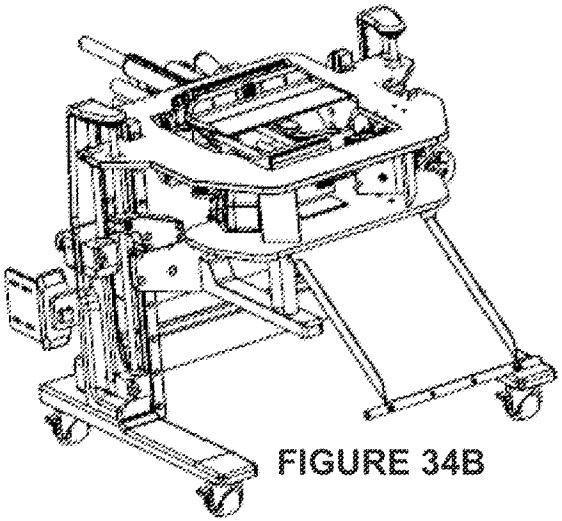
Figure 34C:
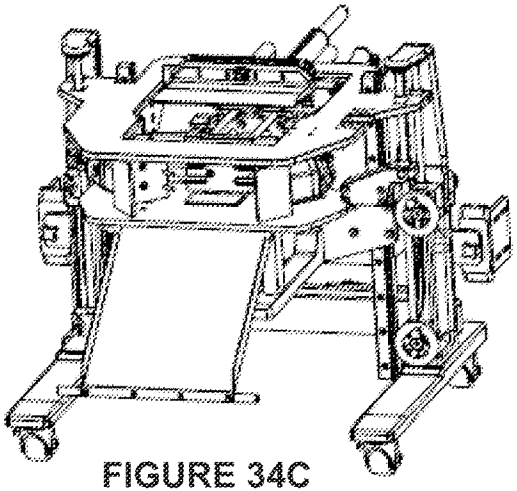
Figure 34D:
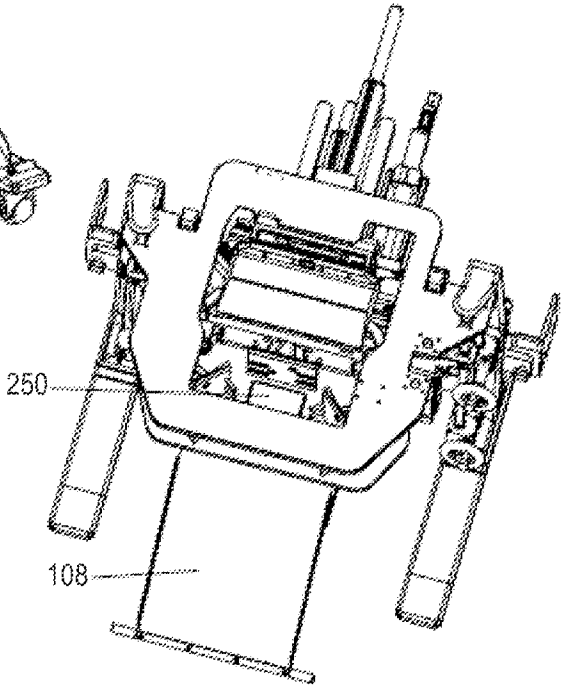

Still referring to FIG. 31E, a perimeter of the central portion 254 may be defined by an edge portion 255 having a shape that corresponds to the shape of the perimeter portion 252 when viewed normal to the top surface 251 of the stationary plate 106. A top surface 256 of the central portion 254 may have any suitable shape or combination of shapes. For example, the top surface 256 of the central portion 254 may be planar or substantially planar (when viewed in a direction parallel to the top surface 251 of the stationary plate 106) and may be disposed at a desired vertical distance (i.e., a distance normal or substantially normal to the top surface 251 of the stationary plate 106) from the top surface 251 of the stationary plate 106. The vertical distance may correspond to a distance that allows a top surface of the central portion 254 to contact a surface of a bottom portion of a package that is received in the forming box 12. In some embodiments, the top surface 256 of the central portion 254 may be contoured or partially contoured. In some embodiments, all or a portion of the forming member 250 may be formed as a unitary part with the stationary plate 106. In other embodiments, all or a portion of the forming member 250 may be coupled to the stationary plate 106 (e.g., by mechanical fasteners or by welding). The skilled person would recognize that the forming member 250 may be formed on or coupled to an actuating plate instead of a stationary plate 106.

Figure 35A:
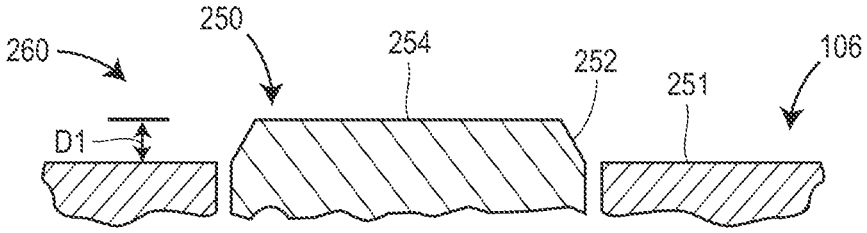
FIG. 35A is a cross-sectional view of a forming member and a stationary plate in a first position.
Figure 35B:
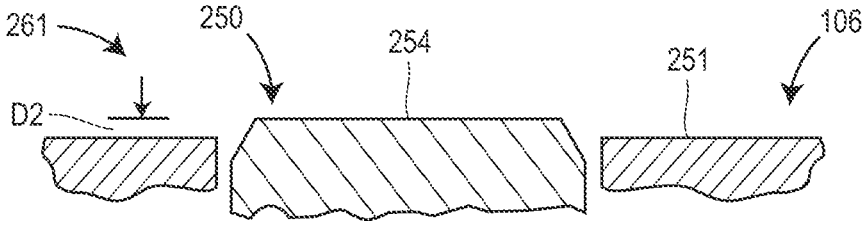
FIG. 35B is a cross-sectional view of the forming member and the stationary plate of FIG. 35A in a second position.

In some embodiments, such as that illustrated in FIGS. 35A and 35B, the central portion 254 and the perimeter portion 252 of the forming member 250 may be displaceable relative to the stationary plate 106. Specifically, the forming member 250 may displace (e.g., vertically displace along an axis normal to the top surface 251 of the stationary plate 106) from a first position 260 (illustrated in FIG. 35A) to a second position 261 (illustrated in FIG. 35B) that is different than the first position 260. In some embodiments, the first position 260 may be a position in which the top surface 256 of the central portion 254 is a desired vertical distance D1 from the top surface 251 of the stationary plate 106, and the second position 261 may be a position in which the top surface 256 of the central portion 254 is coplanar with (or substantially coplanar with) the top surface 251 of the stationary plate 106. In other embodiments, such as that illustrated in FIG. 35B, the second position 261 may be a position in which a vertical distance D2 between the top surface 256 of the central portion 254 and the top surface 251 of the stationary plate 106 may be a vertical distance D2 that is less than the desired vertical distance D1 between the top surface 256 of the central portion 254 and the top surface 251 of the stationary plate 106. In still other embodiments, the second position 261 may be a position in which the top surface 256 of the central portion 254 is vertically below the top surface 251 of the stationary plate 106. The skilled person would recognize that such configurations allows a package to be ejected from the forming box 12 (e.g., using the one or more ejectors of FIGS. 18A-18D previously discussed) without interference from the forming member 250.

In use, when a package is received into the forming box 12, a surface of a bottom portion of a package may be at least partially engaged (or contacted) by the top surface 256 of the central portion 254 and a perimeter portion (that may surround the surface of the bottom portion) of the bottom portion of the package may be at least partially engaged or contacted by the segment(s) forming the perimeter portion 252. In embodiments in which the forming member 250 displaces relative to the stationary plate 106, this position of the top surface 256 corresponds to the first position 260 of FIG. 35A. So disposed, the forming member 250 maintains the shape of the bottom portion of the package when the package is in the forming box 12, thereby minimizing or eliminating deformation of the bottom portion of the package, if desired. Alternatively, the forming member 250 may also crease the edges of the bottom portion of the package (for example, by leaving a gap proximate to the edges so when a flap folder, e.g., the first flap folding bar 20, applies downward pressure to the package, the internal package pressure pushes the edges into the gap and "over-bends" the edges). In embodiments in which the forming member 250 displaces relative to the stationary plate 106, the forming member may displace to the second position 261 (e.g., of FIG. 35B) after the forming member 250 creases the edges of the bottom portion of the package but prior to (or during) the ejection of the package from the forming box 12.

As with the embodiment described above, the forming box 12 can include one or more forming box actuators to actuate portions of the forming box to the various positions. In accordance with an embodiment, the actuators can be operatively coupled to one or more of the portions of the forming box. For example, in an embodiment, actuators are coupled to the second and third portions 16, 18 of the forming box 12 to actuate the second and third portions 16, 18 while the first portion 14 remains stationary. In yet another embodiment, only one of the portions may actuate or all three portions can be actuated.

In any of the embodiments of the forming box disclosed herein, the forming box actuators can be any known type of actuator. For example, in an embodiment, the forming box actuators are linear motors. Other types of actuators include, but are not limited to, air cylinders, linear servos, electric cylinders, hydraulic cams, hydraulic cylinders, and combinations thereof.

Any of the actuators describe herein can be any known type of actuator including, but not limited to, linear servos, air cylinders, linear motors, electric cylinders, hydraulic cams, hydraulic cylinders, and combinations thereof.

In operation, in any embodiment of the forming box described herein, a sealed package can be received into the forming box 12 when the forming box 12 is in the first position. In the first position, the first, second, and third portions 14, 16, 18 are separated slightly to allow the package to be received within the forming box 12 and accommodate any potential offset in the package path that may occur during the package transport process, but prevent the package from passing through the forming box 12. The forming box 12 then actuates to the second position in which the first, second, and third portions 14, 16, 18 close with the mating surface in contact or substantially in contact with one another, as described above. The forming box 12 is sized such that the package is retained within the first, second, and third portions 14, 16, 18 when the forming box 12 is in the second position. For example, in an embodiment, the forming box 12 can be sized such that the first, second, and third portions 14, 16, 18 apply a pressure to the panel of the package when the forming box 12 is in the second position.

In various embodiments, the package to be received in the forming box 12 is a sealed package having at least one seal that extends perpendicularly or substantially perpendicularly from a panel of the package. The package can be received in the forming box 12 such that at least one first seal extends perpendicularly or substantially perpendicularly from the first end of the forming box 12. Once the package is received in the forming box 12, the first flap folding bar 20 can be actuated to the second position in which the first flap folding bar 20 is shifted in a direction transverse to the transport path of the package (and flexible material in a packaging machine) across the first end of the forming box 12 and engages the at least one first seal to force the seal over towards the panel of the package. In various embodiments, the first flap folding bar 20 can actuate across the forming box 12 and down towards the forming box 12 to apply added pressure to fold the first seal against the panel of the package. In an embodiment, the first flap folding bar 20 can be actuated in a direction transverse to the transport path (across the forming box 12) and then in a direction parallel to the transport path (towards the forming box 12). In other embodiments, the first flap folding bar 20 can be actuated in a direction transverse to the transport path and in a direction parallel to the transport path substantially simultaneously.

In various embodiments, the first flap folding bar 20 and the forming box 12 can actuate. For example, the flap folding bar 20 can be operatively coupled to an actuator that actuates the first flap folding bar 20 in a direction transverse to the transport path and the forming box 12 can be operatively coupled to an actuator that actuates the forming box 12 (including the package retained therein) in a direction parallel to the transport path, towards the first flap folding bar 20. In other embodiments, the first flap folding bar 20 can be stationary and the forming box 12 can be operatively coupled to one or more actuators that actuate the forming box 12 in a direction transverse to the transport path and parallel to the transport path towards the first flap folding bar 20. In such embodiments, the first flap folding bar 20 can reside outside of the transport path and the forming box 12 can be actuated into engagement with the first flap folding bar 20 once the package is received to contact the flap of the at least one seal with the first flap folding bar 20 for folding.

In some embodiments, the seal can be attached to the panel of the package by the applied pressure from the first flap folding bar 20 and the residual heat remaining in the at least one first seal from the sealing operation. In other embodiments or additionally, the first flap folding bar 20 can be heated to apply both heat and pressure to attach the seal to the panel. Alternatively or additionally, the first flap folding bar 20 can be cooled or include cooling structures to cool the heated seal once it has been folded over towards the side of the package. For example, referring to FIGS. 29A-29C, the first flap folding bar can include one or more vent holes 90 that allow for heated and/or cooled gas to flow through the vent holes 90 and towards the surface of the package. In an embodiment, the vent holes 90 can be in fluid communication with a manifold 94 or other supply source for supplying the heating or cooling medium. For example, as shown in FIG. 29A, a cooling manifold 94 can be attached to a surface of the flap folding bar. 20 Alternatively, the supply source can be separate from and fluidly coupled to the vent holes 90. Any structures necessary for fluidly coupling the supply source to the vent holes and/or controlling the supply of cooling or heating medium can be used, including, but not limited to, supply inlets, supply lines, and control valves. As illustrated in FIGS. 29A to 29C and 30A to 30E, the vent holes 90 can be disposed on a bottom surface of the flap folding bar 20 to direct the cooling or heating medium towards the package residing in the forming box 12 during the flap folding operation. In an embodiment, as shown in FIGS. 30A-30E, the flap folding bar 20 can include one or more venting channels 92 having one or more vent holes 90 disposed in the venting channel 92. For example, in one embodiment, the flap folding bar can include a series of vent channels oriented parallel to one another along the surface of the flap folding bar. The vent channels can include the same or a different number of vents. As with the embodiment shown in FIGS. 29A to 29C, the venting channels 92 and vent holes 94 can direct cooling or heating medium towards the package during the flap folding operation. Any suitable number and arrangement of vent holes 90 and/or venting channels 94 can be used. For example, the vent holes can be arranged in a region to localize the application of the heat and/or cooling medium to the package. For example, the flap folding bar can include differing numbers of vent holes (density of vent holes) in various portions to direct more or less heating and/or cooling medium to different regions of the package. Heating and/or cooling medium can be directed to the package through the vent holes during all or any portion of the flap folding aperture.

In an embodiment, during operation, a heating medium, for example, a heating gas can be directed to the package as the flap folding bar is actuated to engage and fold over the seal. The heating gas can aid in heating the flexible material forming the seal and/or the outer surface of the package to allow for or aid in formation of a heat seal between seal and the outer surface of the package.

In an embodiment, during operation, the cooling medium, for example a cooling gas, can be directed to the package after the flap folding bar has engaged and folded over the seal. For example, the flap folding bar can be actuated to engage and fold over the seal and then the cooling gas can be flowed through the vent holes to cool the flexible material while the flap folding bar is still engaged with the package. Alternatively, the cooling gas can be flowed through the vent holes and directed to the package concurrently or substantially concurrently with retracting the flap folding bar from engagement with the flap, after the flap folding operation. Cooling during or after the flap folding operation can advantageously aid in setting a hot tack seal to attach the flap to the outer surface of the package. Cooling can also aid in preventing wrinkling in the seal in downstream operations by cooling the seal in place prior to the downstream operations. Cooling can also aid in preventing the seal from detaching from the outer surface of the package in downstream operations by cooling the seal and setting the attachment of the seal to the outer surface, for example, a heat seal, before such downstream operations.

The flap folding bar can remain actuated over forming box for any suitable duration to allow for contact of the package with the heating or cooling medium. For example, the flap folding bar can remain in the actuated position while the package is ejected from the forming box. Alternatively, the flap folding bar can actuate to engage the package, and then retract prior to or substantially concurrently with the ejection of the package from the forming box. Heating and/or cooling by flowing a medium through the flap folder and out the vent holes can occur at any time during the flap folding process.

In various embodiments, any one or more of the features of heating and/or cooling described above with respect to the first flap folding bar can be incorporated into the second flap folding bar. In such embodiments, cooling and/or heating can be initiated during the flap folding operation while the package is retained above the second flap folding bar. The vents and/or vent channels can be incorporated into the second flap folding bar so as to direct the cooling or heating medium towards the package. For example, in various embodiments, the second flap folding bar actuates to engage a seal of the package while the package is disposed upstream of the second flap folding bar. In such embodiments, the vents and/or vent channels can be located on the upstream surface (top surface) of the second flap folding bar.

In other embodiments, the first seal can be folded by the actuation of the first flap folding bar 20, but not attached to the panel. In such embodiments, the at least one first seal can be retained in substantially the same plane as the panel by the fold imparted by the actuation of the first flap folding bar 20. In yet other embodiments, the first flap can be attached to the panel by application of an adhesive prior to or during the flap folding operation.

The first flap folding bar can further include a sealing structure extending from one or both ends of the flap folding bar. The sealing member can engage the edges of the packages as the flap folding bar is actuated to fold the flap, which can apply a pressure to the edges of the package for forming a seal at the edges of the package. The sealing member of the flap folding bar can be heated, for example, to impart a heat seal at the edges of the package when the flap folding bar is actuated to engage the flap. Alternatively or additionally, the forming box can be heated to heat the edges of the package, as described in detail below.

In an embodiment, the first flap folding member can be arranged with the heating and/or sealing member such that the heating and/or sealing member folds the flexible material into the forming box. In various embodiments, the heating and/or sealing member can be mounted to the flap folder and the forming box may be mounted in a position such that the heating and/or sealing member mounted to the flap folder clamps the flexible material against an edge of the forming box to form and/or seal the edge. The forming box and/or the heating and/or sealing member can be thermally insulated from the flap folder. The heating and/or sealing member can be attached to the flap folder with a spring bias. The heating and/or sealing member can be integrally formed into the flap folder.

Alternatively or additionally, similar to the first flap folding bar 20, the stationary plate 106 and/or the forming member 250 can be cooled or include cooling structures to cool the heated seal once it has been folded over towards the side of the package. For example, the stationary plate 106 may include the one or more vent holes 90 of FIGS. 29A-29C that allow for heated and/or cooled gas to flow through the vent holes 90 and towards the surface of the package. In an embodiment, the vent holes 90 can be in fluid communication with a manifold (or other supply source) for supplying the heating or cooling medium. Alternatively, the supply source can be separate from and fluidly coupled to the vent holes 90. Any structures necessary for fluidly coupling the supply source to the vent holes 90 and/or controlling the supply of cooling or heating medium can be used, including, but not limited to, supply inlets, supply lines, and control valves. The vent holes 90 can be disposed on any suitable surface of the stationary plate 106 and/or the forming member 250 to direct the cooling or heating medium towards the package residing in the forming box 12 during the flap folding operation. In an embodiment, the stationary plate 106 and/or the forming member 250 can include one or more venting channels 92 (illustrated in FIGS. 30A to 30E) having one or more vent holes 90 disposed in the venting channel 92. For example, in one embodiment, the stationary plate 106 and/or the forming member 250 can include a series of vent channels oriented parallel to one another along a surface of the stationary plate 106 and/or the forming member 250 (e.g., the top surface 251 of the stationary plate 106). The vent channels 92 can include the same or a different number of vents. As with the embodiment shown in FIGS. 29A to 29C, the venting channels 92 and vent holes 94 can direct cooling or heating medium towards the package while the package is disposed on the stationary plate 106. Any suitable number and arrangement of vent holes 90 and/or venting channels 94 can be used. For example, the vent holes can be arranged in a region to localize the application of the heat and/or cooling medium to the package. For example, the stationary plate 106 and/or the forming member 250 can include differing numbers of vent holes (density of vent holes) in various portions to direct more or less heating and/or cooling medium to different regions of the package. Heating and/or cooling medium can be directed to the package through the vent holes during all or any portion of the forming process while the package is disposed within the forming box 12.

In an embodiment, during operation, a heating medium, for example, a heating gas can be directed to the package as the package is disposed on the stationary plate 106 and/or the forming member 250. The heating gas can aid in heating the flexible material forming the seal and/or the outer surface of the package to allow for or aid in formation of a heat seal between seal and the outer surface of the package. Heated gas can also help to define the shape of the package by preferentially creating shape memory in the edges. In an embodiment, during operation, the cooling medium, for example a cooling gas, can be directed to the package as the package is disposed on the stationary plate 106 and/or the forming member 250. For example, the cooling gas can be flowed through the vent holes 90 and directed to the package while the package is disposed on the stationary plate 106 and/or the forming member 250. Cooling can advantageously aid in preventing wrinkling of the seals along the bottom portion of the package. In downstream operations by cooling the seal in place prior to the downstream operations. Heating and/or cooling by flowing a medium through the stationary plate 106 and/or the forming member 250. and out the vent holes can occur at any time during the forming process while the package is in the forming box 12. The skilled person would also recognize that a first portion of the stationary plate 106 may be heated and a second portion of the stationary plate 106 may be cooled. The skilled person would also recognize that an actuating plate may be cooled in a manner identical to that described for the stationary plate 106.

In various embodiments, a plate, for example a stationary plate or actuating plate disposed below the forming box as described above can include a sealing structure to engage the edges of the package at the bottom of the forming box to impart a seal at the edges as described above with respect to the first flap folding bar. The sealing structure of the plate can be heated, for example, to impart a heat seal. Alternatively or additionally, the forming box can be heated to heat the edges. When the package is provided into the forming box, the edges of the package can align with the sealing structure of the plate and pressure applied by the first flap folding bar can force the package downward to apply pressure at the sealing structures of the plate. Alternatively or additionally, the plate can actuate upstream towards the package to apply pressure with the sealing structure at the edges of the package and form the seal.

Figure 21:
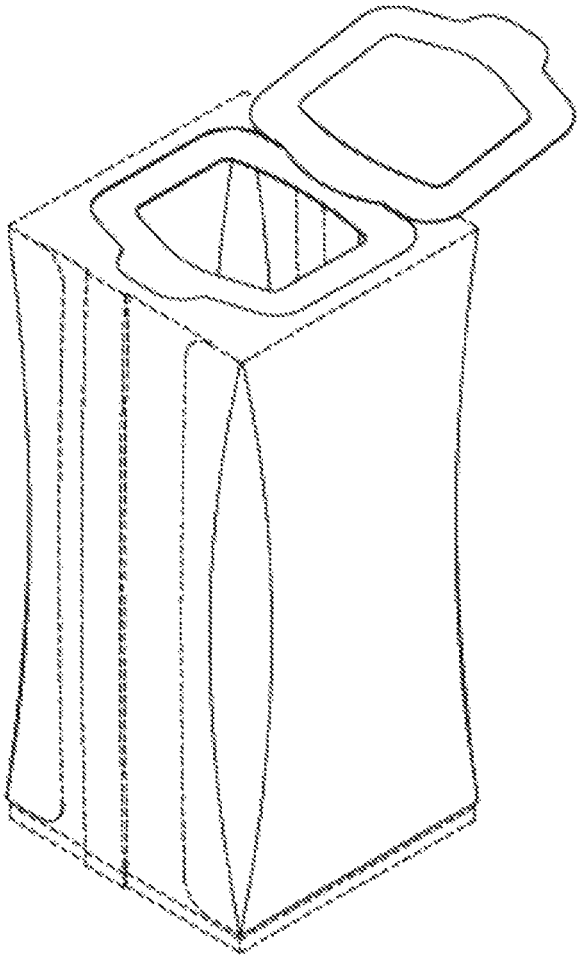
FIG. 21 is a schematic drawing of a contoured package.
Figure 22A:
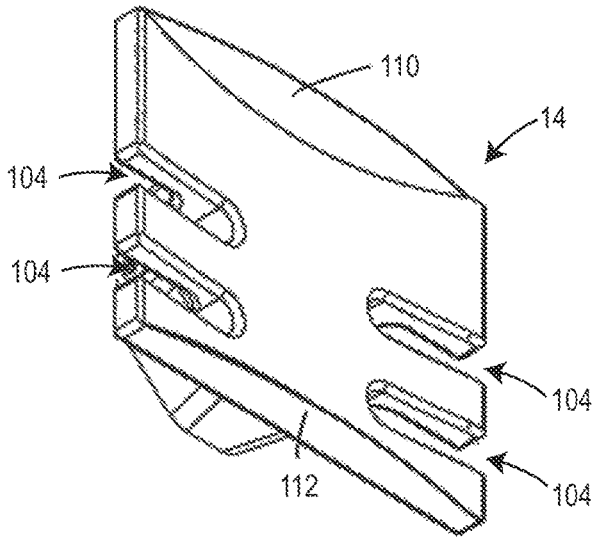
FIGS. 22A-22E are schematic drawings of a first portion of a forming box having contoured surfaces in accordance with an embodiments of the disclosure.
Figure 22B:
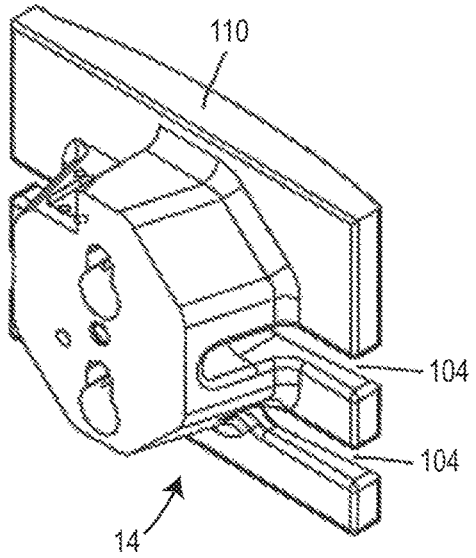
Figure 22C:
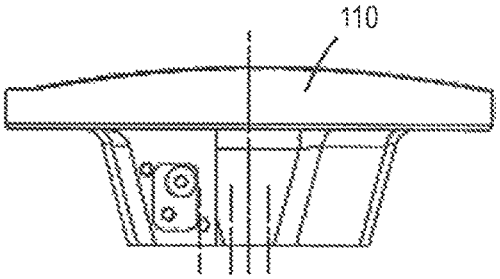
Figure 22D:
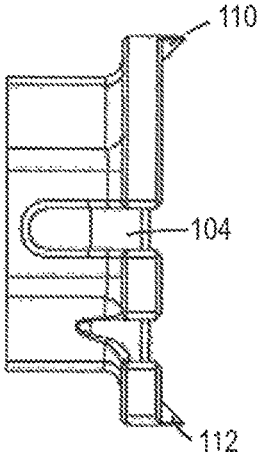
Figure 22E:
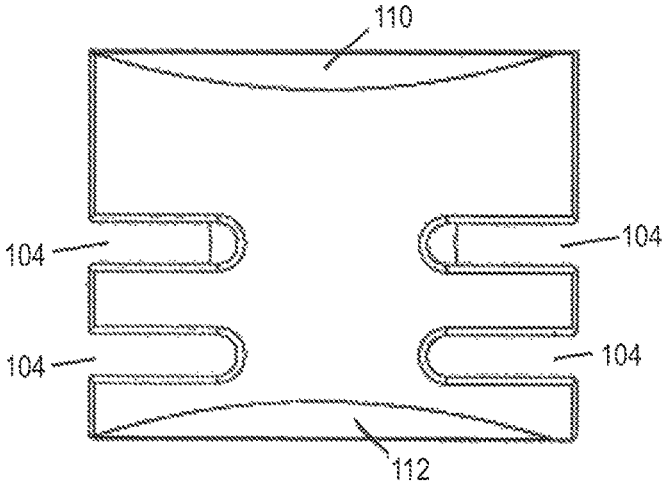
Figure 23B:
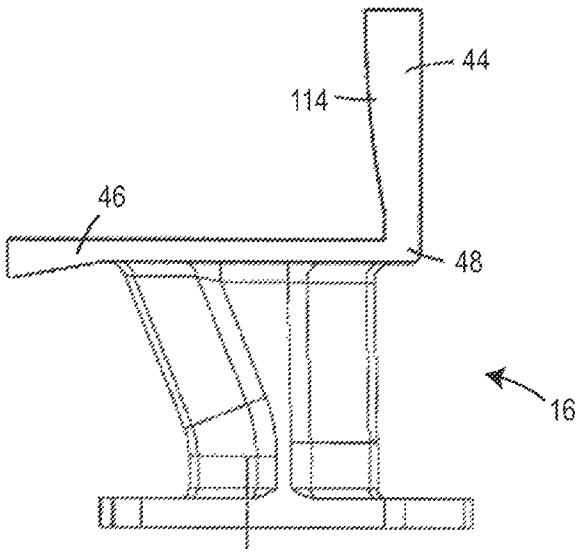
FIGS. 23A-23D are schematic drawings of a second portion of a forming box having contoured surfaces in accordance with an embodiment of the disclosure.
Figure 23D:
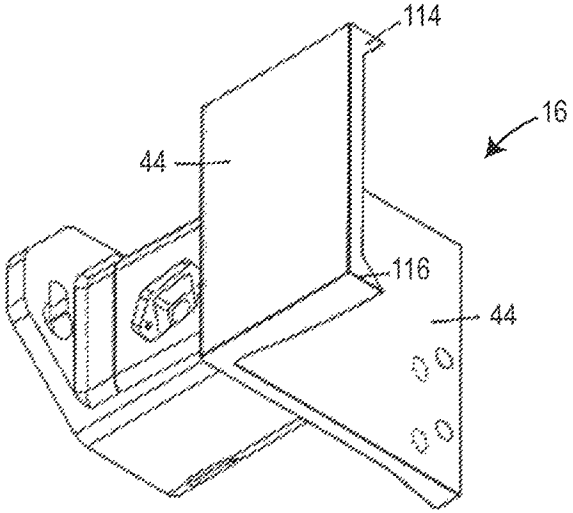
Figure 23A:
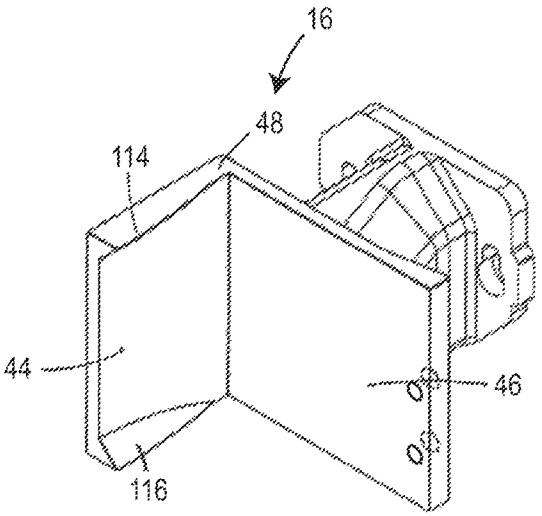
Figure 23C:
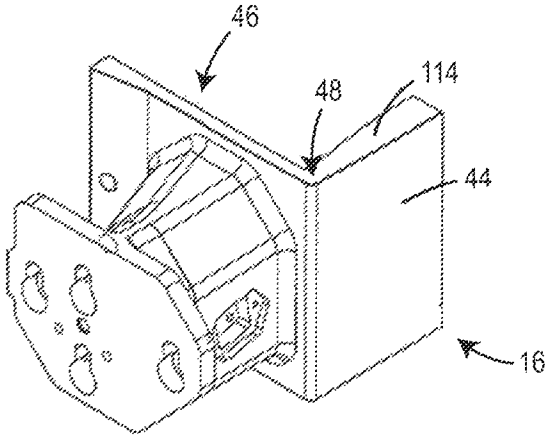
Figure 24B:
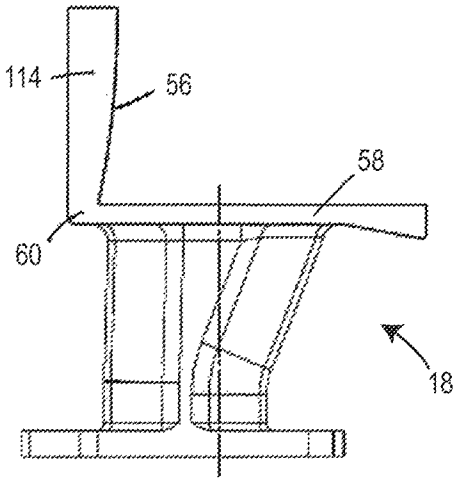
FIGS. 24A-24D are schematic drawings of a third portion of the a forming box having contoured surfaces in accordance with an embodiment of the disclosure.
Figure 24D:
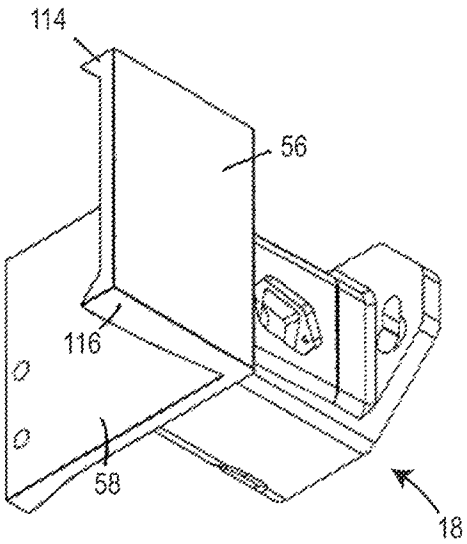
Figure 24A:
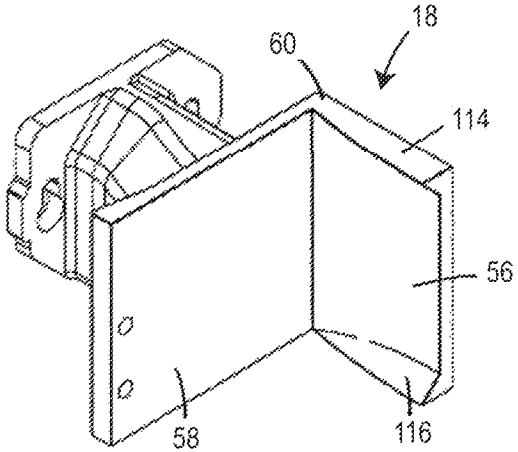
Figure 24C:
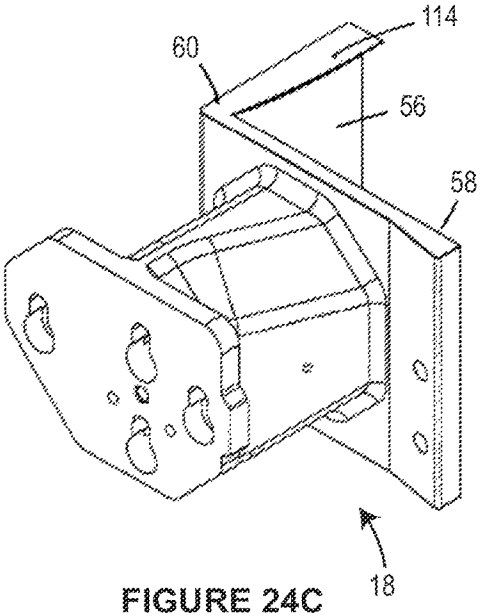

In various embodiments, it can be desired to form a package having a contour shape as illustrated in FIG. 21. As shown in FIG. 21, the side edges of the package are contoured. To aid in achieving the contour shape, the forming box can include one or more contoured surfaces corresponding to the contour edges of the package. That is when a package is received in the forming box, the contour edges of the package or to be defined in the package are arranged in line with the contour surfaces of the portions of the forming box. It is contemplated herein that the contour surfaces of the forming box can be applied to any embodiment of the foregoing box disclosed herein, including one with or without ejectors and/or apertures.

Referring to FIGS. 22A to 22E, the first portion 14 can include opposed first and second contoured surfaces 110, 112 at the top and bottom ends of the first portion 14. Any suitable contour can be used depending on the shape of the package desired. In the embodiment illustrated in FIGS. 22A to 22E, the first portion 14 is illustrated with two convex contours at the top and bottom ends of the first portion 14. When a package is engaged by the forming box, the contours will contact the sides of the package to aid in providing a concave contour shape to the package edges.

Referring to FIGS. 23A to 23D and 24A to 24D, the second and third portions 16, 18 can also include contoured surfaces. For example, the second and fourth portions 44, 56 of the second and third portions 16, 18, respectively, can each include contoured surfaces 114, 116 disposed at the top and bottom ends of the second and third portions 16, 18, respectively. As with the first portion 14, the location of the contoured surfaces corresponds to contoured edges formed or to be formed in the package. That is, when the package is received in the forming box, contour edges of the package align with the contoured surfaces 114, 116 of the second and third portions 16, 18.

The contoured surfaces can be formed along any of the surfaces of the forming box 12, depending on the contours to be imparted to the package. For example, if contours are only desired on subset of the edges of the package, then contoured surfaces could be provided on only a subset of the portions and/or at a subset of the ends of the portions. For example, if it is desired to provide contours only on two edges of the package, the first portion may include only the contoured surfaces, or alternatively, the second and third portions 16, 18 can include the contoured surfaces with the first portion having substantially linear or non-contoured surfaces.

It is also contemplated herein that the contoured surfaces on the first, second, and third portions 14, 16, 18 can have the same contour or different contours shapes and/or dimensions. The contour provided on the surface of the portions can be determined by the desired package configuration and contours to be imparted therein. In various embodiments, the contour surfaces can have a size and shape corresponding to the contoured edges to be formed on the package. In other embodiments, the contour surfaces can have an exaggerated size and shape as compared to the contoured edges to be formed on the package to over-bend the contoured edges of the packages, which can aid in retaining the contoured shape in the package. It is also contemplated herein that the top and/or bottom edge of the first, second, and third portions can be extended into the interior of the forming box, without a contour provided thereon, which can beneficially over-bend the edges of the package. This is can aid in retaining well-defined and/or creased edges in the package even when a non-contoured or straight-line shape is desired.

In an embodiment, the forming box can be heated and/or chilled to aid in forming and defining the shape of the package. For example, the forming box 12 can include a heater to heat all or selected portions of the forming box. For example, portions of the forming box 12 contacting and/or adjacent to the fold lines of the package can be heated and/or cooled to aid in further defining the fold lines/edges of the package. The forming box 12 can additionally or alternatively include a chiller and/or cooling channels 72 to aid in rapidly setting seals and folds formed in prior package processing steps.

Referring to FIGS. 8A to 10H, for example, the forming box of any of the foregoing embodiments can include one or more heaters 68 and/or one or more fluid heating/chilling lines. In the embodiment of FIGS. 8A to 10H, a forming box 12 that does not include ejectors 102 is shown in the figures. However, it is contemplated herein that any of the embodiments of the forming box, including ones with one or more ejectors and/or contour surfaces can include the heating and/or chilling lines. The one or more fluid heating/chilling lines can include one or more fluid inlets or ports 70, one or more fluid channels 72, and one or more fluid outlets 74 for receiving a heating or cooling fluid, such as a heated or cooled gas or liquid. For example, the one or more fluid outlets 74 can be disposed along a surface of one or more of the first, second, and third portions 14, 16, 18 at the first end and/or the second end. In an embodiment, a heated gas can flow through the one or more fluid outlets 74 to locally heat the package at a fold line. The package can be locally heated while the forming box 12 engages the package by actuating into the second position and the first flap folding bar 20 begins to actuate. A cooling gas can then be applied to the package through the one or more fluid outlets 74 or a different set of fluid outlets 74 to chill the package while the first flap folding bar 20 is applying a pressure to the package. In another embodiment, the forming box 12 can include a heater, such as a cartridge heater, to locally heat one or more of the portions of the forming box 12, for example, in regions corresponding to a fold line or edge of the package. The portions of the forming box and/or cooling/heating channels can be formed of a thermally conductive material, such as aluminum, to allow heat transport through the forming box 12. The forming box 12 can alternatively or additionally include a cooler, for example, a thermo-electric cooler to locally cool portions of the package to set folds and creases in the package.

In embodiments including a heater, the forming box 12 can further include fluid inlets, fluid channels 72, and fluid outlets 74 for flow of a chilling fluid to set the folds and edges after heating for example, by the cartridge heater. Additional components, such as thermocouples and temperature sensors can be included to regulate the temperature of the forming box 12.

In various embodiments, the forming box 12 can be heated to soften the material to aid in forming folds and/or seals in the package. The temperature will depend on the type of material, the speed of operation, and the product contained therein. Generally, the flexible material can be heated to a temperature greater than a heat deflection temperature of the flexible material, but less than a melting point and/or distortion point of the flexible material. For example, the forming box can be heated to a temperature of about 70° F. to about 350° F.

During cooling, the forming box 12 can be cooled to any desirable temperature, including room temperature or below room temperature. For example, the forming box can be cooled to a temperature of about 33° F. to about 77° F. Cooling temperatures to set a seal or a fold will depend on the type of material, the speed of operation, and the product contained therein.

The temperature of the forming box 12 can be heated and then cooled to set any folds or seals formed in the flexible material. Alternatively, the forming box 12 can be heated only and cooling can be achieved in a separate operation or by normal convention/radiative processes. For example, cooling fluid can be circulated about the package after it is released from the forming box 12, for example, by directing cooled gas towards the package as travels along the conveyor. In yet another embodiment, the forming box 12 can be cooled only. Cooling can be used to chill the residual heat in the package to set folds and seals formed in the flexible package and/or to aid in setting a seal attaching the at least one extending seal to the panel, for example, where the first flap folding bar 20 is heated.

Figure 2A:
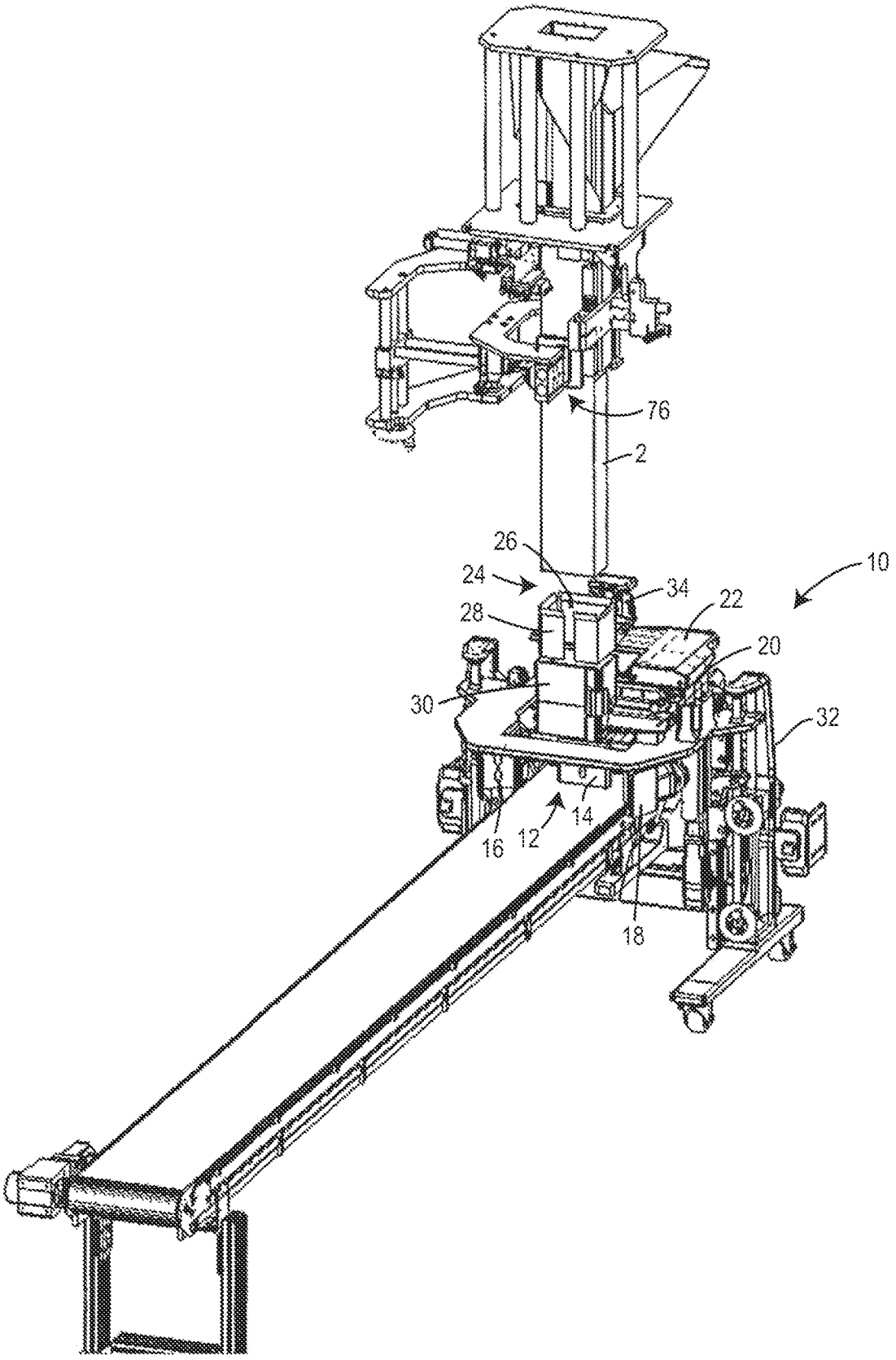
FIG. 2A is a schematic illustration of a system including an apparatus for forming a flexible package in accordance with another embodiment of the disclosure.
Figure 2B:
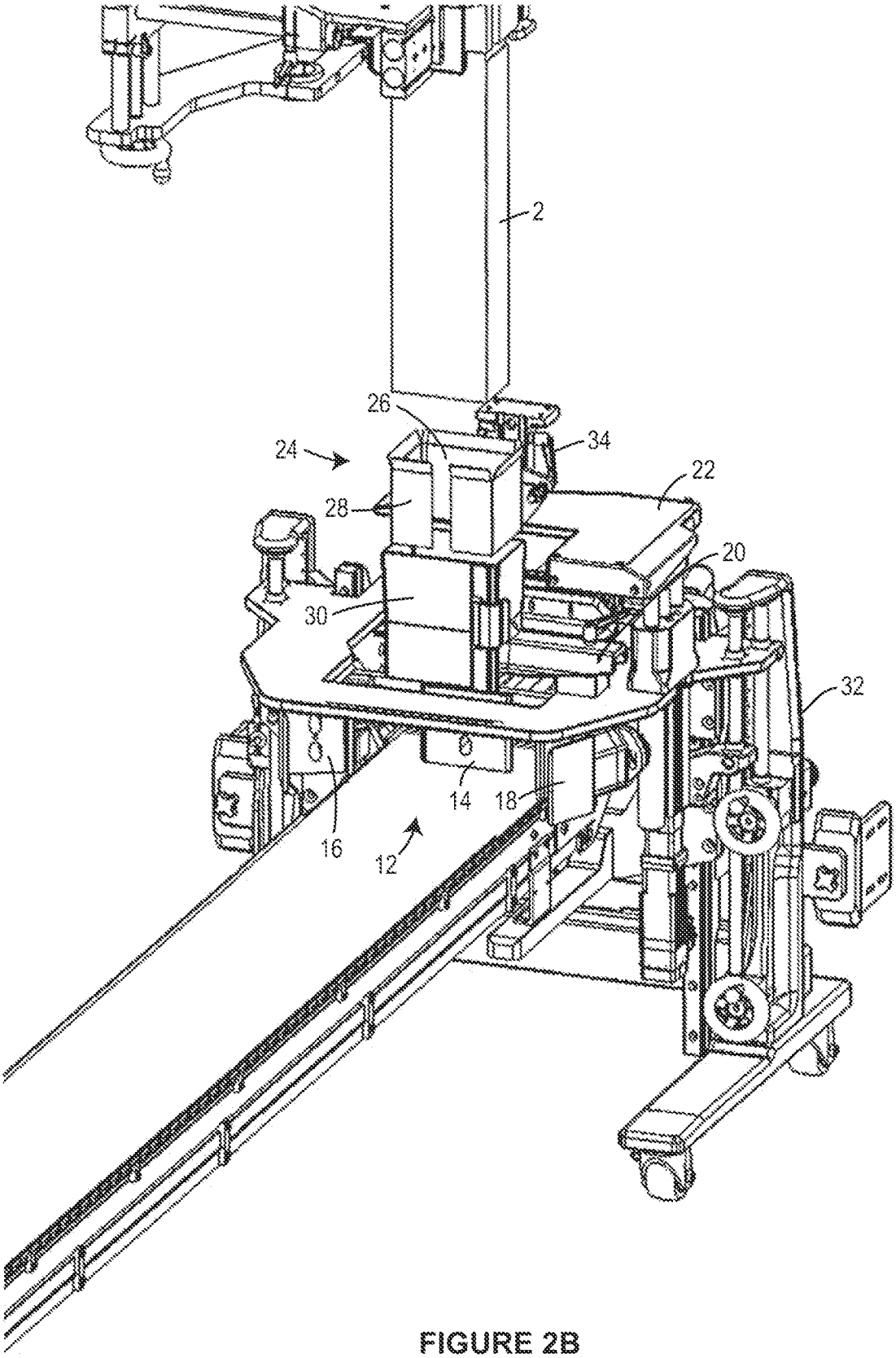
FIG. 2B is a close-up schematic illustration of the apparatus of FIG. 2A.

Referring to FIGS. 2A and 2B, the apparatus 10, can further include a second flap folding bar 22 disposed upstream the first flap folding bar 20. The package can include a second seal extending perpendicularly or substantially perpendicularly from a panel opposite the panel from which the at least one first seal extends. The second flap folding bar 22 can be operatively coupled to at least one second flap folding bar actuator that actuates the second flap folding bar 22 in a direction transverse to the transport path. One or more actuators can also actuate the second flap folding bar 22 in a direction parallel to the transport path. For example, in operation, a sealed package can be transported to the second flap folding bar 22. The second flap folding bar 22 can be actuated to engage the second seal and fold the second seal over towards the panel of the package from which it extends. As with the first flap folding bar 20, the flap folding operation can attach the seal to the panel or the flap folding operation can form a fold that keeps the flap retained in substantially the same plane as the panel. The second flap folding bar 22 can be heated to aid in attaching the second seal to the panel. The second seal can alternatively be attached by residual heat remaining in the second seal after the sealing operation and/or by an adhesive applied prior to or during the flap folding operation.

The package can be received at the second flap folding bar 22 after the package is sealed and released from the sealing components. Alternatively, the second flap folding bar 22 can engage the package after the second seal is formed, but prior to or substantially simultaneously as the first seal is being formed.

In embodiments in which the apparatus 10 does not include a second flap folding bar 22, the second flap folding bar 22 can be a part of the packaging machine upstream of the apparatus 10, such that the apparatus 10 receives a seal package in which one seal is folded over and disposed in substantially the same plane as the panel from which is extends and optionally attached to the panel.

The apparatus 10 can include one or more additional components. Referring to FIGS. 18A and 18B, the apparatus 10 can be provided on a lift assembly 120 that can allow the height of the apparatus to be adjusted, thereby allowing the apparatus to be adaptable to a variety of packaging machine platforms. The lift assembly 120 can control the height of the components of the apparatus, including the forming box and any flap folding bars. The lift assembly 120 can be configured to control the height of the components as a single unit so the relative spacing the components is not affected by the height adjustment. Alternatively or additionally, lift assemblies can be provided to the individual components to allow for individual adjustment of the components of the apparatus, such as the forming box, the stationary plate, the flap folding bars, and any one or more of the components.

Referring to FIGS. 1A to 2B, for example, the apparatus 10 can include a volume adjuster 24 disposed upstream of the first flap folding bar 20 and the second flap folding bar 22, if present. Referring to FIGS. 7A-7F, the volume adjuster 24 can include a package transition box 28 and a plate 26 disposed within the package transition box 28. In various embodiments, the volume adjuster 24 can include opposed actuating plates that actuate towards one another to apply a pressure to the package. In yet another embodiment, the volume adjuster 24 can include stationary plates and actuating plates. The plates of any of the foregoing embodiments can have any suitable size and shape. For example, the plates can be sized and shaped to substantially correspond to the size and shape of the panel of the package, which is contacted by the plate 26 such that a substantially even force is applied across the package panel. In other embodiments, the plate 26 can be sized to be smaller than the package to apply a force in a selected and targeted location of the package.

An actuator can be operatively coupled to the one or more plates to actuate the plate 26 from a first position in which the plate 26 is disposed adjacent to an internal wall of the package transition box 28 to a second position in which the plate 26 is moved transverse to the transport path towards and opposed internal wall of the package transition box 28. In operation, the package is received in the package transition box 28 and the plate 26 is actuated to contact a panel of the package to apply a pressure to the package and release a portion of the air contained within the package. The plate 26 can be actuated substantially simultaneously with the sealing operation to seal the package or the plate 26 can be actuated before the sealing operation is performed to seal the package. In embodiments in which the plate 26 is actuated before the sealing operation is performed, the plate 26 can remain engaged with the package until sealing is complete. For example, the plate can be actuated about 100 ms before the sealing operation is performed. In other embodiments, the plate can be actuated substantially simultaneously with the start of the sealing operation, with the plate being actuated into position prior to complete sealing of the package.

The packaging machine can include a gas nozzle (not shown) disposed for example on or at the end of the forming tube 2 and configured to apply a gas for inflating the flexible material that is being configured into the package. The gas can also provide the package with a modified gas atmosphere depending on the product to be contained therein. Such gas inflation devices are well known in the art. Inflation of the package can be coordinated with the volume adjuster 24, such that the package can be inflated and then deflated to the desired volume by actuation of the plate 26 of the volume adjuster 24 just prior to or substantially simultaneously with sealing the package. Inflation and volume reduction by the volume adjusters can also aid in tucking the flexible material inwardly to form the leading and trailing seals.

In various embodiments, the volume adjuster 24 is separate from the apparatus 10. For example, the volume adjuster 24 can be attached to a frame member 34 that can be incorporated or attached to a conventional packaging machine. In such embodiments, the volume adjuster 24 can be disposed downstream of a seal bar station, which is conventionally disposed downstream of a forming tube 2. In other embodiments, the volume adjuster 24 is a component of the apparatus 10 and can be attached to the frame 32 of the apparatus 10.

Referring again to FIGS. 1A, 1B, 2A, and 2B, the apparatus 10 can further include a guide box 30 disposed upstream the first flap folding bar 20. In embodiments including the second flap folding bar 22, the guide box 30 can be disposed between the first and second flap folding bars 20, 22. The second flap folding bar 22 can either be part of the packaging machine or part of the apparatus 10 in embodiments including a guide box 30. The guide box 30 is sized such that the package can easily pass through the guide box 30 with little to no resistance. The guide box 30 can aid in transitioning the package between the second flap folding bar 22 and the first flap folding bar 20 to keep the package in the proper orientation during the transition.

Referring to FIGS. 11 and 12A to 12E, in accordance with an embodiment of the disclosure, a pre-creasing device 76 can be used when forming the flexible material into the package. The pre-creasing device 76 can include a first plate 78 and a second plate 80 in facing relationship with the first plate 78. One of the plates can be disposed against the forming tube 2, such that the flexible material passes over the plate. The plate disposed against the forming tube 2 can include a stripper plate to aid in removing the flexible material from the plate after the creasing so the flexible material can move down the transport path. For ease of reference, the pre-creasing device 76 will be described herein with reference to the first plate 78 being disposed adjacent the forming tube 2. The first and second plates 78, 80 can include one or more projections and/or one or more apertures.

Referring to FIGS. 15A to 16D, for example, the first plate 78 can include one or more first plate projections 82 and the second plate 80 can include one or more second plate apertures 88 for receiving the first plate projections 82. In operation, the flexible material passes over at least the first plate 78 (or plate disposed against the forming tube), the plates 78, 80 are actuated towards each other to force the flexible material into contact with the projections and forcing the projections into engagement with the corresponding apertures, thereby creasing the flexible material at the location of the projections. Actuation of the plates towards each other can be achieved by actuation of one or both plates. Either one or both of the plates can be operatively coupled to one or more actuators to actuate the plates into engagement to crease the flexible materials. The projections can provide a crease in the flexible material at a region of a fold line of the flexible material that defines an edge of the package when the flexible material is configured into the package. In this embodiment, the first plate 78 is configured to be disposed adjacent the forming tube 2. Alternatively, the second plate 80 can include one or more second plate projections 86 and the first plate 78 can include one or more first plate apertures 84 for receiving the second plate 80 projections.

Referring to FIGS. 13A to 14E, in yet another embodiment, the first plate 78 can include both first plate projections 82 and first plate apertures 84 and the second plate 80 can include both second plate projections 86 and second plate apertures 88, with the first and second plate projections 82, 86 and the first and second plate apertures 84, 88 arranged such that the first plate projections 82 are received in the second plate apertures 88 and the second plate projections 86 are received in the first plate apertures 84 when the plates are actuated into engagement with one another. The embodiment of FIGS. 13A to 14E illustrate first and second plates that include first plate projections 82 and corresponding second plate apertures 88 for forming a crease at a fold line of the flexible material that defines an edge of the package when the flexible material is configured into the package, and second plate projections 86 and first plate apertures 84 for forming a crease in a pull tab to bias the pull tab away from the flexible material. In this embodiment, the first plate 78 is configured to be disposed adjacent the forming tube 2.

The first plate 78 and/or the second plate 80 are operatively coupled to an actuator. Any known actuators including, but not limited to, linear servos and air cylinders, can be used. The one or more actuator can actuate one or both of the plates into engagement with each other such that the flexible material is folded over the projections, defining a crease in the flexible material. The first and second plates 78, 80 and the projections/apertures contained thereon can be arranged such that a crease is defined in the flexible material at an edge of the package to be formed. Additionally, projections can be included on the plate disposed away from the forming tube 2, for example, in a region corresponding to a pull tab of a flap to form a crease in the pull tab to bias the pull tab away from the panel of flexible material. This can advantageously ease grasping of the pull tab when opening the package.

The pre-creasing device 76 can include a frame that is attachable to the frame of a packaging machine to place the pre-creasing device 76 in position along the forming tube 2.

In accordance with an embodiment, a system for making a flexible package from a flexible material can include a conventional packaging machine and an apparatus 10 in accordance with embodiments of the disclosure in which the second flap folding bar 22 is a part of the conventional packaging machine. In accordance with another embodiment, a system for making a flexible package from a flexible material can include a conventional packaging machine and the apparatus in accordance with embodiments of the disclosure in which the second flap folding bar 22 is part of the apparatus. The system of any of the embodiments herein can optionally include a volume adjuster 24, a guide box 30, a pre-creasing device 76, and other components, including but not limited to additional guides, pull belts, heaters, coolers, and conveyors.

Figure 25B:
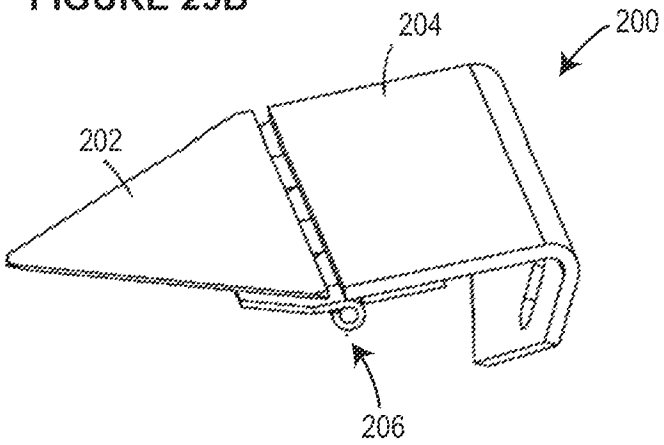
FIGS. 25A-C are various views of an articulating tucker in a non-articulated position in accordance with an embodiment of the disclosure.
Figure 25C:
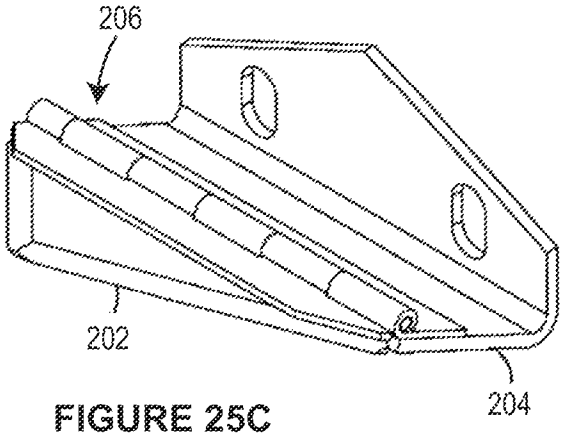
Figure 25A:
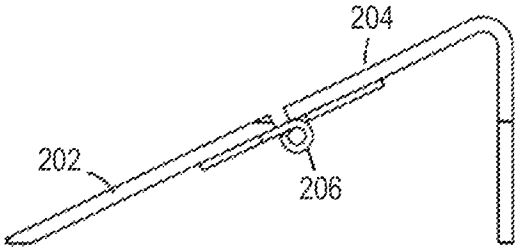
Figure 25F:
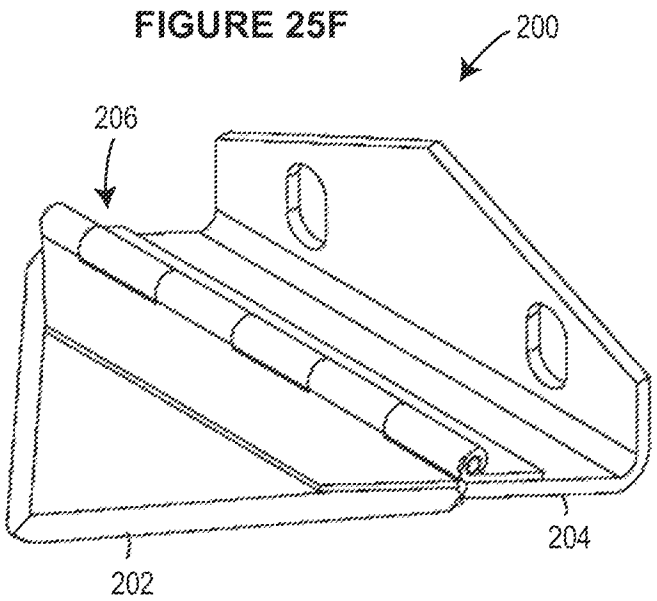
FIGS. 25D-F are various views of the articulating tucker in an articulated position in accordance with an embodiment of the disclosure.
Figure 25D:
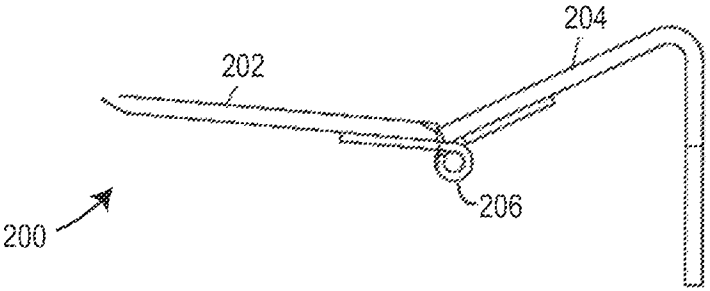
Figure 25E:
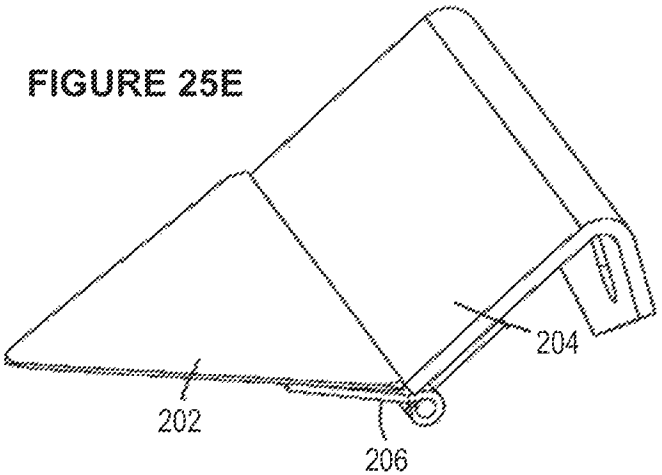
Figure 26B:
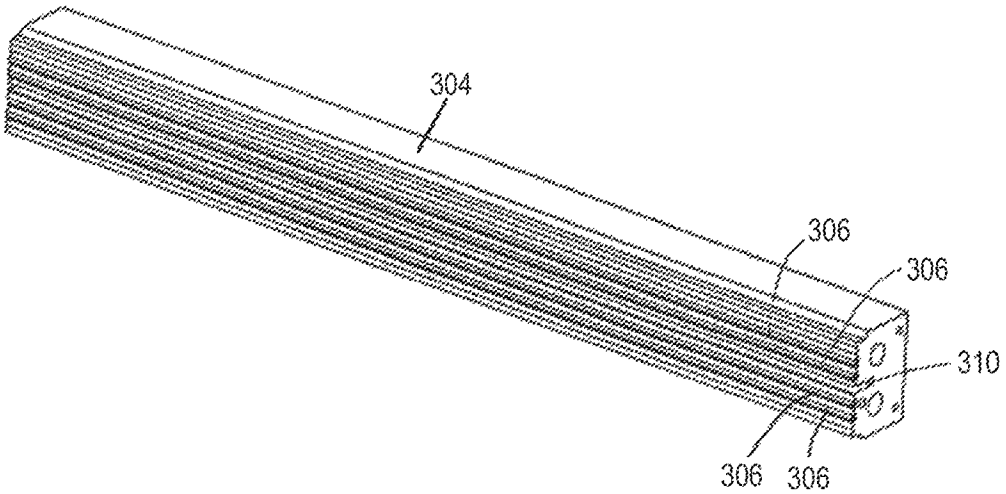
FIG. 26B is a schematic drawing of an engagement bar showing the sealing surface of the seal jaw of FIG. 26A.
Figure 26A:
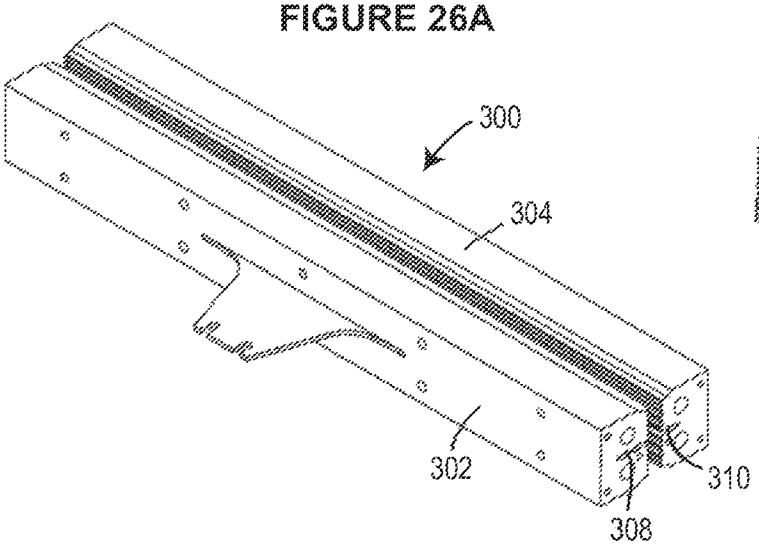
FIG. 26A is a schematic drawing of a seal jaw in accordance with an embodiment of the disclosure.
Figure 26E:
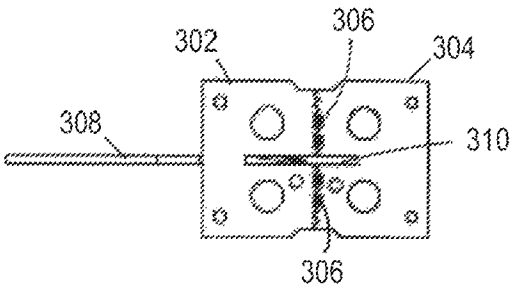
FIG. 26E is a side view of the seal jaw of FIG. 26A, showing the engagement bars in the closed position with additional force applied to compress the compressive bands on the sealing surface.
Figure 26D:
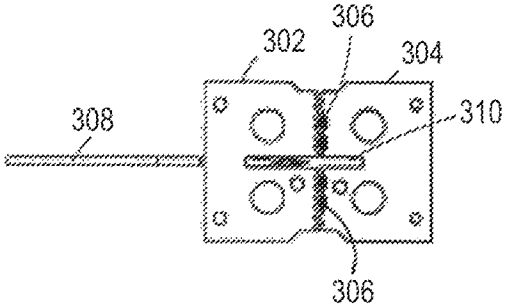
FIG. 26D is a side view of the seal jaw of FIG. 26A, showing the engagement bars in the closed position with the sealing surfaces in contact.
Figure 26C:
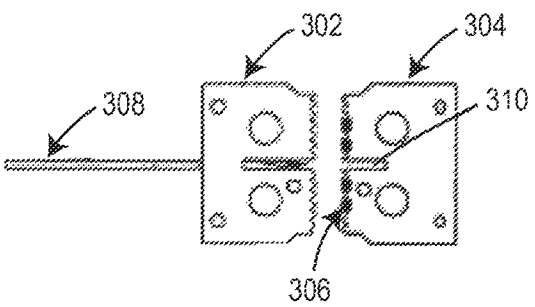
FIG. 26C is a side view of the seal jaw of FIG. 26A, showing the engagement bars in the open position.
Figure 27A:
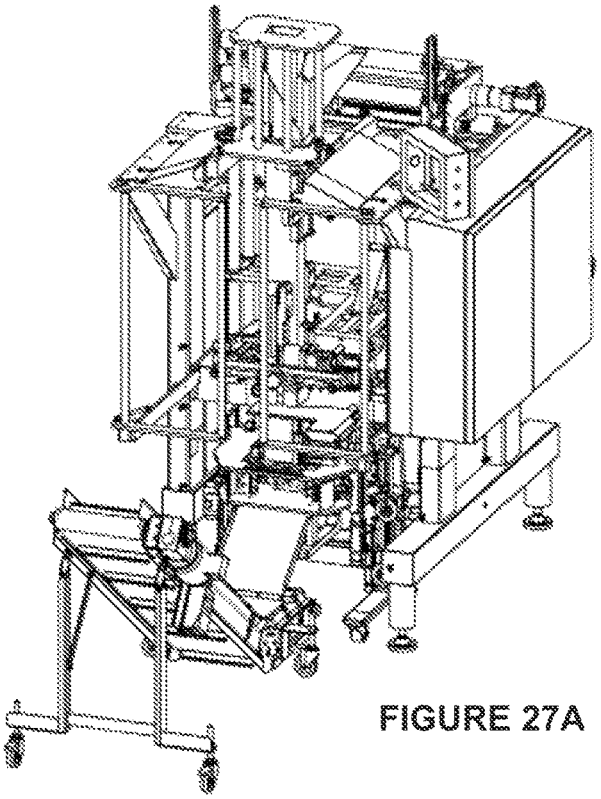
FIGS. 27A and 27B are schematic drawings of a packaging machine in accordance with an embodiment of the disclosure.
Figure 27B:
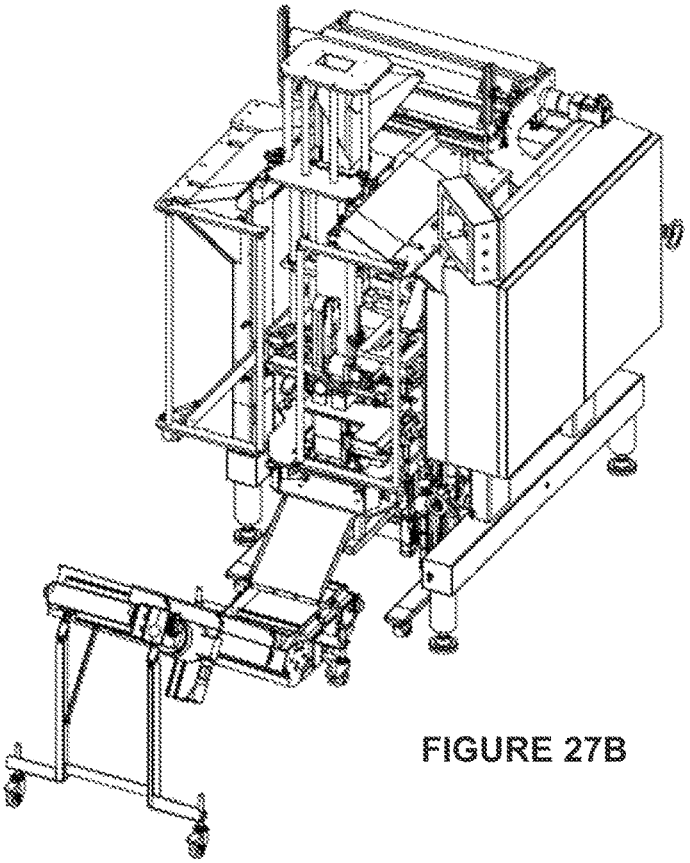
Figure 28A:
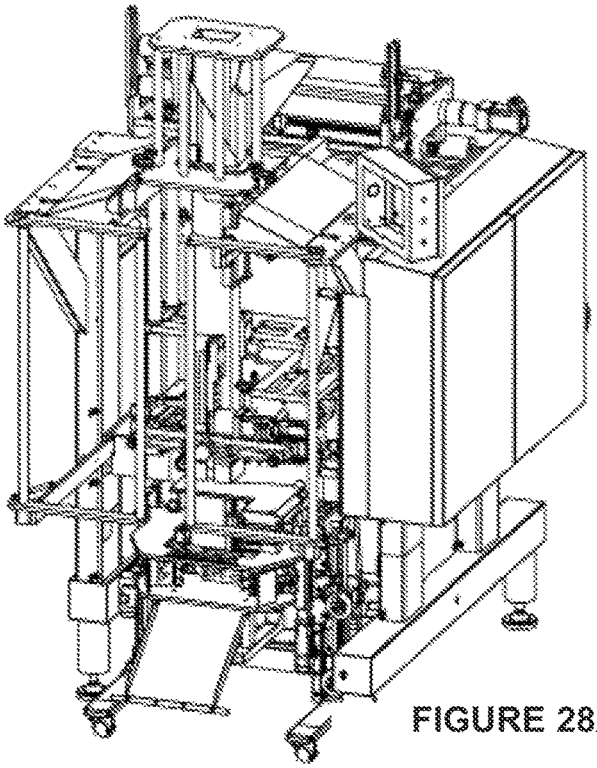
FIGS. 28A and 28B are schematic drawings of a packaging machine in accordance with an embodiment of the disclosure.
Figure 28B:
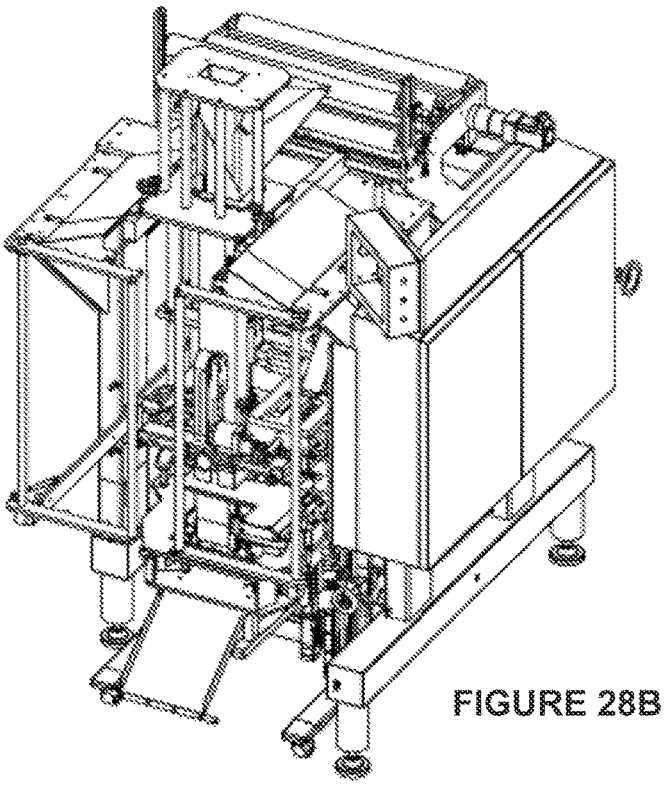

Referring to FIGS. 25A to 25F, the packaging machine can further include tuckers for inwardly tucking a portion of the flexible material during sealing of the leading and trailing seals of the package. As is known in the art, the tuckers can be coupled to a frame and one or more actuators that actuate the tuckers transverse to the transport path of the flexible material to engage the flexible material while the leading and/or trailing seals are being formed. Optionally, the one or more actuators can actuate the tuckers to rotate once engaged with the flexible material to enhance the shape of the package by more tightly creasing the flexible material at the edges. For example, the articulating tuckers 200 can include a tuck portion 202 attached to a base 204 by a hinge or spring 206, that allows the tuck portion 202 to move upward and downward relative to the base 204. The base can be attached to a frame or other structure that actuates the tucker into and out of engagement with the flexible material as known in the art. In various embodiments, the articulating tuckers may be rotated by movement of the package during sealing of the leading and trailing seals and/or lifting of the package during sealing. The articulating tuckers may also be spring-loaded to articulate in a direction parallel to the transport path when engaged with the package. The articulating tuckers can be located above and/or below the seal jaw. In an embodiment, articulating tuckers disposed above the seal jaw can be articulated upward towards the package being formed above the seal jaw. Articulating tuckers disposed below the seal jaw can be articulated downward towards the package being formed below the seal jaw. In another embodiment, the articulating tuckers can be actuated towards the seal jaw. In an embodiment, articulating tuckers can be located above and below the seal jaw, with the tuckers located above the seal jaw articulating upward towards the upstream package, and the tuckers located below the seal jaw articulating downward towards the downstream package. In yet another embodiment, articulating tuckers can be located above and below the seal jaw, with the tuckers located above the seal jaw articulating upward towards the upstream package, and the tuckers located below the seal jaw articulating upward towards the downstream package. FIGS. 25A-C illustrate a tucker in a non-articulated position and FIGS. 25D-F illustrate a tucker in an articulated position.

Referring to FIGS. 26A to 26E, the packaging machine can include one or more seal jaws for forming the leading and trailing seals of the package. Conventionally, seal jaws are provided on packaging machines to impart a seal to close the package, such as at the leading and trailing edges of the flexible material. The thickness of the flexible material can affect the ability to form a seal, in particular, a hermetic seal. With conventional seal jaws, it may be necessary to use relatively thin flexible materials in order to achieve a sufficient seal, for example, by heat sealing. Additionally, it has been problematic with conventional seal jaws to achieve suitable seals, without leakage, where there are different numbers or layers of materials present in the sealing area. Different thickness of material may be present in the seal zone due to folding of the flexible material when configuring it into the package. For example, in the seal area, the flexible material can be presented with 2 plies and 4 plies side by side as a result of folds in the package. Conventional seal jaws heat sealing through such a sealing zone can provide ineffective seal in which a portion of the seal zone at the transition between the 2 plies and 4 plies region remains unsealed. Such a defect is conventionally known as a channel leaks. This results from a gap between the seal bars that can occur in the thinner region because of the presence of the thicker region of the material in the seal zone. Conventionally, the sealing pressure was increased in an attempt to avoid channel leaks by decreasing the width of the seal. This, however, limits the types of packaging and even the products that can be stored therein as certain products and/or package configurations may be required for a given seal width.

It has been surprisingly and beneficially discovered that providing seal jaws with one or more compressive bands disposed on the sealing surface of at least one of the engagements bars can provide an effective seal without channel leaks, regardless of the width of the seal to be formed. Referring to FIGS. 26A to 26E, the seal jaw 300 can include first and second engagement bars 302, 304 each coupled to an actuator (not shown) that actuates the engagements bars 302, 304 towards and away from one another. During operation, the flexible material, for example, the leading or trailing edges of a flexible material, is received between the engagement bars 302, 304, and the engagement bars are actuated together to engage the flexible material and apply pressure and optionally heat to impart a seal in the flexible material.

One or both of the engagement bars 302, 304 can include one or more compressive bands 306 disposed on the sealing surfaces of the engagement bars 302, 304. When one of the engagement bars includes a compressive band, the compressive band is aligned with the sealing surface of the other engagement bar, such that the compressive band of one engagement bar is aligned with the sealing surface of the opposed engagement bar during the sealing operation. The sealing surface of the engagement bar can be a flat sealing surface, a ribbed sealing surface, or other textured surface. For example, the sealing surface can be machined to include channels and projections. The channels and projections can provide a wavy surface, a zigzag surface, sinusoidal surface, or any other shaped/textured surface. During operation, the engagement bars are closed together such that the flexible material disposed between the engagement bars is engaged and compressed between the compressive band and the sealing surface of the other engagement bar. In embodiments in which the sealing surface of the other engagement bar includes channels and projections, the compressive band can be aligned, for example, with a single projection of the sealing surface. In other embodiments, the compressive band can have width such that it is aligned to be contacted, through the flexible material, by two or more projections of the sealing surface of the other engagement bar. In various embodiments, both the engagement bars can include compressive bands 306 disposed on the sealing surfaces thereof. In such embodiments, the compressive bands can be arranged such that upon closing of the engagement bars, the compressive bands of one engagement bar are not aligned with the compressive band of the opposed engagement bar. As described above, the sealing surfaces of the engagement bars can each include projections and channels. The compressive bands of one engagement bar can be aligned with one or more projections of the opposed engagement bar in various embodiments. In a thicker region of the seal zone, for example, the one or more compressive bands are locally compressed to provide an increased compressive force in this region. In the thinner region, the one or more compressive bands remain less compressed or uncompressed, which allows the seal jaw to maintain contact between the seal bars despite the presence of the thicker region. That's, local compressive of the compressive bands in the thicker region of the seal zone, while having the band in an uncompressed or less compressed stat in the thinner region, prevents a gap between the engagement bars at the transition between the thick and thin regions of the seal zone, which in turn can prevent channel leaks. Additionally, because sealing pressure can be locally increased by the compressive nature of the compressive bands, the overall seal pressure can be reduced, which can reduce wear on the seal jaws.

As illustrated in FIGS. 26A to 26E, the engagement bars can include machined channels for receiving the compressive band. The machined channels can retain the compressive band by friction forces. Placement of the compressive bands in a machined channel can facilitate replacement of the bands once they become worn. For example, a machined channel formed in accordance with the Parker standard for dovetail grooves can be used when the compressive band is an o-ring. Other cross-sectional shapes for the machined channel can be used depending on the type and shape of the compressive band used. Other ways of attaching a compressive band to the engagement bar are also contemplated herein, including, for example, the use of adhesive to adhere the compressive band to the engagement bar. Adhesive can be used with or without a machined channel. The use of one or more compressive bands can extend the overall life of the seal jaws by reducing the wear on the sealing surfaces by allowing for reduced sealing pressures to be used, and/or by localizing increased sealing pressures on the compressive bands, themselves. While the compressive bands may be subject to wear, they can be easily and cost effectively replaced, leaving the seal jaw structure with a longer life span.

The compressive band can be formed of any compressive material, for example, an elastomer such as silicon rubber. For example, the compressive band can be an o-ring. A commercially available elastomer that can be used can be Viton® Fluoroelastomer (DUPONT). Other elastomeric materials can also be used as the compressive bands. In various embodiments, the seal jaw seals the flexible material by a heat seal. The elastomeric material can be selected so as to withstand the temperature necessary for imparting the heat seal. The compressive band can have any suitable width and length. For example, the compressive band can extend long the length of the entire engagement bar or a portion of the engagement bar. The engagement bar can include any suitable number of compressive bands. For example, the engagement bar can each include 1 to 10 compressive bands, 1 to 8 compressive band, 2 to 6 compressive bands, 3 to 5 compressive bands, and 4 to 8 compressive bands. Other suitable numbers of bands can include, for example, 1, 2, 3, 4, 5, 6, 7, 8, 9, and 10. When an engagement bar includes multiple compressive bands, the bands can be spaced across the sealing surface in any suitable manner. For example, in some embodiments, as illustrated in FIGS. 26A to 26E, the seal jaw can include a separator or knife 308 embedded in one of the engagement bars, with the other engagement bar including a receiving slot 310. As discussed above, one or both of the engagement bars can include compressive bands. The engagement bars can include the same or a different number of compressive bands above and below the separator and receiving slot. The spacing and/or number of compressive bands on the sealing surface of an engagement bar can be used to define a shape or characteristic to the seal. For example, the compressive bands and/or machined channels can be used to form ridge features in the seals.

While various embodiments have been described above, the disclosure is not intended to be limited thereto. Variations can be made to the disclosed embodiments that are still within the scope of the appended aspect

What is claimed:

1. An apparatus for forming a flexible package, comprising:

a forming box having a first end and an oppositely disposed second end, wherein the forming box comprises first, second, and third portions that cooperate to define first, second, third, and fourth walls of the forming box, each extending between the first and second ends;

one or more forming box actuators operatively coupled to the forming box to actuate the forming box between a first position for receiving a package, a second position in which the forming box is closed for retaining the package, and a third position for releasing the package, wherein when the package is retained in the forming box with the forming box in the second position, the package comprises a first panel disposed at or adjacent to the first end of the forming box, the first panel comprising a flap extending substantially perpendicular from the first panel such that the flap is extended in a direction substantially parallel to a transport path;

a first flap folding bar disposed upstream and adjacent the first end of the forming box; and one or more first flap folding bar actuators operatively coupled to the first flap folding bar to actuate the first flap folding bar in a direction substantially transverse to the transport path of a flexible material between a first position in which the first flap folding bar is disposed away from the forming box and a second position in which at least a portion of the first flap folding bar engages the flap forcing it over towards the first panel of the package such that the flap extend substantially parallel to the first panel, and the portion of the first flap folding bar is disposed over the first end of the forming box, wherein the first flap folding bar is operable to actuate from the first position to the second position when the package is retained in the forming box, with the forming box in the second position.

2. The apparatus of claim 1, wherein:

the first portion of the forming box comprises a first substantially planar surface extending between first and second mating ends, the second portion of the forming box comprises second and third substantially planar surfaces joined together at a first corner, and a third mating end joined to the third substantially planar surface at a second corner, the third mating end having a complementary shape to a shape of the first mating end; and the third portion of the forming box comprises fourth and fifth substantially planar surfaces joined together at a third corner, and a fourth mating end joined to the fifth substantially planar surface at a fourth corner, the fourth mating end having a complementary shape to a shape of the second mating end.

3. The apparatus of claim 2, wherein the second and third portions comprise fifth and sixth mating ends, respectively, the fifth and six mating ends having complementary shapes.

4. The apparatus of claim 1, further comprising a plate disposed beneath the forming box such that the package rests on the plate when disposed in the forming box.

5. The apparatus of claim 4, further comprising a forming member, wherein the forming member is a protrusion upwardly extending from a top surface of the plate.

6. The apparatus of claim 5, wherein the forming member includes a perimeter portion and a central portion, and wherein the perimeter portion at least partially surrounds the central portion.

7. The apparatus of claim 6, wherein the perimeter portion includes one or more segments that gradually decrease in height from the central portion to the top surface of the plate.

8. The apparatus of claim 4, wherein the plate includes one or more vent holes that allow for heated and/or cooled gas to flow through the vent holes.

9. The apparatus of claim 1 further comprising a second flap folding bar disposed upstream of the first flap folding bar and one or more second flap folding bar actuators operatively coupled to the second flap folding bar to actuate the second flap folding bar in a direction transverse to the transport path between a first position in which the second flap folding bar does not engage the package disposed in the transport path, and a second position in which the second flap folding bar engages a flap portion of the package disposed in the transport path.

10. The apparatus of claim 9, wherein the second flap folding bar comprises one or more vents arranged to direct cooling and/or heating gas towards the package when the second flap folding bar is in the second position in which the second flap folding bar engages the flap portion of the package disposed in the transport path.

11. The apparatus of claim 1, wherein the first flap folding bar actuators further actuate the first flap folding bar in a direction parallel to the transport path, such that the first flap folding bar is actuated to the second position in which at least a portion of the flap folding bar is disposed over the first end of the forming box and shifted downstream toward the first end of the forming box.

12. The apparatus of claim 1, comprising a first forming box actuator operatively coupled to the second portion and a second forming box actuator operatively coupled to the third portion, wherein the forming box is actuated between the first, second, and third positions by actuation of the second and third portions.

13. The apparatus of claim 1, further comprising at least one heater operatively coupled to the forming box to heat one or more regions of the forming box.

14. The apparatus of claim 1, wherein one or more of the first, second, and third portions comprises one or more fluid inlets fluidly coupled to one or more fluid channels fluidly coupled to one or more fluid outlets, the one or more fluid outlets are disposed at the first and/or second ends of the forming box along a surface of the one or more of the first, second, and third portions.

15. The apparatus of claim 1, wherein the first flap folding bar comprises one or more vents arranged to direct a cooling and/or heating gas towards the package when the package is disposed in the forming box.

16. An apparatus for forming a flexible package, comprising:

a forming box having a first end and an oppositely disposed second end, wherein the forming box comprises first, second, and third portions that cooperate to define first, second, third, and fourth walls of the forming box, each extending between the first and second ends;

one or more forming box actuators operatively coupled to the forming box to actuate the forming box between a first position for receiving a package, a second position for retaining the package, and a third position for releasing the package;

a first flap folding bar disposed upstream and adjacent the first end of the forming box, one or more first flap folding bar actuators operatively coupled to the first flap folding bar to actuate the first flap folding bar in a direction substantially transverse to a transport path of a flexible material between a first position in which the first flap folding bar is disposed away from the forming box and a second position in which at least a portion of the first flap folding bar is disposed over the first end of the forming box; and a volume adjuster disposed upstream of the first flap folding bar, wherein the volume adjuster comprises a transition box, a plate disposed within an interior of the transition box, and an actuator operatively coupled to the plate to actuate the plate in a direction transverse to the transport path.

17. An apparatus for forming a flexible package, comprising:

a forming box having a first end and an oppositely disposed second end, wherein the forming box comprises first, second, and third portions that cooperate to define first, second, third, and fourth walls of the forming box, each extending between the first and second ends;

one or more forming box actuators operatively coupled to the forming box to actuate the forming box between a first position for receiving a package, a second position for retaining the package, and a third position for releasing the package, wherein when the package is retained in the forming box with the forming box in the second position, the package comprises a first panel disposed at or adjacent to the first end of the forming box, the first panel comprising a flap extending substantially perpendicular from the first panel such that the flap is extended in a direction substantially parallel to a transport path;

a first flap folding bar disposed upstream and adjacent the first end of the forming box;

one or more first flap folding bar actuators operatively coupled to the first flap folding bar to actuate the first flap folding bar in a direction substantially transverse to the transport path of a flexible material between a first position in which the first flap folding bar is disposed away from the forming box and a second position in which at least a portion of the first flap folding bar engages the flap forcing it over towards the first panel of the package such that the flap extend substantially parallel to the first panel, and the portion of the first flap folding bar is disposed over the first end of the forming box; and a forming tube disposed upstream of the first flap folding bar and a pre-creasing device disposed along a portion of the forming tube, wherein the pre-creasing device comprises a first plate and a second plate disposed in facing relationship to the first plate, wherein one of the first plate or the second plate is disposed adjacent the forming tube and a pre-creaser actuator operatively coupled to one or both of the first plate and the second plate to actuate the first plate and/or the second plate towards and engagement with the other one of the first or second plate, wherein the first plate comprises one or more projections and the second plate comprises one or more apertures for receiving the one or more projections when the first and second plates is actuated into engagement with each other.

18. The apparatus of claim 17, wherein the first plate further comprises one or more apertures and the second plate further comprises one or more projections.

19. A method of making a flexible package, comprising:

actuating first, second, and third portions of a forming box to a first position for receiving a sealed package having a first seal extending substantially perpendicularly from a first panel of the sealed package;

receiving the sealed package in the forming box;

actuating the first, second, and third portions of the forming box to a second position in which the first, second, and third portions engage the sealed package and the forming box is closed to retain the sealed package;

actuating a first flap folding bar when the forming box is in the second position to fold the first seal towards the sealed package such that the seal is disposed in substantially the same plane as the first panel;

actuating the first, second, and third portions of the forming box to a third position to release the package.

20. The method of claim 19, wherein the sealed package further comprises a second seal extending from a second panel of the sealed package substantially perpendicularly from the sealed package, and the method further comprises, before receiving the sealed package in the forming box, actuating a second flap folding bar to engage the second seal and fold the second seal toward the sealed package such that the seal is disposed in substantially the same plane as the second panel.

21. The method of claim 20, wherein actuating the second flap folding bar comprises moving the second flap folding bar in a direction parallel to the second panel.

22. The method of claim 21, wherein actuating the second flap folding bar further comprises moving the second flap folding bar towards the second panel after moving the second flap folding bar in a direction parallel to the second panel.

23. The method of claim 20, wherein actuating the second flap folding bar comprises moving the second flap folding bar in an oblique motion relative to a plane containing the second panel such that the second flap folding bar is moved towards the second panel and in a direction parallel to the second panel.

24. The method of claim 19, wherein actuating the first flap folding bar comprises moving the first flap folding bar in a direction parallel to the first panel.

25. The method of claim 19, wherein actuating the first flap folding bar further comprises moving the first flap folding bar downstream toward the first panel after moving the first flap folding bar in a direction parallel to the first panel.

26. The method of claim 19, wherein actuating the first flap folding bar comprises moving the first flap folding bar in an oblique motion relative to a plane containing the first panel such that the first flap folding bar is moved towards the first panel and in a direction parallel to the first panel.

27. The method of claim 19, wherein:

the first portion comprises a first substantially planar surface extending between first and second mating ends, the second portion comprises second and third substantially planar surfaces joined together at a first corner, and a third mating end joined to the third substantially planar surface at a second corner, the third mating end having a complementary shape to a shape of the first mating end, the third portion comprises fourth and fifth substantially planar surfaces joined together at a third corner, and a fourth mating end joined to the fifth substantially planar surface at a fourth corner, the fourth mating end having a complementary shape to a shape of the second mating end, and the third and fourth mating ends contact the package when the first, second, and third portions of the forming box are actuated to the third position to force the package out of the forming box.

28. The method of claim 19, wherein:

the first portion comprises a first surface extending defining the first wall of the forming box, the second portion comprises second and third surfaces joined together at a first corner, the third surface defining the second wall of the forming box, and the second surface defining a portion of the fourth wall of the forming box, the third portion comprises fourth and fifth surfaces joined together at a third corner, the fifth surface defining the third wall of the forming box, and the fourth surface defining a remaining portion of the fourth wall of the forming box, and one or both of the third surface and/or the fifth surface includes at least one ejector extending perpendicularly to the third surface and/or the fifth surface, the at least one ejector contacting the package when the first, second, and third portions of the forming box are actuated to the third position to force the package out of the forming box.

* * * * *